US007325908B2

(12) United States Patent
Katoh et al.

(10) Patent No.: US 7,325,908 B2
(45) Date of Patent: Feb. 5, 2008

(54) PRESSURE ADJUSTMENT MECHANISM, LIQUID TANK, LIQUID PROVIDING DEVICE, INK CARTRIDGE, AND INKJET PRINTING APPARATUS

(75) Inventors: Tomomi Katoh, Kanagawa (JP); Eisuke Hori, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 234 days.

(21) Appl. No.: 10/497,924

(22) PCT Filed: Feb. 4, 2003

(86) PCT No.: PCT/JP03/01134

§ 371 (c)(1),
(2), (4) Date: Jun. 8, 2004

(87) PCT Pub. No.: WO03/066336

PCT Pub. Date: Aug. 14, 2003

(65) Prior Publication Data

US 2005/0116997 A1 Jun. 2, 2005

(30) Foreign Application Priority Data

Feb. 7, 2002 (JP) ..... 2002-030232
Feb. 18, 2002 (JP) ..... 2002-040038

(51) Int. Cl.
*B41J 2/175* (2006.01)
*B41J 2/17* (2006.01)

(52) U.S. Cl. ..... 347/85; 347/84

(58) Field of Classification Search ..... 347/84, 347/85

See application file for complete search history.

(56) References Cited

U.S. PATENT DOCUMENTS

| | | | | |
|---|---|---|---|---|
| 5,686,947 | A | 11/1997 | Murray et al. | |
| 6,322,207 | B1 * | 11/2001 | Hall et al. | 347/85 |
| 6,428,152 | B1 * | 8/2002 | Hollands | 347/85 |
| 6,450,629 | B2 * | 9/2002 | Childers | 347/85 |
| 6,726,313 | B1 * | 4/2004 | Oda et al. | 347/85 |
| 6,773,099 | B2 * | 8/2004 | Inoue et al. | 347/86 |
| 2001/0020970 | A1 * | 9/2001 | Kuribayashi et al. | 347/85 |
| 2002/0012030 | A1 * | 1/2002 | Okamoto et al. | 347/85 |
| 2002/0145649 | A1 * | 10/2002 | Hirano et al. | 347/85 |

FOREIGN PATENT DOCUMENTS

EP 0983857 3/2000

(Continued)

OTHER PUBLICATIONS

Jan. 19, 2007 Chinese official action (and English Translation) in connection with Chinese Patent Application No. 038018675.

*Primary Examiner*—Stephen Meier
*Assistant Examiner*—Rene Garcia, Jr.
(74) *Attorney, Agent, or Firm*—Cooper & Dunham, LLP

(57) ABSTRACT

A pressure adjustment mechanism can provide ink to a subtank with the inside of the subtank being opened to outside air, by using a low driving force. A liquid tank holds liquid to be used by a printing apparatus. The liquid tank has a structure in which a capacity of the liquid tank can be changed so as to generate a negative pressure in the liquid tank. The liquid tank includes a case having an opening at one side of the tank, and a flexible film that covers the opening, and a compressed spring in the tank for pressing the film outwards.

52 Claims, 33 Drawing Sheets

FOREIGN PATENT DOCUMENTS

| | | | |
|---|---|---|---|
| JP | 2-113950 | | 4/1990 |
| JP | 04005053 | | 1/1992 |
| JP | 04244854 | | 9/1992 |
| JP | 6-336028 | | 12/1994 |
| JP | 08104011 | | 4/1996 |
| JP | 08104011 | A * | 4/1996 |
| JP | 8-183185 | | 7/1996 |
| JP | 08267779 | | 10/1996 |
| JP | 9-66610 | | 3/1997 |
| JP | 10128992 | | 5/1998 |
| JP | 10235892 | | 9/1998 |
| JP | 2000-70773 | | 3/2000 |
| JP | 2000-185411 | | 7/2000 |
| JP | 2000211151 | | 8/2000 |
| JP | 2001038920 | | 2/2001 |
| JP | 2001063087 | | 3/2001 |
| JP | 2001-199084 | | 7/2001 |
| JP | 2001-253089 | | 9/2001 |
| JP | 2002205418 | | 7/2002 |
| JP | 2002370374 | | 12/2002 |
| JP | 2003048328 | | 2/2003 |
| JP | 2003053995 | | 2/2003 |
| WO | WO96/34761 | | 11/1996 |

* cited by examiner

PRESSURE ADJUSTMENT MECHANISM, LIQUID TANK, LIQUID PROVIDING DEVICE, INK CARTRIDGE, AND INKJET PRINTING APPARATUS

TECHNICAL FIELD

The present invention relates to a pressure adjustment mechanism for an inkjet head device, and an inkjet printer that uses the pressure adjustment mechanism. Specifically, with this pressure adjustment mechanism, a driving mechanism can use a low driving force when ink is provided to an ink subtank provided at the inkjet head device with the inside of the subtank being open to the outside air. Specifically, the inkjet printer uses the pressure adjustment mechanism to provide ink to the inside of the subtank while adjusting a pressure of the subtank.

The present invention also relates to a liquid tank, a liquid providing device, an ink cartridge, and an inkjet printer (inkjet printing apparatus).

BACKGROUND ART

FIG. 1 is a perspective view showing disassembled elements that are used at a conventional inkjet head device of an inkjet printer. In FIG. 1, the reference number 10 designates a lever, 13 a driving mechanism for driving the lever 10, 20 a carriage for mounting an inkjet head thereon, 21 an air releasing pin, 22 a negative pressure pin, 23 an elastic member, 30 a subtank mounted on the carriage 20 for holding ink, 31 an air releasing opening used for adjusting a pressure inside a subtank case to be an atmospheric pressure, 32 a negative pressure lever, 40 an inkjet head (hereinbelow, referred to as a head), 50 an ink cartridge, and 51 a connection tube for connecting the ink cartridge 50 to the subtank 30 to provide ink to the subtank 30.

In the case of an inkjet printer that includes the cartridge containing a large amount of ink, or an inkjet printer for producing high quality image, when the ink cartridge and the head are attached in the carriage together, the weight of the carriage can affect the operation the head so as to cause the image to be out of the correct position at the time the carriage 20 works. For this reason, as shown in FIG. 1, the ink cartridge 50 is disposed external to the carriage 20, and the subtank 30 that temporarily holds ink is mounted on the carriage 20.

When the inside pressure of the subtank 30 is positive, ink leaks (is exuded) from the head 40 due to the weight of the ink in the subtank 30. Accordingly, it is necessary to set the inside pressure of the subtank 30 to be negative. Such pressure setting becomes important when ink is ejected from the head. However, the ink can be mixed with air that enters the subtank 30 from the ink cartridge 50 or the connection tube 51. As a result, an amount of the air in the subtank 30 gradually increases, and thereby, the inside pressure of the subtank 30 changes so as to degrade the image formed by the ink. In order to deal with this problem, the ratio of the air inside the ink cartridge 50 as well as the inside pressure of the ink cartridge 50 are periodically controlled so as to become the original values.

FIG. 2 is a perspective view showing disassembled elements of the subtank 30. The subtank 30 includes a case 33 having an approximately rectangular upper wall 39*a*, an approximately rectangular bottom wall 39*b*, and three approximately rectangular side walls 39*c*. The case 33 has one open side. The subtank 30 further includes a film 34 for covering the one open side of the case 33, an elastic member 36 for pressing the film 34 from the inside of the case 33 via a plate 35, and a negative pressure lever 32 that is elastic and plate-shaped and presses the film 34 towards the inside of the case 33 from the outside of the case 33. The setting is made such that the force on the film 34 exerted from the inside by the elastic member 36 is larger than the force on the film 34 exerted from the outside by the negative lever 32. Accordingly, at the initial setting, the film 34 is pressed outwards. The balanced position of the film 34 determined by the negative pressure lever 32 and the elastic member 36 changes in accordance with the change in the inside pressure of the subtank 30 during the operation. When an amount of the ink in the subtank 30 decreases, the film 34 is pressed inwards, accompanying the change (reduction) of the inside pressure.

In a normal state, an air releasing opening 31 provided on one of the side walls 39*c* is sealed with an elastic member 311 such as a spring, a sphere 312, an elastic member 313 such as rubber, and a cap 314 that closely contact with one another. Also, in a normal state, an ink providing opening 37 provided on the upper wall 39*a* of the case 33 is sealed with an elastic member 371 such as a spring, a sphere 372, an elastic member 373 such as rubber, and a cap 374 that closely contact with one another. The spheres 312 and 372 are pressed by the elastic members 311 and 371, respectively. The ink providing opening 37 becomes open by the pressure of the ink that flows to the subtank 30 from the cartridge 50 via the connection tube 51 shown in FIG. 1, and thereby, the flowing ink is provided to the inside of the subtank 30. The air releasing opening 31 becomes open when the air releasing pin 21 provided on the carriage 20 shown in FIG. 1 is pressed inwards to adjust the inside pressure of the subtank 30.

The negative pressure pin 22 of the carriage 20 presses the negative pressure lever 32 of the subtank 30 inwards from the outside. That is, the negative pressure pin 22 is pressed inwards so that the negative pressure lever 32 can be moved towards the inside of the subtank 30, and the inside capacity of the subtank 30 can decrease. The elastic member 23 is provided for forcing the negative pressure lever 32 and the negative pressure pin 22 to be separated from each other. Therefore, in a normal state, the negative pressure lever 32 and the negative pressure pin 22 do not contact each other due to the elastic member 23.

In the operation of the inkjet head device having the above-described structure, the air releasing pin 21 is operated to open the air releasing opening 31, and the negative pressure pin 22 is operated to press the negative pressure lever 32 inward so that an inside capacity of the subtank 30 can become reduced. Then, in the state in which the subtank 30 has the reduced capacity, the subtank 30 is filled with ink via the ink providing opening 37. The filled ink is detected by filled ink detection sensors 38 disposed at the upper part of the subtank 30. Based on the result detected by the filled ink detection sensors 38, providing of the ink is controlled. In accordance with this control, the volumes of air and ink inside the subtank 30 are determined. Then, the air releasing opening 31 is closed. In the state in which the air releasing opening 31 is closed, the negative pressure lever 32 that is held at the inward position is released by removing the inward pressing force on the negative pressure lever 32. By performing such an operation, it is possible to control the inside pressure of the subtank 30 to be a constant negative pressure, and to stabilize ink ejection characteristics of the head 40.

FIG. 3 is a perspective view showing an example of the structure of a driving mechanism provided at the main body side of the printer for pressing and moving the negative pressure pin 22 and the air releasing pin 21. In FIG. 3, the reference number 10 designates a lever, 11 an air releasing pin pressing part, 12 a negative pressure pin pressing part, 14 a cam, 15 a solenoid, 16 an elastic member, 17 a sensor (HP sensor), and 18 a rotational shaft. The lever 10 includes the air releasing pin pressing part 11 for pressing the air releasing pin 21, and the negative pressure pin pressing part 12 for pressing the negative pressure pin 22. The pressing phase or level at which the air releasing pin pressing part 11 presses the air releasing pin 21 is different from the pressing phase or level at which the negative pressure pin pressing part 12 presses the negative pressure pin 22. With this difference in the pressing phase, when the lever 10 is operated, the air releasing opening 31 is made open by the air releasing opening pin 21 before the negative pressure lever 32 is pressed. Furthermore, with this difference in the pressing phase, after the air releasing pin 21 is moved outwards, and the air releasing opening 31 is thereby made closed, the pressing force acting on the negative pressure lever 32 by the negative pressure pin 22 is released.

The elastic member 16 drives the lever 10 to move in the direction opposite the direction of pressing the negative pressure pin 22 and the air releasing pin 21. The rotational shaft 18 to which the cam 14 is attached is provided for moving the lever 10 so as to perform the pressing operation of the negative pressure pin 22 and the air releasing pin 21. Accompanying the rotation of the rotational shaft 18, the cam 14 acts on the lever 10 so as to move (rotate) the lever 10. The solenoid 15 having a flapper is provided for rotating the rotational shaft 18. A filler provided on the rotational shaft 18 releases/shields the sensor 17 so that the sensor 17 can detect a home position (HP) of the rotational shaft 18.

The above-described ink filling operation in which the subtank 30 is filled with ink by pressing the negative pressure pin 22 and the air releasing pin 21 is referred to as an air releasing filling operation. In the air releasing filling operation, it is possible to keep a pressure in the subtank 30, an amount of the ink in the subtank 30, and an amount of the air in the subtank 20 at desired values. On the other hand, an ink filling operation in which only ink is provided to the subtank 30 without pressing the negative pressure pin 22 and the air releasing pin 21 is referred to as a normal filling operation. In the normal filling operation, the air amount in the subtank 30 that has gradually increased is not controlled, so that the inside pressure of the subtank 30 is shifted from a desired value.

FIG. 4 is a partial schematic illustration for a lever operation mechanism provided at the main body of the printer. In the above-described structure, in order to press and move the negative pressure pin 22 and the air releasing pin 21, it is necessary to apply a force to the lever 10 that is larger than the reaction force by the negative pressure pin 22 and the air releasing pin 21. As shown in FIG. 4, in the conventional structure of the cam 14, the lever 10 is rotated counterclockwise by the cam 14, the cam 14 being rotated clockwise by the rotational shaft 18. Accordingly, the reaction force R1 by the lever 10 acts on the rotational shaft 18 to apply a rotational force R2 that drives the cam 14 to rotate in the direction opposite the desired operation direction. For this reason, in order to rotate the cam 14 to move the lever 10, a motor or a solenoid that has a high driving force is conventionally used as a driving mechanism at the main body of the printer for operating the lever 10.

However, the air releasing filling operation needs to be performed only when the air amount inside the subtank 30 increases, and in reality, the necessary frequency of the air releasing filling operation is much smaller than that of the normal filling operation. Accordingly, in terms of the manufacturing costs of the printer, it is not wise to use the expensive motor or solenoid for the air releasing filling operation having the less necessary frequency.

FIGS. 5A, 5B, and 5C are illustrations for the lever operation at the carriage on which plural-color subtanks are mounted. The order of the lever operation procedure is from FIG. 5A to FIG. 5C. In FIGS. 5A through 5C, the subtanks (not shown) that correspond to a plurality of colors (in this example, four colors) are provided on the carriage 20. In the drawings, air releasing pins 21*a* through 21*d*, and negative pressure pins 22*a* through 22*d* that correspond to the respective subtanks extend from the carriage 20. For example, in the case of tying to press the air releasing pin 21*a* and the negative pressure pin 22*a* located at the most left side of the carriage 20 when seen from the pin side to perform the air releasing filling operation, the air releasing pins 21*b* through 21*d* and the negative pressure pins 22*b* through 22*d* of the other subtanks corresponding to the pins 21*b* through 21*d* and pins 22*b* through 22*d* are also successively pressed by the lever 10, accompanying the movement of the carriage 20. When these affected other subtanks are not filled with the ink, the air amounts in the subtanks become larger than in the case where the appropriate air releasing filling operation is performed. Furthermore, in this case, the inside pressures of the suntanks cannot be controlled to be a desired value.

Furthermore, in the related art, generally, an inkjet printing apparatus is applied to an image printing apparatus or an image forming apparatus such as a printer, a facsimile machine, a copying machine, and a plotter. A printing head of the inkjet printing apparatus includes a nozzle for ejecting ink, a ejection room (a pressure room, a pressurized liquid room, or an ink passage) that communicates with the nozzle, and energy generation means for generating energy that is used for pressurizing the ink in the ejection room. When an image is recorded on paper by a serial printer, a carriage is moved in a main running direction, paper is fed in a sub-running direction, and the ink is ejected from the printing head. Instead of paper, any medium on which the ink will adhere may be used.

In such a serial inkjet printing apparatus, ink needs to be provided to the printing head mounted on the carriage. Generally, the printing head and an ink cartridge (or an ink tank) that provides ink are disposed together on the carriage. The ink cartridge integrally formed with the printing head may be disposed on the carriage.

An appropriate ink meniscus needs to be formed at the nozzle hole of the head when such an ink cartridge is used. Furthermore, it is necessary to prevent bubbles or foam from being formed. In addition, when the head is disposed so as to, be oriented in the downward direction, the ink needs to be prevented from dropping and leaking from the nozzle. For these reasons, the ink pressure needs to be negative. Accordingly, an inkjet printing apparatus that has a porous ink absorption body for absorbing the ink and that generates a negative pressure is widely used.

In another usage example, a subtank having a small capacity is disposed on the carriage, and a main cartridge having a large capacity is disposed at the main body side of the printer. In this arrangement, the ink is supplied to the subtank from the main cartridge disposed at the main body side.

In the case where the only ink cartridge is disposed on the carriage without using the main cartridge at the main body side, the ink cartridge needs to be replaced with new one when the ink cartridge runs out of the ink. Accordingly, when the ink is frequently used for high speed printing or high quality image printing, the cartridge needs to be replaced more frequently. On the other hand, when the capacity of the ink cartridge is made large, the weight of the entire carriage becomes large. Accordingly, it becomes difficult to move the carriage at a high speed, and further, the size of the carriage and the like becomes large. In addition to that, the output energy of the motor for driving the carriage needs to be large. Moreover, the weight of the carriage changes significantly, so that the movement characteristics of the carriage change during the printing operation, and it becomes difficult to maintain stable printing accuracy.

According to Japanese Laid-Open Patent Application Nos. 10-128992 and 10-235892, a subtank having a small capacity is disposed on the carriage, and the main cartridge having a large capacity is disposed at the main body side of the printer. The subtank is connected to the main cartridge by a tube. With this structure, when the ink in the subtank decreases, the ink is supplied to the subtank from the main cartridge. Further, according to Japanese Patent No. 3053017, two tubes, i.e., an ink providing tube and an air sucking tube are connected to the suntank.

In the above-described ink cartridge, the ink in the cartridge is sucked via the nozzle so that the negative pressure can be generated. The generated negative pressure is maintained by the porous body. However, the ink is wasted without being used, and the absorbing body for holding the waste ink in the printer becomes larger. In addition, using the only ink cartridge disposed on the carriage causes the ink shortage more often.

In the case of the printer disclosed in the above Japanese Laid-Open Patent Application Nos. 10-128992 and 10-235892, since the tube has permeability of air and moisture, the air enters the inside of the tube. Also when the ink supply unit is attached or detached, the air enters the inside of the tube. Since the disclosed printers do not have a function of discharging the air mixed with the ink inside the ink supply passage (the tube), a large amount of air enters the subtank when the tube is used for a long time, resulting in printing being degraded.

Furthermore, in the printer disclosed in the above Japanese Patent No. 3053017, the ink is provided to the subtank while the air is discharged from the subtank. Accordingly, the air is not accumulated in the subtank. However, in this printer, it is necessary to connect two tubes, that is, the ink providing tube and the air sucking tube to the subtank. Particularly, in the case of the color inkjet printing apparatus, eight tubes need to be connected to respective subtanks corresponding to four colors.

In this case, the subtanks are moved with the subtank being disposed on the carriage, the tubes connected to the subtanks need to have lengths that are at least equal to the length of the movement of the subtanks. Accordingly, it is necessary to arrange the plural long tubes in the printer, and to provide a special pump for generating the negative pressure, resulting in high manufacturing costs.

DISCLOSURE OF THE INVENTION

It is a general object of the present invention to provide a pressure adjustment mechanism that enables a relatively low driving force used for operation of a subtank that holds ink, and an inkjet printer that uses this pressure adjustment mechanism.

It is another object of the present invention to provide a liquid tank in which a negative pressure in the liquid tank can be adjusted without increasing waste ink, with a simple structure.

It is another object of the present invention to provide a liquid providing device that can reliably provide liquid to a printing head or the like for a long time.

It is another object of the present invention to provide an inkjet printing apparatus that can perform stable printing for a long time.

It is another object of the present invention to provide an ink cartridge having a simple structure in which the ink cartridge is integrally formed on a head such as a printing head, and a negative pressure in the ink cartridge can be adjusted without increasing the amount of waste ink.

According to a first aspect of the present invention, there is provided a pressure adjustment mechanism for an inkjet head device, comprising: a head that ejects ink; a carriage that mounts the head thereon and moves; a subtank that is mounted on the carriage, temporarily holds ink provided from a cartridge, and provides the temporarily held ink to the head; a lever that is moved to adjust a pressure inside the subtank; and driving means for moving the lever selectively to a first position of the lever or a second position of the lever. Specifically, in this pressure adjustment mechanism, the subtank includes pressure adjustment means that have air releasing control means and negative pressure control means, the air releasing control means are provided on a side wall of the subtank, enabling an inside of the subtank to be opened to outside air, and enabling the inside of the subtank to be closed from outside air, and the negative pressure control means generate a negative pressure inside the subtank. Further, in this pressure adjustment mechanism, the lever acts on the pressure adjustment means at the first position of the lever when the carriage is at a second position of the carriage, and the acting on the pressure adjustment means by the lever is released at the second position of the lever. Furthermore, in this pressure adjustment mechanism, the driving means includes a cam that acts on the lever so as to move the lever, and means for rotating the cam. In addition, in this pressure adjustment mechanism, when the carriage is at a first position of the carriage where the lever does not act on the pressure adjustment means even if the lever is moved to the first position of the lever, the lever is moved by the driving means to the first position of the lever, and the carriage is moved to the second position of the carriage with the lever being at the first position of the lever to perform air releasing control for the subtank and negative pressure control for the subtank.

With this pressure adjustment mechanism, it is possible to realize a relatively low driving force of the driving means, and to manufacture the driving means at a low cost.

According to a second aspect of the present invention, the pressure adjustment mechanism of the first aspect further comprises: a plurality of subtanks that are mounted on the carriage, have a substantially same structure as that of said subtank and hold ink whose types are different from each other; a plurality of levers that have a substantially same structure as that of said lever; and a plurality of pressure adjustment means that are respectively provided on the plurality of subtanks, and have a substantially same structure as that of said pressure adjustment means, wherein each of the plurality of pressure adjustment means receives action applied by one of the plurality of levers (or each of the plurality of pressure adjustment means are activated by one of the plurality of levers).

With this pressure adjustment mechanism, it is possible to perform the negative pressure control of the subtanks independently of each other. Furthermore, the time required for providing ink to the subtanks with the insides of the subtanks being open to outside air can be reduced. In addition, it is possible to keep a stable inside pressure of each subtank.

According to a third aspect of the present invention, in the pressure adjustment mechanism of the first aspect or the second aspect, the pressure adjustment means include an air releasing pin that enables an air releasing opening formed on the subtank to be opened and closed so as to perform the air releasing control, the negative pressure means include a negative pressure pin that moves a part of a wall constituting the subtank so as to control a pressure inside the subtank to be a desired negative pressure, the lever presses the air releasing pin and the negative pressure pin at the first position of the lever when the carriage is at the second position of the carriage, and the lever is separated from the air releasing pin and the negative pressure pin at the second position of the lever, and the air releasing pin is separated from the negative pressure pin in a vertical direction.

With this pressure adjustment mechanism, it is possible to perform the pressure control of the subtank at a predetermined procedure or timing when ink is provided to the subtank with the inside of the subtank being open to outside air.

According to a fourth aspect of the present invention, in the pressure adjustment mechanism of any one of the first aspect to the third aspect, when the lever acts on the pressure adjustment means, and receives a reaction force that is generated from the pressure adjustment means and that causes a stress acting on the lever in a direction of releasing the acting by the lever on the pressure adjustment means, the stress received by the lever acts on the cam towards a center axis of a rotational shaft of the cam so as to restrain movement of the lever caused by the stress.

With this pressure adjustment mechanism, it is possible to use the driving mechanism that generates low torque.

According to a fifth aspect of the present invention, in the pressure adjustment mechanism of any one of the second aspect to the fourth aspect, when a series of movements of one of the plurality of levers successively or simultaneously causes some of the plurality of pressure adjustment means to function, ink is provided to some of the plurality of subtanks corresponding to the some of the plurality of pressure adjustment means.

With this pressure adjustment mechanism, when ink is provided to a plurality of subtanks, the inside pressures of the subtanks can be prevented from changing. In other words, in the case where ink is provided to a plurality of subtanks of plural colors, it is possible to prevent the inside pressures of the plurality of subtanks from changing, by providing ink to the plurality of subtanks with the insides of the plurality of subtanks being open to outside air.

According to a sixth aspect of the present invention, there is provided an inkjet printer comprising the pressure adjustment mechanism described in any one of the first aspect to the fifth aspect. This inkjet printer provides ink to an inside of the subtank or insides of the subtanks while the inkjet printer uses the pressure adjustment mechanism so as to adjust a pressure in the subtank or pressures in the subtanks.

According to a seventh aspect of the present invention, there is provided a liquid tank having a structure in which a capacity of the liquid tank can be changed so as to generate a negative pressure in the liquid tank.

Preferably, this liquid tank includes an air releasing opening that can be opened and closed so as to open and close the inside of the liquid tank to outside air. A negative pressure can be generated by opening and closing the air releasing opening, and changing the capacity of the liquid tank. Preferably, the liquid tank includes an air releasing valve that is provided at the air releasing opening and can keep the air releasing opening closed from outside air, by using a spring member.

Preferably, the liquid tank includes a liquid providing opening used for providing liquid to the inside of the liquid tank from outside the liquid tank. Preferably, a position of the liquid providing opening is lower than a position of the air releasing opening. Preferably, the liquid tank includes reverse flow prevention means for preventing liquid from flowing in reverse via the liquid providing opening from the inside to the outside of the liquid tank. The reverse flow prevention means may be valve means, or a fluid resistance part that produces large fluid resistance. Further, a valve that is opened and closed in accordance with a pressure inside the liquid tank may be provided at the liquid providing opening. In addition, liquid providing to the liquid tank may be stopped after the liquid providing opening is filled with the liquid.

Furthermore, the liquid tank preferably includes pressing means for pressing the liquid tank from outside the liquid tank. Preferably, the liquid tank includes a displacement member that moves in accordance with change in a capacity or a volume of the liquid tank. Preferably, an amount of movement of the displacement member is larger than an amount of deformation of the liquid tank that indicates change of the capacity of the liquid tank. The displacement member may cause the capacity of the liquid tank to be changed. Further, the displacement member may be made of a material having high thermal conductivity. Further, liquid providing to the liquid tank may be controlled based on a position of the displacement member.

Preferably, at least two detection electrodes are provided at an upper part of the inside of the liquid tank, and extend to respective different depths in the liquid tank. Preferably, the liquid tank includes an air extraction space that communicates with the air releasing opening, and one of the detection electrodes is provided at the air extraction space.

In addition, a spring member for generating a negative pressure may be provided inside the liquid tank, and a spring member for maintaining a negative pressure may be provided inside the liquid tank. The inside of the liquid tank may be divided into two rooms so that different kinds of liquid can be held in the respective rooms.

According to an eighth aspect of the present invention, there is provided a liquid providing device having any one of the above-described liquid tanks. The liquid providing device may include liquid providing means for providing liquid to the liquid tank by using a difference in a pressure head. Preferably, the liquid providing device includes a driving member that is disposed on a member for fixing the liquid tank and moves so as to change a capacity of the liquid tank. Preferably, the liquid providing device includes restriction means for restricting an amount of the movement of the driving member. Further, a gap preferably exists between the driving member and the liquid tank, and the liquid providing device includes a spring member for maintaining the gap.

According to a ninth aspect of the present invention, there is provided a liquid providing device that includes a liquid tank having an air releasing opening, and liquid providing means for providing liquid to the liquid tank by selecting either a state where the inside of the liquid tank is opened to outside air, or a state where the inside of the liquid tank is closed from outside air.

According to a tenth aspect of the present invention, there is provided a liquid tank that includes an air releasing opening, and opening/closing means for opening the air releasing opening in accordance with a surrounding temperature.

According to an eleventh aspect of the present invention, there is provided a liquid providing device that includes a liquid tank having an air releasing opening, and an opening/closing driving member that is provided on a member for fixing the liquid tank and moves so as to open and close the air releasing opening. Preferably, the liquid providing device includes restriction means for restricting the movement of the opening/closing driving member. Further, a gap preferably exists between the opening/closing driving member and the liquid tank. In addition, the liquid providing device preferably includes a spring member for maintaining this gap.

According to a twelfth aspect of the present invention, there is provided an inkjet printing apparatus that includes any one of the above-described liquid tanks (ink tanks), or any one of the above-described liquid providing devices (ink providing devices). Preferably, the inkjet printing apparatus includes means for wiping a nozzle surface of an inkjet head before the negative pressure is generated in the liquid tank.

According to a thirteenth aspect of the present invention, there is provided an ink cartridge that includes an inkjet head for ejecting ink, and any one of the above-described liquid tanks that is integrally formed on the inkjet head.

BEST MODE FOR CARRYING OUT THE INVENTION

First, a first embodiment of the present invention will be described with reference FIGS. 6 through 10. In the following description of the first embodiment of the present invention, a pressure adjustment mechanism for adjusting a pressure inside a subtank that holds ink, and an inkjet printer using this pressure adjustment mechanism are described in detail.

Figure 1:
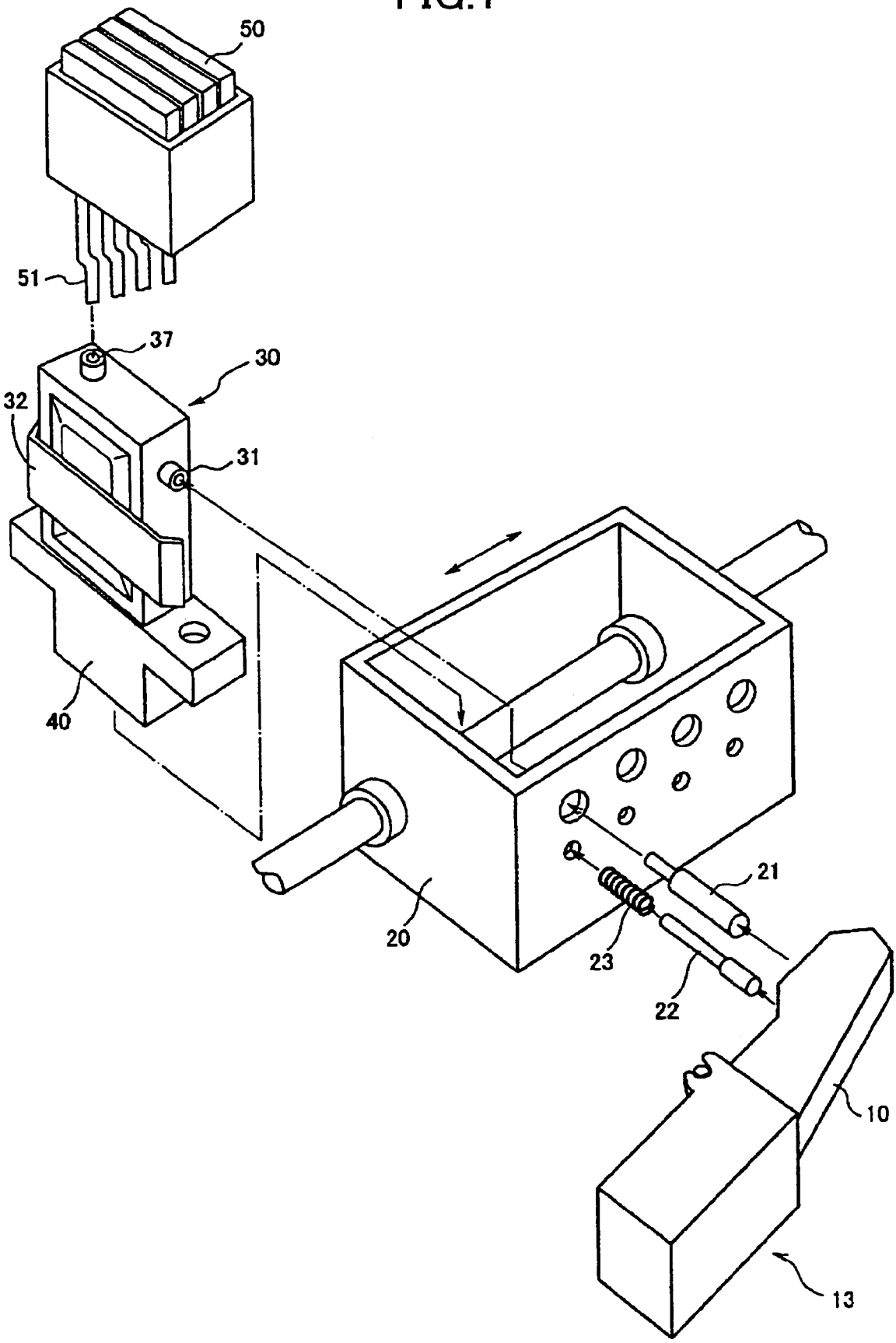
FIG. 1 is a perspective structural view of disassembled elements provided at an inkjet head device of an inkjet printer in the related art.
Figure 2:
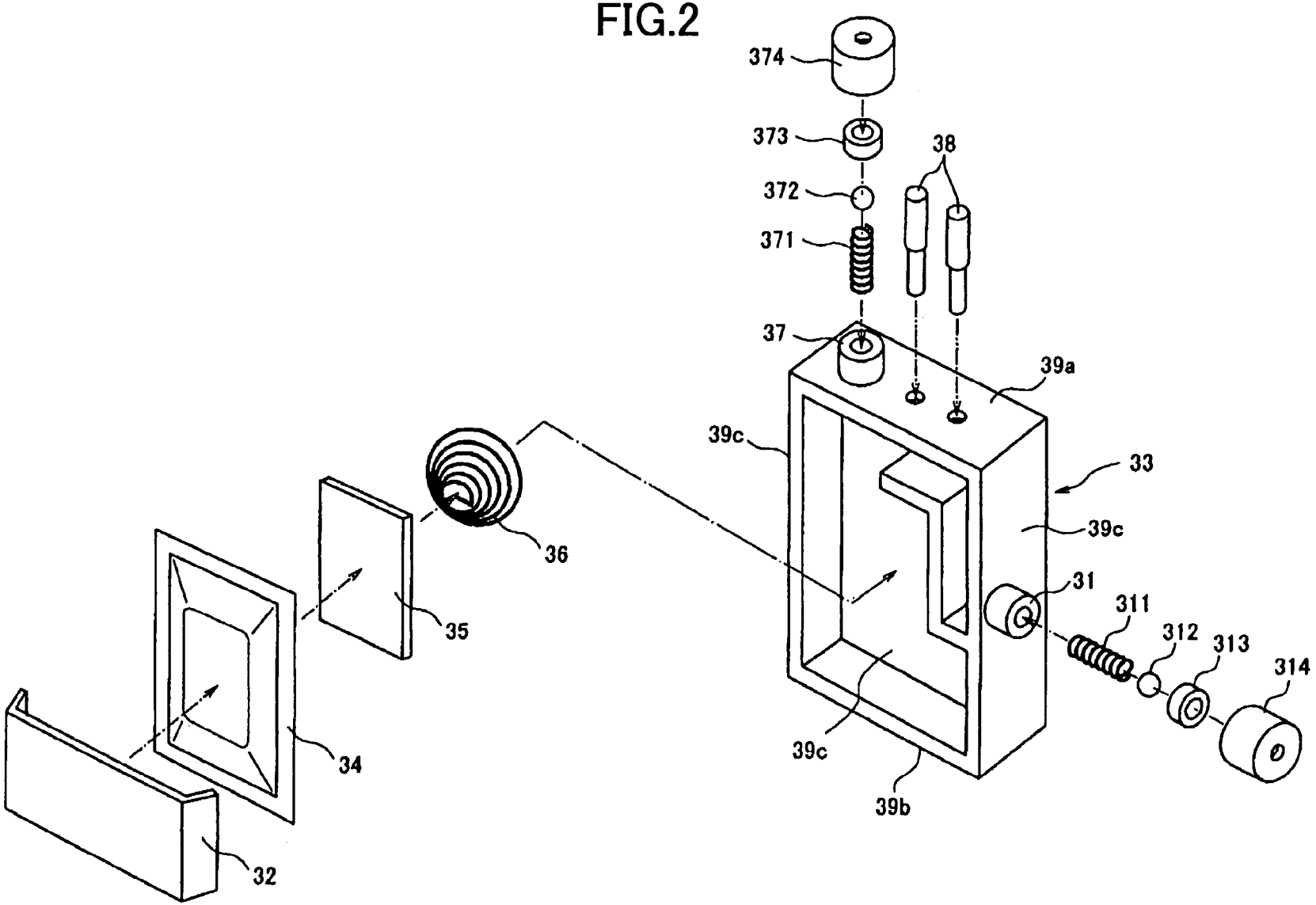
FIG. 2 is a detailed perspective view of a disassembled subtank shown in FIG. 1.
Figure 3:
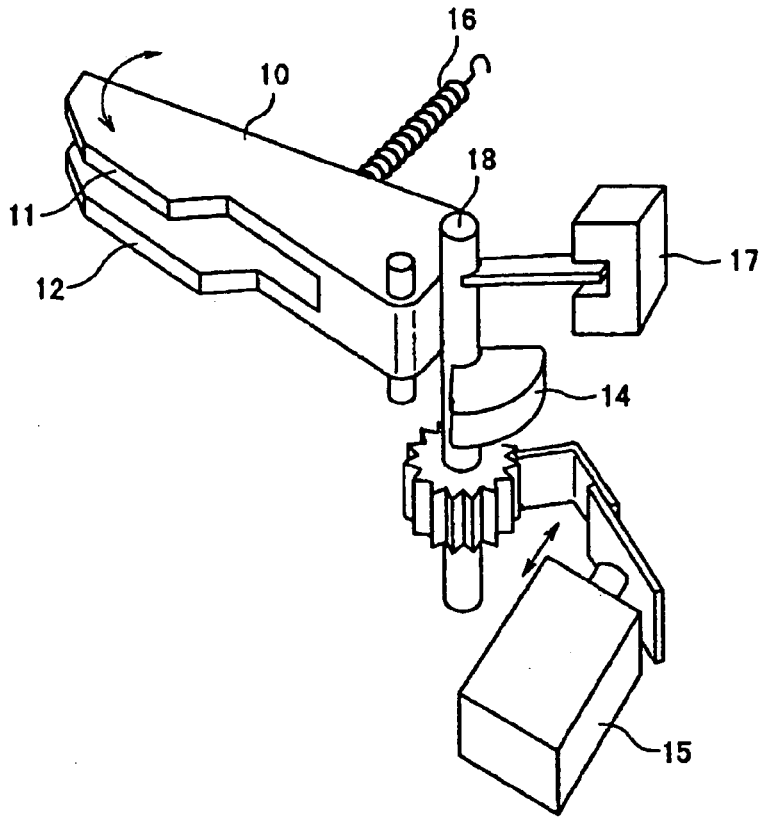
FIG. 3 is a perspective view of a driving mechanism for pressing and moving a negative pressure pin and an air releasing pin in the related art.
Figure 4:
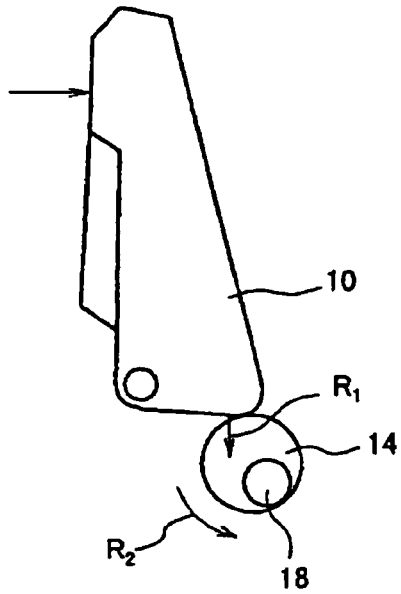
FIG. 4 is a partial schematic view showing an operation mechanism of the driving mechanism shown in FIG. 3.
Figure 5A:
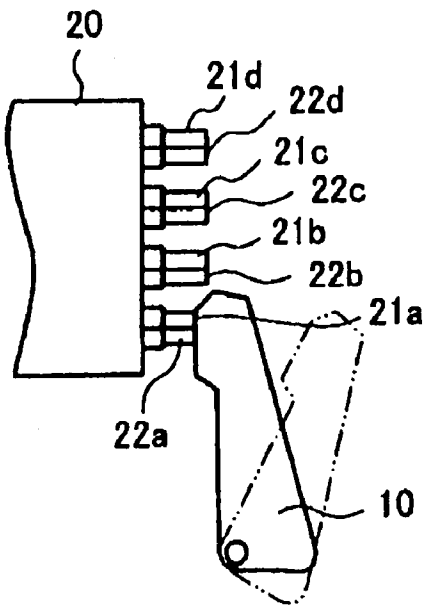
FIGS. 5A through 5C show a lever operation at a carriage on which subtanks corresponding to a plurality of colors are mounted in the related art.
Figure 5B:
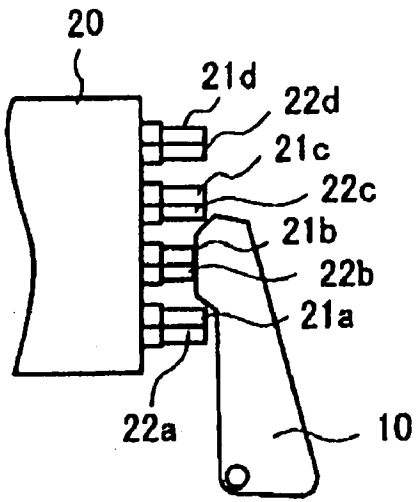
Figure 5C:
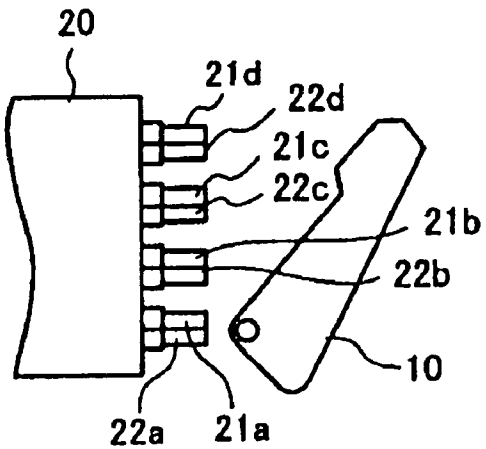
Figure 6:
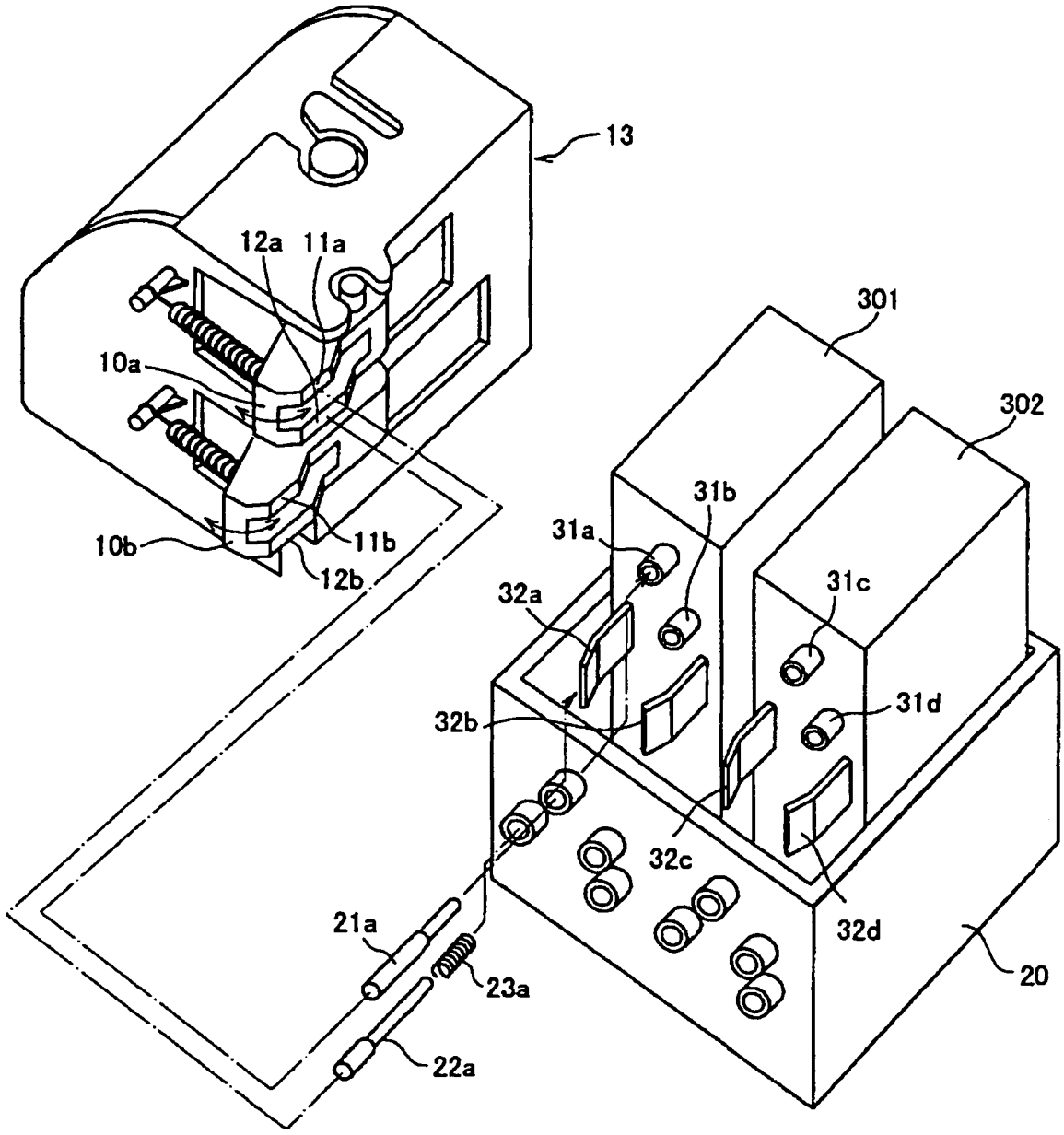
FIG. 6 is a perspective view showing disassembled elements of a part of an inkjet printer according to the present invention.

FIG. 6 is a partial perspective view showing disassembled elements in an inkjet printer according to the present invention. In FIG. 6, the reference numbers 10*a* and 10*b* designate a first lever and a second lever, respectively, 11*a* and 11*b* air opening releasing pin pressing parts of the first and second levers 10*a* and 10*b*, respectively, 12*a* and 12*b* negative pressure pin pressing parts of the first and second levers 10*a* and 10*b*, respectively, 13 a driving unit, 21*a* an air releasing pin, 22*a* a negative pressure pin, 23*a* an elastic member, 301 and 302 subtank units, 31*a* through 31*d* air releasing openings, and 32*a* through 32*d* negative pressure levers. The air releasing pins 21*a* through 21*d* and negative pressure pins 22*a* through 22*d* correspond to respective colors, but only the air releasing pin 21*a*, the negative pressure pin 22*a*, and the elastic member 23*a* corresponding to the first color are shown in FIG. 6, and the other corresponding elements for other colors are not shown in FIG. 6.

In this embodiment, the inkjet printer includes the driving unit 13 having two driving mechanisms each of which is similar to the mechanism using the lever 10 described above and shown in FIGS. 1 through 5C. Each of the subtank units 301 and 302 has two subtanks. Each color can be held by one of the subtanks. The air releasing openings 31*a* and 31*b*, and the negative pressure levers 32*a* and 32*b* are provided on the subtank unit 301, and the air releasing opening 31*b* and 31*c*, and the negative pressure levers 32*c* and 32*d* are provided on the subtank unit 302. As shown in FIG. 6, the driving unit 13 has two levers 10*a* and 10*b*. As for the first color, the air releasing pin 21*a* and the negative pressure pin 22*a* are separate from each other in the vertical direction. Also as for the other colors, the air releasing pin and the negative pressure pin are separate from each other in the vertical direction in the same manner as the pins 21*a* and 22*a*. Furthermore, in this example, the air releasing pin 21*a* of the first color and the air releasing pin 21*c* of the third color are in alignment with each other in the horizontal direction. Similarly, in this example, the air releasing pin 21*b* of the second color and the air releasing pin 21*d* of the fourth color are aligned with each other in the horizontal direction, the negative pressure pin 22*a* of the first color and the negative pressure pin 22*c* of the third color are aligned with each other in the horizontal direction, and the negative pressure pin 22*b* of the second color and the negative pressure pin 22*d* of the fourth color are aligned with each other in the horizontal direction. The air releasing pins 21*a* and 21*b* are separated from each other with respect to the vertical direction, and the negative pressure pins 22*a* and 22*b* are separated from each other with respect to the vertical direction.

With this structure, the first lever 10*a* at the upper side can press only the air releasing pins 21*a* and 21*c*, and the negative pressure pins 22*a* and 22*c* corresponding to the first and third colors, and the second lever 10*b* at the lower side can press only the air releasing pins 21*b* and 21*d*, and the negative pressure pins 22*b* and 22*d* corresponding to the second and fourth colors. In this example, the driving unit 13 has two levers 10*a* and 10*b*, but may have four levers for pressing respective air releasing pins and negative pressure pins of four subtanks that correspond to four colors of ink. Since when four or more levers are provided on the driving unit 13, a size in the vertical direction becomes larger, an appropriate plurality of levers may be provided on the driving unit 13 in accordance with the size restriction.

Figure 7:
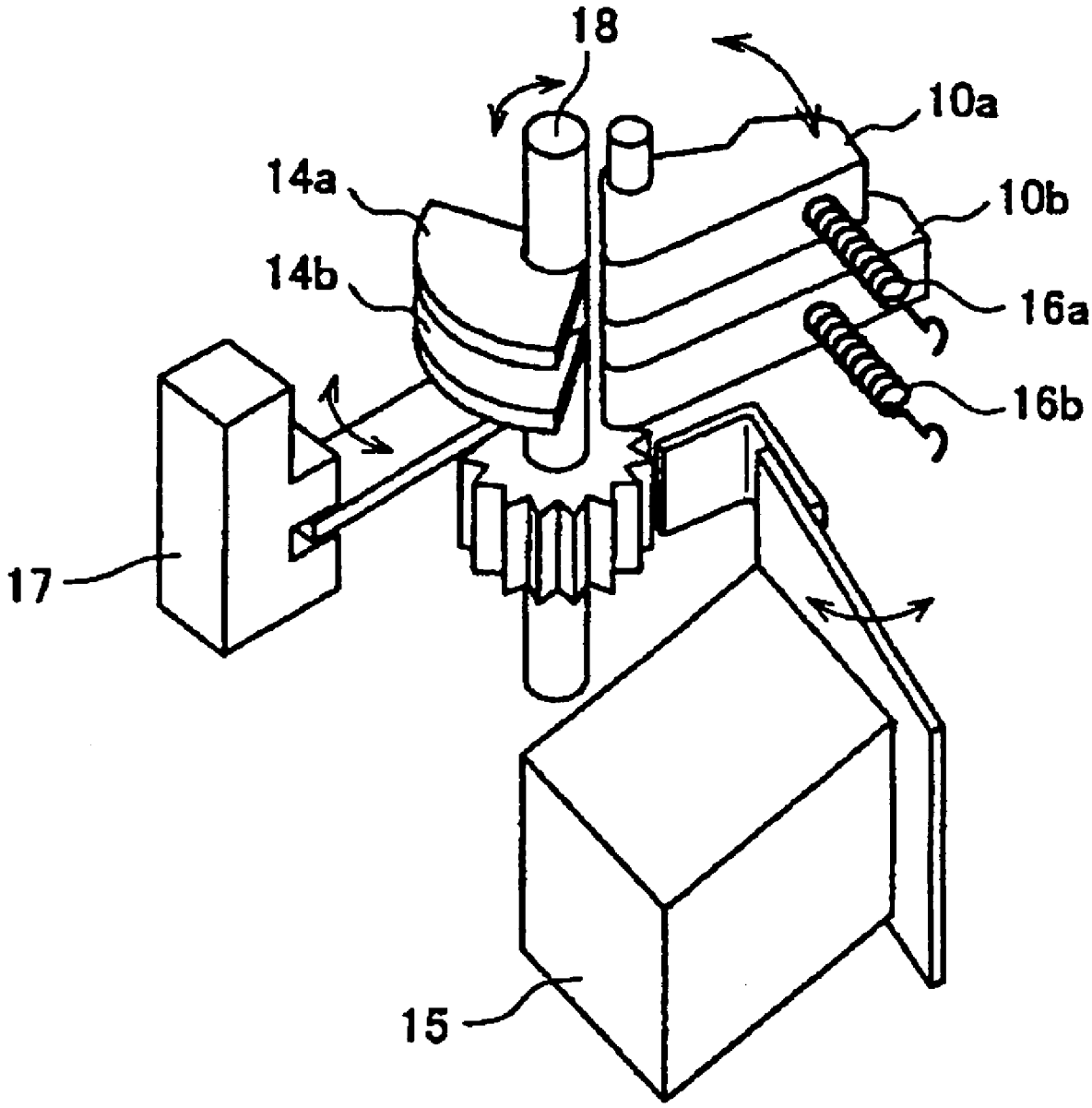
FIG. 7 shows a driving mechanism of a driving unit shown in FIG. 6.

FIG. 7 is an illustration of the structure of the driving unit 13 shown in FIG. 6. Elements shown in FIG. 7 correspond to the elements of the lever driving mechanism shown in FIGS. 8A through 8H. In FIG. 7, the reference number 18 designates a rotational shaft, 14*a* and 14*b* cams corresponding to the levers 10*a* and 10*b* respectively, 15 a DC solenoid, 16*a* and 16*b* elastic members for driving the levers 10*a* and 10*b* respectively, and 17 a sensor (HP sensor). In this embodiment of the present invention, the DC solenoid is operated so that the rotational shaft 18 can be rotated to cause the cams 14*a* and 14*b* to move the levers 10*a* and 10*b*, respectively. In this manner, the pressing/releasing operation is performed on the air releasing pins 21*a* through 21*d*, and the negative pressure pins 22*a* through 22*d*.

FIGS. 8A through 8H are illustrations for the operation of the driving unit for the inkjet head, and the operation of the carriage 20. The operation order is from FIG. 8A to FIG. 8H. As described above, each of the levers 10*a* and 10*b* moves between the position where each of the levers 10*a* and 10*b* presses the air releasing pins and the negative pressure pins by the working of the cam and the position where each of the levers 10*a* and 10*b* is separate from the air releasing pins and the negative pressure pins. Hereinbelow, the position where each of the levers 10*a* and 10*b* presses the air releasing pins and the negative pressure pins is referred to as the pin pressing position, and the position where the pressing forces on the air releasing pins and the negative pressure pins are released is referred to as the pressure releasing position. In this example, the two subtanks that each accommodate different colors of ink are attached to the carriage 20, and the first color to the fourth color correspond to the air releasing pin 21*a* to the air releasing pin 21*d*, respectively.

Figure 8A:
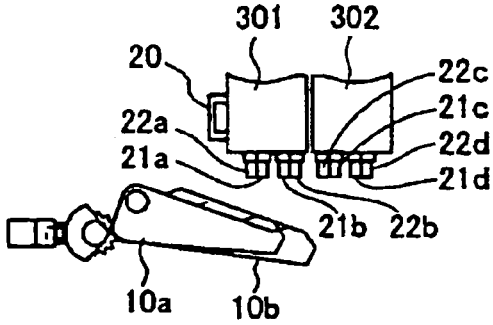
FIGS. 8A through 8H are partial schematic view of an operation of the driving unit and a carriage shown in FIG. 6.
Figure 8B:
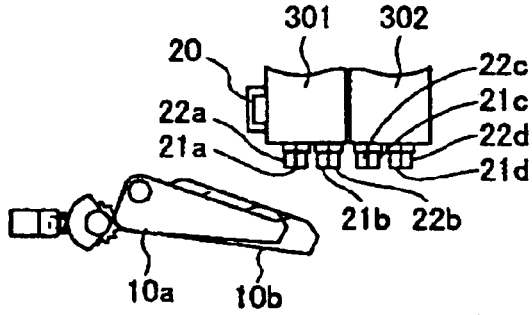

First, as shown in FIG. 8A, the carriage 20 is positioned at the suction position where the ink suction/filling operation can be carried out, and the levers 10*a* and 10*b* of the driving unit are positioned at the pressure releasing position. At this time, the sensor 17 confirms that the levers 10*a* and 10*b* are positioned at the home positions. Next, the carriage 20 is moved by 10.5 mm in the right direction when seen from the lever side in FIG. 8A. This moved position of the carriage 20 shown in FIG. 8B is referred to as the first carriage waiting position.

Figure 8C:
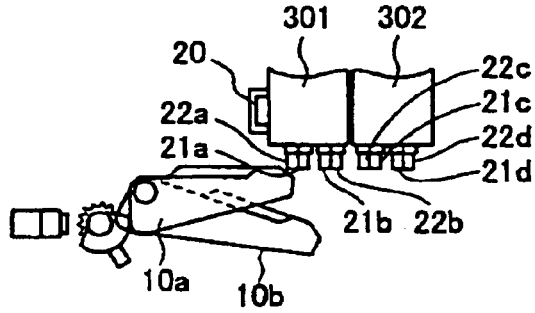
Figure 8D:
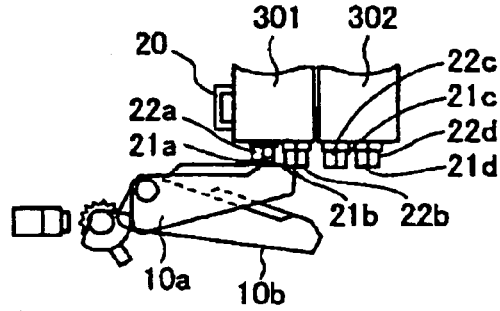

Subsequently, at the first carriage waiting position, the first lever 10*a* is operated so as to be set at the pin pressing position, as shown in FIG. 8C. In this state, the carriage 20 is moved to the suction position where the lever 10*a* can push the pins 21*a* and 22*a*. Since the first lever 10*a* is set at the pin pressing position, the air releasing pin 21*a* and the negative pressure pin 22*a* of the first color are pressed by the first lever 10*a*, accompanying the movement of the carriage 20, as shown in FIG. 8D.

In this example, the sum of the reaction forces of the pins 21*a* and 22*a* is 300 gf, but the attraction force of the solenoid may be 20 gf. In other words, if at the suction position, the lever 10*a* is rotated to press the pins 21*a* and 22*a*, the lever 10*a* cannot push the pins 21*a* and 21*b* when the driving force of the solenoid is weak. However, according to the embodiment of the present invention, at the position where the lever 21*a* cannot push the pins 21*a* and 22*a*, the lever 21*a* is set at the pin pressing position before pushing the pins 21*a* and 22*a*, and in this state, the carriage 20 is moved to the suction position. In this manner, the structure can be made such that the reaction forces of the pins 21*a* and 22*a* act towards the center of the rotational shaft 18 via the lever 10*a*. Accordingly, the rotational shaft 18 can receive the reaction forces of the pins 21*a* and 22*a*. With this pushing manner and the structure, the lever 10*a* is not moved back to the pressure releasing position, and a stable operation can be carried out.

Figure 8E:
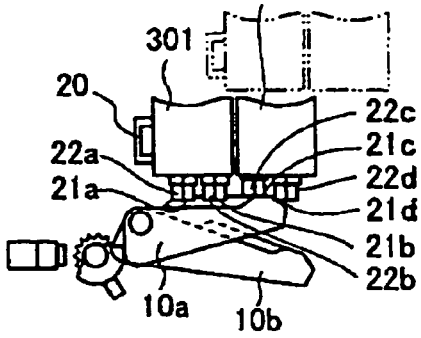

When the carriage 20 is further moved to the left side when seen from the pin side, the pins 21*a* and 22*a* are released from the protruding parts of the lever 10*a*, and the pins 21*a* and 22*a* are not being pressed by the lever 10*a*, as shown in FIG. 8E. In this example of FIG. 6 in which the driving unit 13 has two levers 10*a* and 10*b*, when the air releasing filling operation is performed on the pins of the first color, the pins of the second color arranged next to the pins of the first color are not affected, i.e., not pushed, but the air releasing pin 21*c* and the negative pressure pin 22*c* of the third color are pushed by the first lever 10*a*, accompanying the movement of the carriage 20 because the pins are arranged as shown in FIG. 6.

Figure 8F:
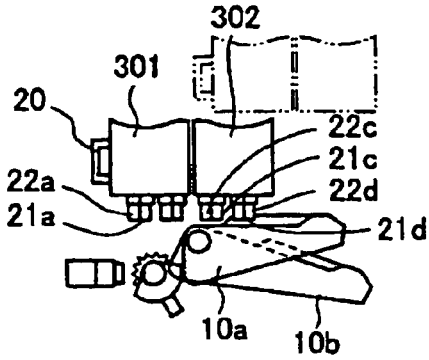

When the carriage 20 is further moved from the position shown in FIG. 8E to a second carriage waiting position shown in FIG. 8F, the pins 21*c* and 22*c* are released from protruding parts (the air releasing pin pressing part and the negative pressure pressing part) of the first lever 10*a*, and the pins 21*c* and 22*c* are not being pressed by the first lever 10*a*. In this state shown in FIG. 8F, the solenoid is operated so that the first lever 10*a* can be rotated back to the pressure releasing position without being affected by the reaction forces of the pins 21*c* and 22*c*.

Figure 8G:
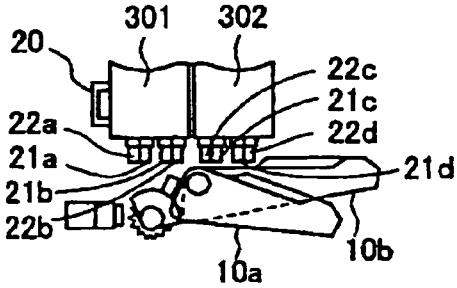
Figure 8H:
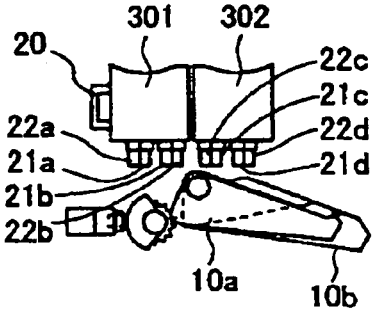

Meanwhile, when the air releasing filling operation is carried out on the second and fourth colors, the second lever 10*b* is operated. In other words, at the second carriage waiting position shown in FIG. 8F, the second lever 10*b* is operated to be set at the pin pressing position, as shown in FIG. 8G. Thereafter, the carriage 20 is moved to the right side in FIG. 8G so that the air releasing pin 21*d* and the negative pressure pin 22*d* of the fourth color, and the air releasing pin 21*b* and the negative pressure pin 22*b* of the second color are successively pushed by the second lever 10*b* (this operation is not shown). In this manner, the air releasing filling operation is carried out. Then, while the carriage 20 is made to be positioned where the reaction forces of pins do not affect the second lever 10*b*, the second lever 10*b* is rotated back to the pressure releasing position, as shown in FIG. 8H, for example.

In this lever operation, when the first and second levers 10*a* and 10*b* are rotated, the loads from the air releasing pins 21*a* through 21*d* and the negative pressure pins 22*a* through 22*d* are not applied to the first and second levers 10*a* and 10*b*. As described above, if the forces from the pins 21*a* through 21*d* and the pins 22*a* through 22*d* are applied to the levers 10*a* and 10*b*, these forces work against the rotation of the cam, and increase the load on the solenoid.

Figure 9:
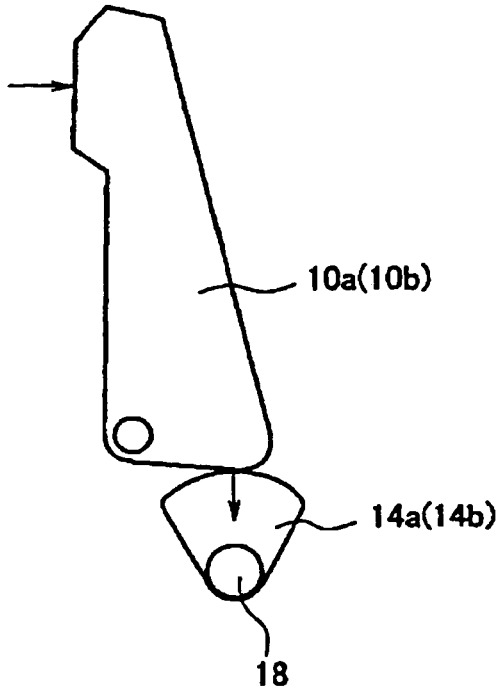
FIG. 9 shows the engagement between a cam and a lever shown in FIG. 7.

According to this embodiment, as shown in FIG. 9, the shapes of the cams 14*a* and 14*b*, and the engaging state between each cam and each of the levers 10*a* and 10*b* are optimized so that even when the reaction forces by the pins act on the levers 10*a* and 10*b*, the reaction forces of the pins can act on the rotational shaft 19 toward the rotational center of the rotational shaft 18. In this manner, the reaction forces of the pins do not function as the rotational force of the rotational shaft 18. Accordingly, it is not necessary to provide a mechanism for preventing the rotation of the cam caused by the reaction forces, resulting in low manufacturing costs of the lever driving unit.

In the above-described embodiment, even when the air releasing filling operation needs to be performed for the only one color in the subtank, for example, at the time of exchanging the cartridge, the air releasing filling operation is performed on all the colors of the subtanks. For example, in this embodiment, when the subtank corresponding to the first color needs to be filled with the ink, the inside pressure of the subtank corresponding to the third color is also affected by the operation of the first lever 10*a*, and is temporarily changed. However, the air releasing filling operation is also performed on the subtank corresponding to the third color so that the inside pressure of the subtank corresponding to the third color can be maintained at a desired value.

In addition, according to the present invention, the lever may be provided for each subtank. With this structure, when the air releasing filling operation is performed on one subtank corresponding to one color, the inside pressures of the subtanks corresponding to the other colors are not affected.

Figure 10:
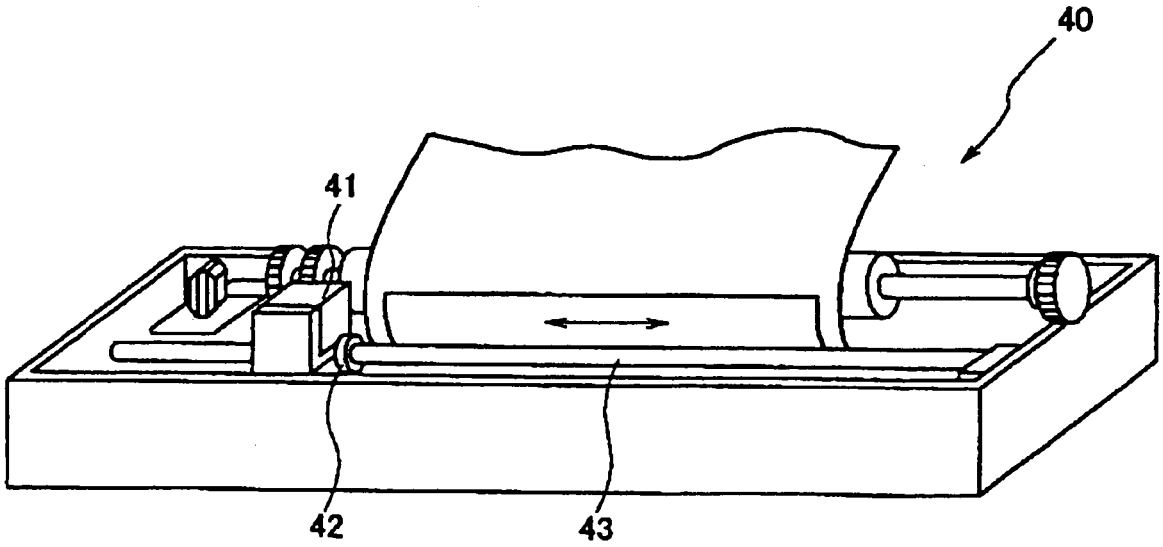
FIG. 10 is a perspective view of an example of the inkjet printer according to the present invention.

FIG. 10 is a perspective view showing one example of the inkjet printer according to the present invention. In FIG. 10, the reference number 40 designates the inkjet printer, 41 an inkjet head device, 42 a carriage for mounting the inkjet head device 41 thereon and moving the carriage in the directions indicated by the arrows in this figure, and 43 a rod for supporting the carriage 42 such that the carriage can move axially along the rod. The inkjet printer 40 may be structured such that the pressure adjusting mechanism as described above can be applied to the inkjet head device 41. With this structure, it is possible to realize an inkjet printer having the driving mechanism for performing the air releasing filling operation that can be structured at a low cost.

Figure 11:
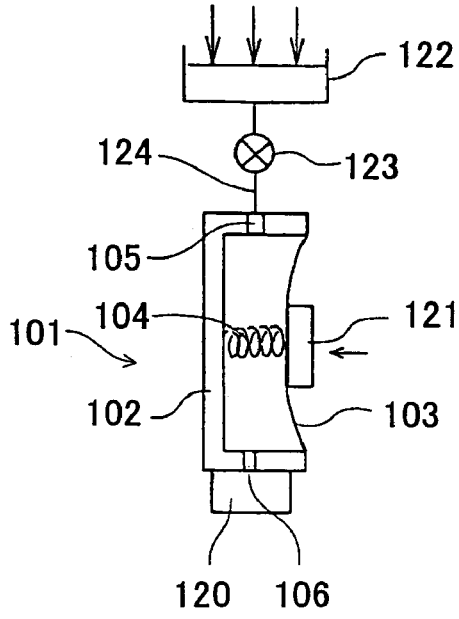
FIG. 11 shows the basic structure of an ink tank according to a second embodiment of the present invention.

A second embodiment of the present invention will be described with reference to FIGS. 11 and 12. In FIG. 11, the basic structure of an ink tank is shown, and in FIG. 12, the operation of the ink tank is shown. The ink tank 101 includes a case 102, and a flexible film 103. The case 102 is made of resin or the like, and has an opening at the one side thereof. The flexible film 103 closes the opening of the case 102. A compressed spring 104 for pressing the film 103 outwards is provided inside the case 102. An ink providing opening (or ink providing hole) 105 for providing ink to the ink tank 101, and an ink supply opening (or ink supply hole) 106 for supplying the ink to an inkjet head 120 that is a printing head are formed on the case 102.

The ink tank 101 and the inkjet head 120 may be separately provided such that the only ink tank can be replaced. Alternatively, an ink cartridge may be configured so as to include the ink tank 101 and the inkjet head 120 that are integrally united.

A restriction member 121 is provided at the outside of the film 103 so as to move relative to the film 103. The procedure of providing ink to the ink tank 101 is as follows. When the ink tank 101 is to be filled with the ink, this restriction member 121 is advanced so as to press and move the film 103 against the force of the compressed spring 104 so that the capacity of the ink tank 101 can be made smaller than the capacity in the normal state. An ink tube 124 is connected to the ink providing opening 105 from an ink providing source 122 such as a main ink tank via a valve 123.

In this state, the valve 123 is made to open so that the ink can be provided to the inside of the ink tank 101 from the ink providing source 122. At this time, the air inside the ink tank 101 is pushed and discharged to the outside of the ink tank 101 via the ink supply opening 106 and a nozzle of the inkjet head 120. After the required ink is provided to the ink tank 101, the valve 123 is closed so as to shut the communication between the ink tank 101 and the ink providing source 122.

Figure 12:
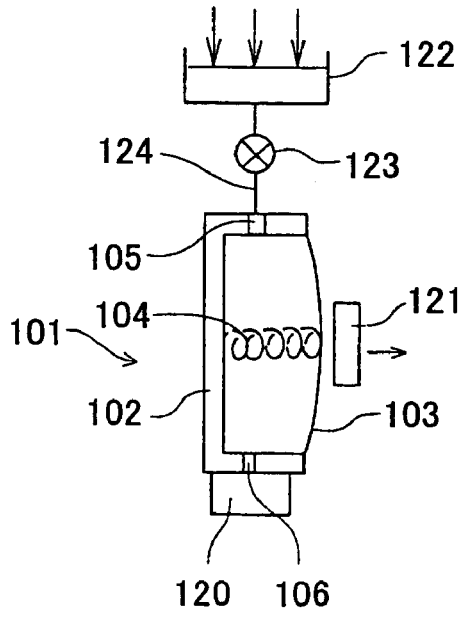
FIG. 12 shows the operation of the ink tank shown in FIG. 11.

Next, the nozzle face of the inkjet head 120 is temporarily closed, and the restriction member 121 is moved back so as to be separated from the ink tank 101, as shown in FIG. 12. Since the restriction member 121 is separated from the ink tank 101, the compressed spring 104 tries to restore the original shape to press the film 103 outwards. Accordingly, the capacity of the ink tank 101 becomes larger, and a negative pressure is thereby generated inside the ink tank 101 in accordance with the spring force.

According to this embodiment, the ink tank 101 is configured such that the capacity of the ink tank 101 can change. By using the capacity change of the ink tank 101, it is possible to generate the negative pressure in the ink tank 101. In this example, the negative pressure can be controlled by the compressed degree of the spring, so that it is possible to easily generate and maintain the appropriate negative pressure.

Figure 13:
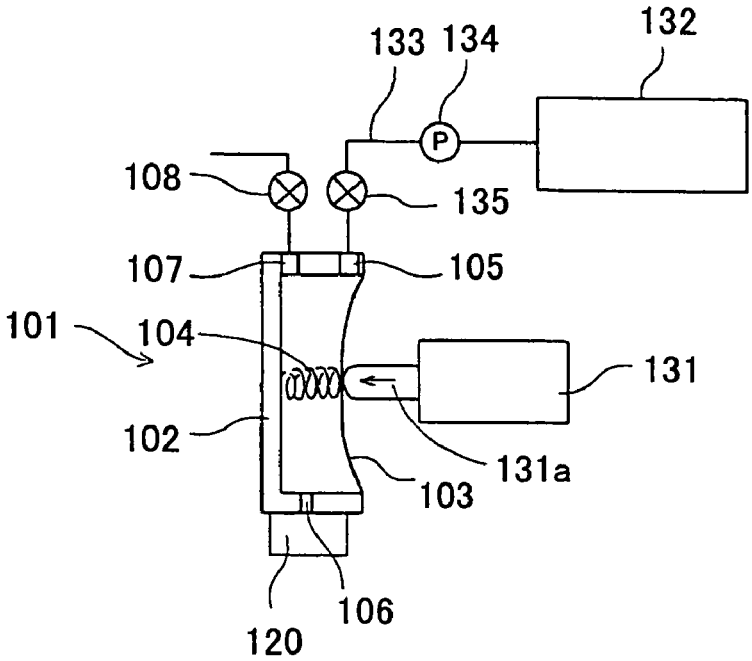
FIG. 13 shows an ink providing device including an ink tank according to a third embodiment of the present invention.
Figure 14:
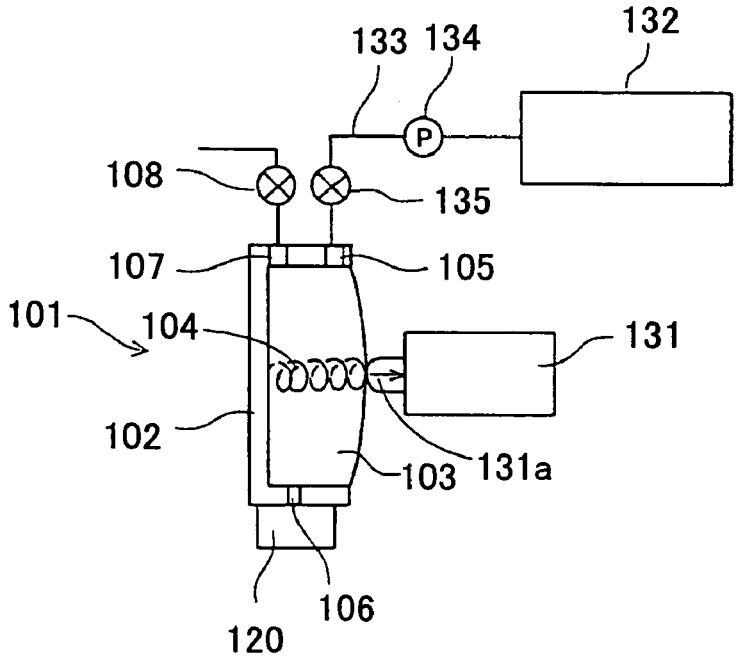
FIG. 14 shows the operation of the ink providing device shown in FIG. 13.

Next, a third embodiment of the present invention will be described with reference to FIGS. 13 and 14. The basic structure of an ink tank 101 of an ink providing device of the third embodiment is shown in FIG. 13, and the operation of the ink providing device is shown in FIG. 14. In this embodiment, an air releasing opening 107 for opening the inside of the ink tank 101 to the outside is formed on the ink tank 101. An air releasing valve 108 for opening and closing the air releasing opening 107 is provided at the air releasing opening 107.

The ink providing device supplies the ink to the ink tank 101 in accordance with operating necessity. The ink providing device includes the ink tank 101 and pressing means 131. The pressing means includes a plunger 131*a* that moves forwards to press a flexible film 103 against the spring force of a compressed spring 104 and that moves backwards to release the pressure on the film 103. The pressing means 131 that are driving means may include a driving element such as a solenoid actuator, or may be operated via a link mechanism or the like.

The ink providing device includes a main cartridge 132 that is ink supply means that accommodate a large amount of ink. The main cartridge 132 is connected to an ink providing opening 105 of the ink tank 101 by a tube 133. A supply pump 134 for pressurizing and sending the ink of the main cartridge 132 and a supply valve 135 for opening and closing the ink supply passage (i.e., the tube 133) are provided on appropriate positions of the tube 133 between the main cartridge 132 and the ink tank 101.

In the ink providing device including such an ink tank 101, the ink providing procedure is as follows. When the ink is supplied to the ink tank 101, as shown in FIG. 13, an air releasing valve 108 is made open so as to open the air releasing opening 107, that is, open the inside of the ink tank 101 to the outside air. Next, the pressing means 131 is driven to move the plunger 131*a* forwards so as to press the film 103 of the ink tank 101 against the spring force of the compressed spring 104. In this manner, the inside capacity of the ink tank 101 is decreased.

Thereafter, in this state, the valve 135 is made open, and the supply pump 134 is operated so that the ink in the main cartridge 132 can be sent in the pressurized state to the inside of the ink tank 101 via the supply tube 133. In this manner, a predetermined amount of ink is provided to the ink tank 101. When the ink supply to the ink tank 101 is completed, the operation of the supply pump 134 is stopped, and the valve 135 is closed to shut the ink supply to the ink tank 101 via the tube 132. In addition, the air releasing valve 108 is closed to shut an air releasing passage of the ink tank 101.

Then, as shown in FIG. 14, the driving of the pressing means 131 is stopped so as to move the plunger 131*a* backwards. In this manner, the restoring force of the compressed spring 104 causes the film 103 to move outwards, and the negative pressure is thereby generated in the ink tank 101.

According to the third embodiment, the negative pressure in the ink tank 101 is generated by opening and closing the air releasing opening of the ink tank 101, and changing the inside capacity of the ink tank 101. Accordingly, the ink can be supplied to the ink tank 101 without increasing the waste ink produced at the time of the ink supply and without degrading the quality of the ink in the main ink cartridge.

Furthermore, as another method of generating the negative pressure in the ink tank 101, after the ink is provided to the ink tank 101, and the air releasing valve 108 is closed to make the closed state of the ink tank 101, the negative pressure can be generated by discharging the ink from the ink tank 101 via the head. This method may be applied, but the ink discharged from the head is wasted. Accordingly, the above method of generating a negative pressure by changing the capacity of the ink tank is superior to the method of generating a negative pressure by discharging the ink in that the wasted ink can be decreased.

As another method of generating the negative pressure, after the ink tank is closed, the supply pump is driven in reverse so that the ink in the ink tank can be sent back to the main cartridge. In this method, the wasted ink is not increased, but the ink that flows through the supply tube and the pump is mixed with the ink in the main cartridge. Accordingly, a quality such as deaeration of the ink in the main cartridge is degraded.

Meanwhile, according to the third embodiment of the present invention, the ink tank 101 itself generates the negative pressure as described above without discharging the ink of the ink tank from the head. Accordingly, the ink is not wasted. Furthermore, since the ink is not sent back to the main cartridge when generating the negative pressure, the quality of the ink in the main cartridge is not degraded.

Figure 15:
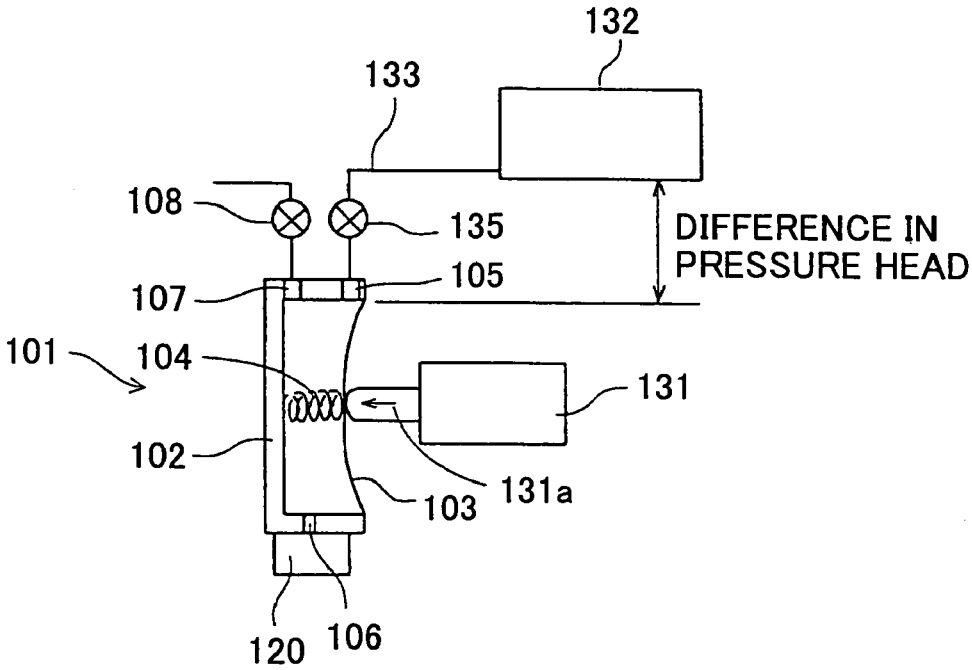
FIG. 15 shows the basic structure of an ink providing device including an ink tank according to a fourth embodiment of the present invention.
Figure 16:
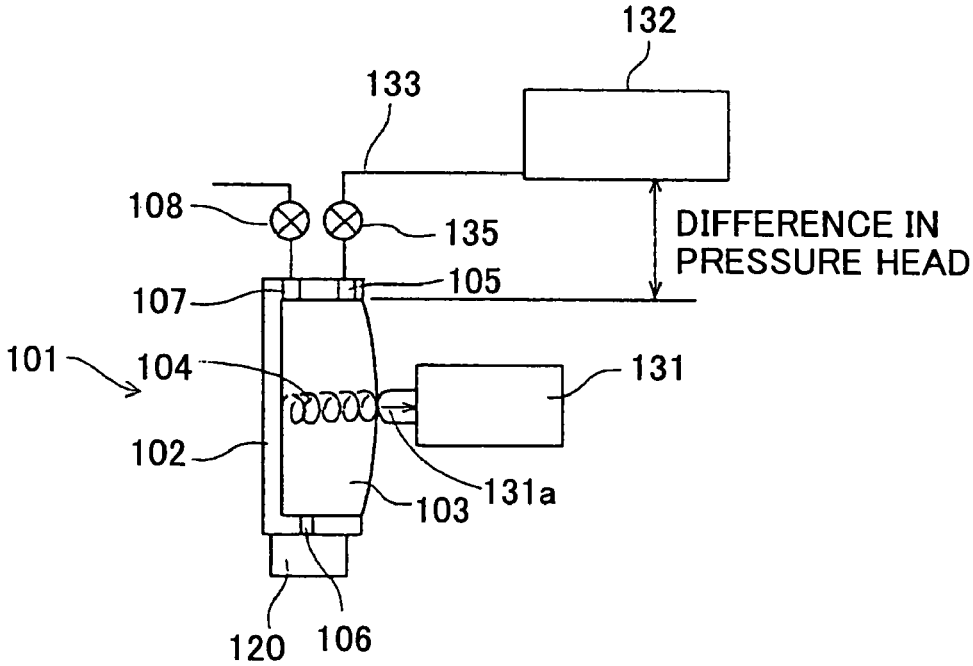
FIG. 16 shows the operation of the ink providing device shown in FIG. 15.

Next, a fourth embodiment of the present invention will be described with reference to FIGS. 15 and 16. In FIG. 15, the basic structure of an ink providing device including an ink tank is shown, and in FIG. 16, the operation of the ink providing device is shown.

In the forth embodiment, the difference in the pressure head between the ink tank 101 and the main cartridge 132 is used instead of the supply pump 134 used in the third embodiment.

With this structure, it is possible to provide the ink to the ink tank 101 from the main cartridge 132 by using the difference in the pressure head. In this case, since the pump is not necessary, the ink providing device can be manufactured at a low cost.

In this embodiment, as a method of providing the ink to the subtank from the main cartridge, the main cartridge 132 may be made of flexible materials so that the pressurized ink can be provided to the subtank from the main cartridge by deforming the main cartridge.

Figure 17:
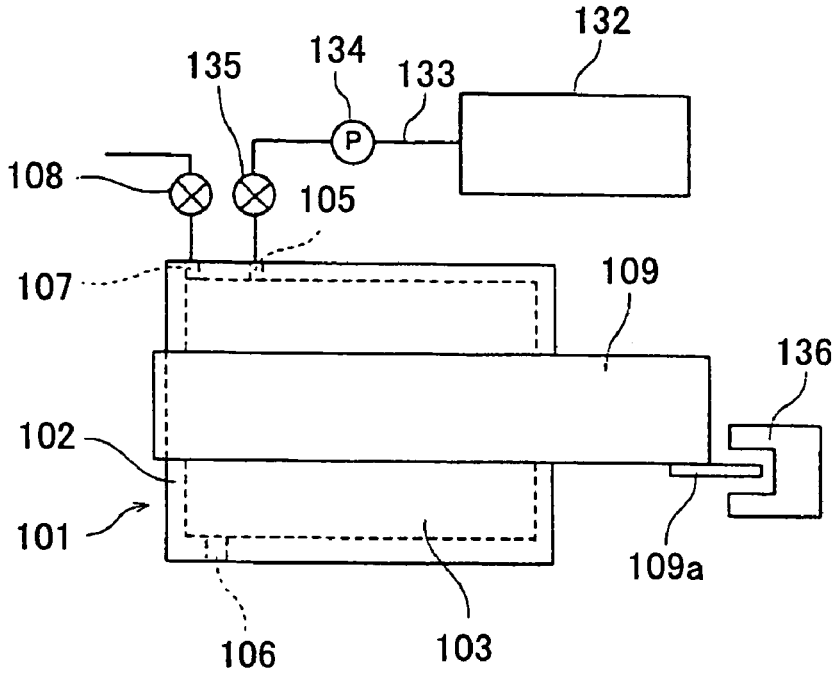
FIG. 17 shows the basic structure of an ink providing device according to a fifth embodiment of the present invention.
Figure 18:
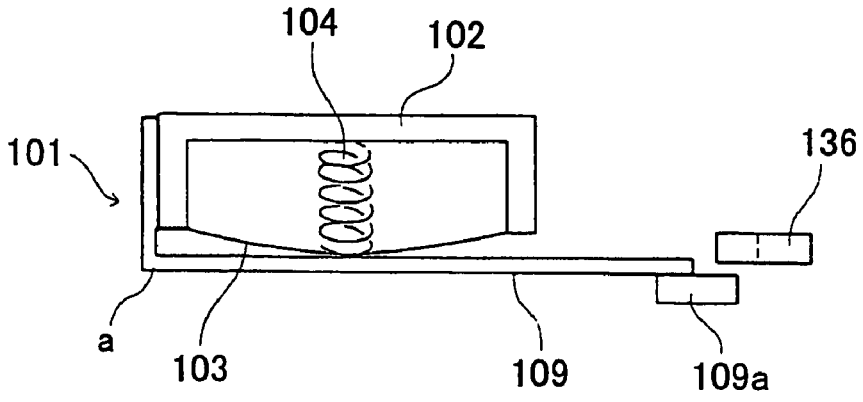
FIG. 18 is a plan view showing the important part of the ink providing device shown in FIG. 17.

Next, a fifth embodiment of the present invention will be described with reference to FIGS. 17 through 19. The basic structure of an ink providing device according to the fifth embodiment is shown in the elevation view of FIG. 17. FIG. 18 is a plan view of an important part of the ink providing device, and FIG. 19 is a plan view showing the operation of the ink providing device.

In the fifth embodiment, a displacement member (or a moving member) 109 is provided at an ink tank 101. The displacement member 109 can move or rotate, centering the point "a" of FIGS. 18 and 19, in accordance with the deformation of the film 103. The displacement member 109 is made of a leaf spring or the like. The spring force of the displacement member 109 is set to be weaker than the spring force of a compressed spring 104 provided in the ink tank 101. The displacement member 109 is moved in accordance with the deformation of the film 103, i.e., the increase or the decrease of the ink in the ink tank 101. Displacement detection means 136 includes a transmission photo sensor for detecting the displacement of the displacement member 109 by detecting the existence or absence of a detection piece 109*a* provided at the end of the displacement member 109 of the ink tank 101.

Figure 19:
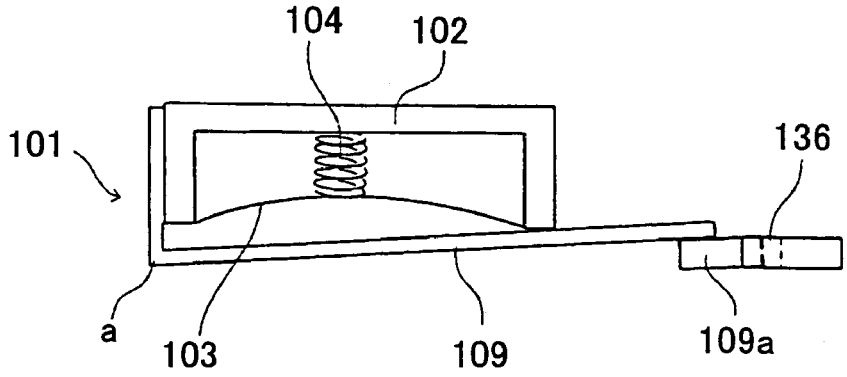
FIG. 19 shows the operation of the ink providing device shown in FIG. 17.

With this structure, when the ink in the ink tank 101 is consumed, as shown in FIG. 19, the film 103 is deformed in the inward direction against the spring force of the compressed spring 104 provided in the ink tank 101. In this state, the negative pressure in the ink tank 101 is stronger than the spring force of the compressed spring 104.

Then, as shown in FIG. 19, when the detection piece 109*a* of the displacement member 109 is detected by the displacement detection means 136, a supply pump 136 is operated without opening the air releasing valve 108 so that the ink in a main cartridge 132 can be provided to the ink tank 101 with the inside of the ink tank 101 being shut off from the outside air. Thereby, the film 103 swells or is deformed outwards, and the inside capacity of the ink tank is increased to reduce the degree of the negative pressure in the ink tank 101. Since the film 103 is deformed outwards by supplying the ink to the ink tank 101, the displacement member 109 is also moved outwards.

When a predetermined amount of ink is supplied to the ink tank 101, as shown in FIG. 18, the detection piece 109*a* of the displacement member 109 comes to be off (that is, separated from) the displacement detection means 136. From this state, the displacement detection means 136 detects that a predetermined amount of ink has been supplied to the ink tank 101. Then, a detection signal generated by the displacement detection means 136 causes the operation of the supply pump 134 to be stopped so that the ink supply to the ink tank 101 can be stopped.

In this case, if the amount of ink that is provided to the ink tank 101 exceeds a certain amount, the inside pressure of the ink tank 101 becomes positive. Accordingly, when the ink is supplied to the ink tank 101 with the ink tank 101 being closed from the outside air, it is necessary to stop the operation of the supply pump 134 to stop the ink supply to the ink tank 101 before the inside pressure of the ink tank 101 changes from a negative pressure to a positive pressure.

By taking this point into account, the setting is made such that the detection piece 109*a* of the displacement member 109 comes to be off the displacement detection means 136 before the pressure inside the ink tank 101 changes to a positive pressure from a negative pressure. In this manner, in the state in which the inside pressure of the ink tank 101 is negative, the operation of the supply pump 134 can be stopped to stop the ink supply to the ink tank 101.

Accordingly, in the fifth embodiment, even when the inside of the ink tank 101 is closed from the outside air, it is possible to repeat the ink supply to the ink tank 101 while the negative pressure inside the ink tank 101 is kept in an appropriate range.

The displacement detection means 136 may be configured to include two photo sensors in order to perform finer control. In the case where the displacement detection means 136 includes one sensor, when the displacement detection means 136 detects the absence of the detection piece 109*a* of the displacement member 109, the ink supply to the ink tank 101 may be started, and when the displacement detection means 136 detects the presence of the detection piece 109*a* of the displacement member 109, the ink supply to the ink tank 101 may be stopped. A reverse manner of the above example may be adopted. In this case, the setting may be made such that when an amount of the ink in the ink tank 101 becomes large, the detection piece 109*a* of the displacement member 109 is detected by the displacement detection means 136.

Furthermore, in this embodiment, since the displacement member 109 can move or rotate, centering the corner of the ink tank 101 (that is, the corner functions as the center of the rotation), the displacement detection means 136 can detect the magnified deformation of the ink tank 101 or the film 103. Accordingly, it is possible to detect the timing for supplying the ink to the ink tank 101 in high accuracy.

According to the second to fifth embodiments, it is possible to supply the ink to the ink tank 101 both when the inside of the ink tank 101 is open to the outside air and when the inside of the ink tank 101 is closed from the outside air. The ink supply to the ink tank 101 with the inside of the ink tank 101 being open to the outside air, and the ink supply to the ink tank 101 with the inside of the ink tank 101 being closed from the outside air can be selectively performed for maintaining the excellent ink supply with high reliability for a long time.

Particularly, the ink is preferably provided to the ink tank 101 with the inside of the ink tank 101 being open to the outside air for discharging the gradually accumulated air in the ink tank 101 to the outside of the ink tank 101. Furthermore, when a large change in a temperature is generated, the negative pressure changes by the expansion and contraction of the air inside the ink tank 101. In this case, after the inside of the ink tank 101 is made open to the outside air without supplying the ink to the ink tank 101, the negative pressure generation operation may be performed to adjust the negative pressure in the ink tank 101 so as to maintain the function of the ink tank 101.

By opening the inside of the ink tank 101 to the outside air, the unnecessary air can be discharged to the outside. However, if the inside of the ink tank 101 is made open to the outside air with high frequency, the drying of the inside of the ink tank 101 is promoted. As a result, the ink inside the ink tank 101 can has high viscosity. Accordingly, preferably, the inside of the ink tank 101 is made open with less frequency, and the usual ink supply to the ink tank 101 is carried out with the inside of the ink tank 101 being closed from the outside air. Thus, the ink supply to the ink tank 101 with the inside of the ink tank 101 being open to the outside air is preferably performed on a predetermined condition. For example, when the main cartridge 132 is replaced with new one, when the ink tank 101 has not been used for a long time, or when the instruction is provided from a user, the inside of the ink tank 101 may be made open to the outside air.

Figure 20:
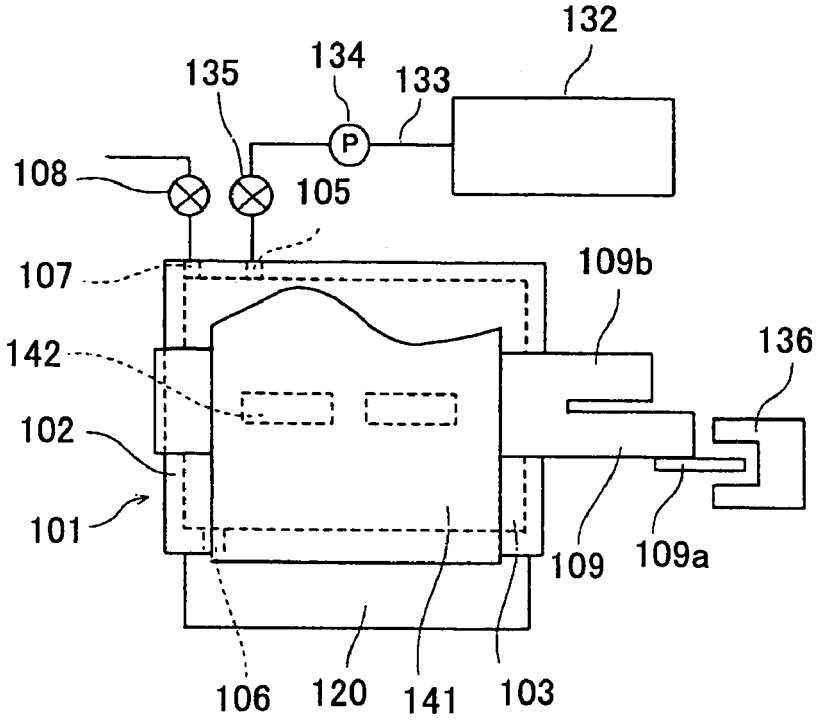
FIG. 20 shows the basic structure of an ink providing device including an ink tank according to a sixth embodiment of the present invention.
Figure 21:
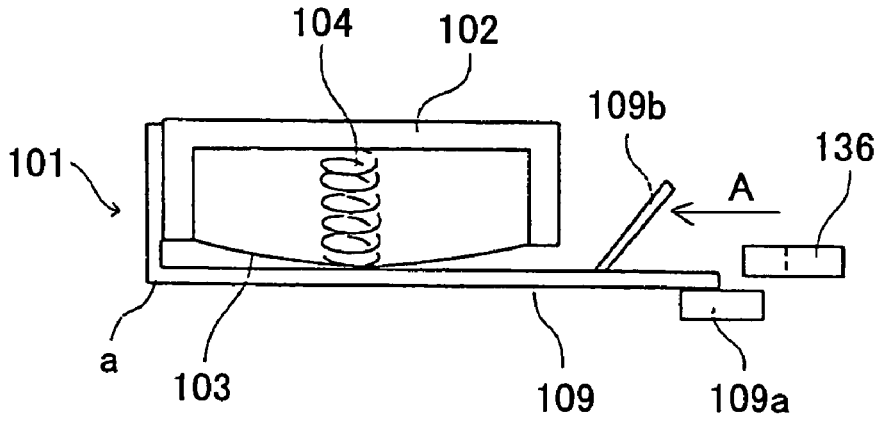
FIG. 21 is a plan view showing the important part of the ink providing device shown in FIG. 20.
Figure 22:
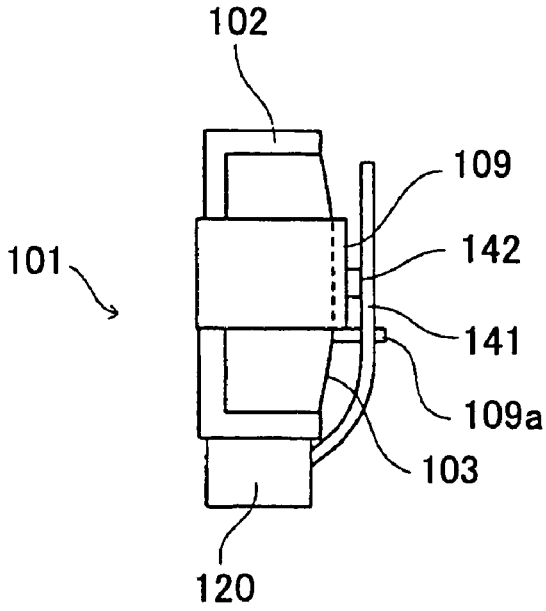
FIG. 22 is a side view showing the important part of the ink providing device shown in FIG. 20.

Next, a sixth embodiment of the present invention will be described with reference to FIGS. 20 through 22. The basic structure of an ink providing device of the sixth embodiment is shown in an elevation view of FIG. 20, FIG. 21 is a plan view showing a important part of the ink providing device, and FIG. 22 is a side view showing an important part of the ink providing device. In this embodiment, a part of a displacement member 109 is cut and made to stand obliquely so as to form a displacement operation part 109*b*, as shown in FIG. 21. With this structure, the displacement operation part 109*b* is pushed in the direction indicated by the arrow "A" by an operation part such as a lever so that the volume inside an ink tank 101 can be changed.

In other words, the displacement member 109 can be used as pressing means for pressing a flexible film 103 of the ink tank 101 against the spring force of a compressed spring 104 in the ink tank 101. Particularly, in the case of the color inkjet printing apparatus, when a plurality of ink tanks 101 are arranged so as to be close to each other, it becomes difficult to directly press the film 103 in the directions of the expansion and the contraction of the compressed spring 104. However, with the structure of this embodiment, even if a plurality of ink tanks are arranged so as to be close to each other, the displacement member 109 can be moved from the outside-to-inside direction of the ink tank to generate the negative pressure.

Furthermore, in this embodiment, the displacement member 109 is made of material such as metal having high thermal conductivity, and a driver integrated circuit 142 mounted on a connection member (a electric conducting member) 141 such as a FPC (flexible printed circuit) for providing a driving signal to the inkjet head 120 is made to be in contact with the outside surface of the displacement member 109, as shown in FIG. 22.

In other words, when the ink tank 101 is directly connected to the head 120, in many cases, the connection member 141 is disposed on the side surface of the ink tank 101. This is because it is impossible to arrange the connection member 141 at the nozzle surface side where the paper runs. In this case, the driver integrated circuit (driving circuit) 142 is mounted on the connection member 141 for the sake of a small mounting area. However, when the number of nozzles of the inkjet heads increases, and the printing speed becomes high, a substantial amount of heat is generated from the driver integrated circuit 142. At this time, it is difficult to disperse the generated heat because the heads are usually arranged so as to be close to each other in the carriage.

For this reason, the metal having high thermal conductivity is used as material for the displacement member 109, and a part of the metal displacement member 109 is made to extend to the place where air sufficiently communicates with the outside of the printer. In this manner, it is possible to easily disperse the heat generated from the driver integrated circuit 142 via the displacement member 109.

Figure 23:
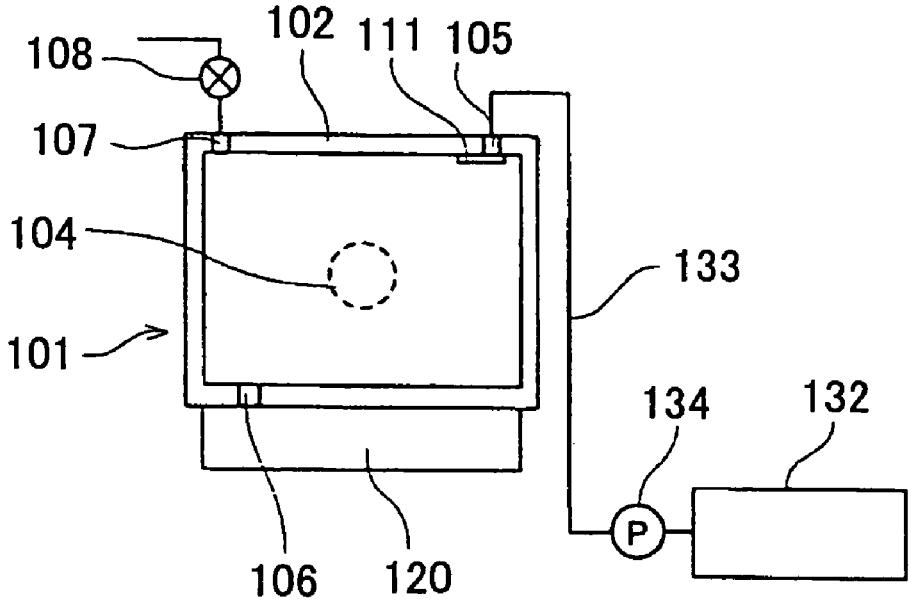
FIG. 23 shows the basic structure of an ink providing device including an ink tank according to a seventh embodiment of the present invention.

Next, a seventh embodiment of the present invention will be described with reference to FIGS. 23 through 25B. The basic structure of an ink providing device including an ink tank of this embodiment is shown in FIG. 23, and a part of the ink tank is shown in FIGS. 24A and 24B, and a part of another example of the ink tank is shown in FIGS. 25A and 25B.

Figure 24A:
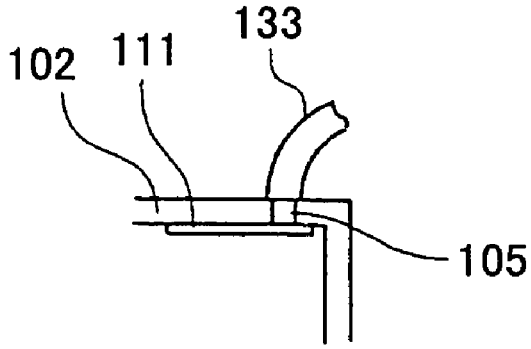
FIGS. 24A and 24B are enlarged views showing one example of a reverse flow prevention valve of the ink providing device shown in FIG. 23.
Figure 24B:
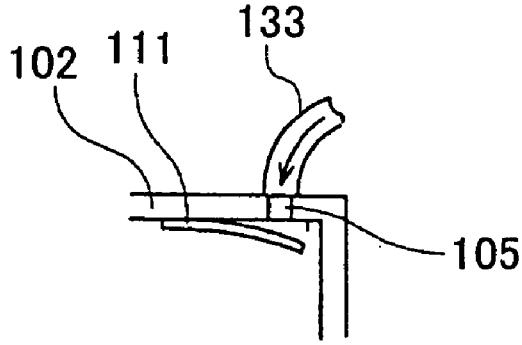
Figure 25A:
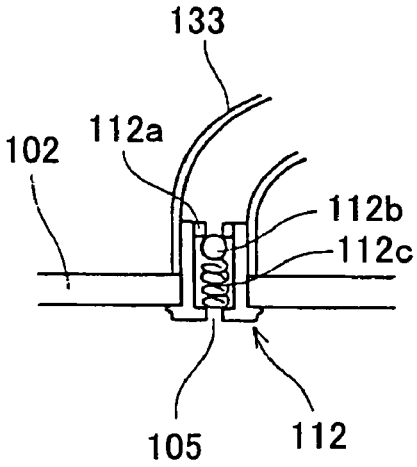
FIGS. 25A and 25B are enlarged views showing another example of a reverse flow prevention valve of the ink providing device shown in FIG. 23.

In this embodiment, reverse flow prevention valve 111 that is reverse flow prevention means for preventing the reverse flow of the ink, i.e., preventing the ink from flowing to the main cartridge 132 from an ink providing opening 105, is provided at or near the ink providing opening 105 of the ink tank 101, as shown in FIGS. 24A and 24B. This reverse flow prevention means may be made of an elastic member. Alternatively, as shown in FIGS. 25A and 25B, the reverse flow prevention means may be the reverse flow prevention valve 112 that includes a valve seat 112*a*, a ball 112*b* for opening and closing the ink providing opening 105, and a spring member 112*c* for pressing the ball 112*b* to make a closed state.

A main cartridge 132 that provides the ink to the ink tank 101 is provided at the level that is below the ink tank 101.

Figure 25B:
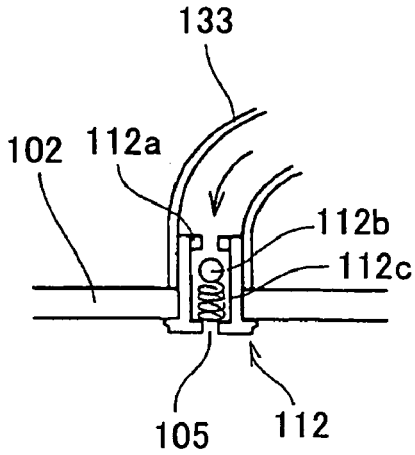

With this arrangement, when a supply pump 134 is operated to send the ink in the main cartridge 132 to the ink tank 101 in the pressurized state, the reverse flow prevention valve 111 is made open by the ink flow from the main cartridge 132 to the ink tank 101 as shown in FIG. 24B, or the ball 112*b* is pressed by the ink flow from the main cartridge 132 against the spring force of the spring member 112*c* as shown in FIG. 25B so that the reverse flow prevention valve 112 can be made open. In this manner, the ink providing opening 105 is made open, and the ink can flow into the ink tank 101. On the other hand, when the operation of the supply pump 134 is stopped, the reverse flow prevention valve 111 is made closed by the ceasing of the ink flow from the main cartridge 132 as shown in FIG. 24A, or the reverse flow prevention valve 112 is made closed by the ceasing of the ink flow from the main cartridge 132 as shown in FIG. 25A so that the ink providing opening 105 can be closed.

Accordingly, even when the main cartridge 132 is disposed below the ink tank 101, it is possible to prevent the ink in the ink tank 101 from flowing in reverse to the main cartridge 132. In other words, in order to dispose the main cartridge 132 below the ink tank 101, the reverse flow prevention means such as valve means for opening and closing the ink providing opening 105 are provided at the ink tank 101 for preventing the ink from flowing in reverse to the main cartridge 132 from the ink tank 101.

Meanwhile, in the case where the main cartridge 132 is disposed at the level below the level of the ink tank 101, the reverse flow prevention means such as the valve means are not provided at the ink providing opening 105 of the ink tank 101, and the ink is provided to the ink tank 101 from the main cartridge 132 with the inside of the ink tank 101 being open to the outside air, an air releasing valve 108 is first made open, and the supply pump 134 is operated to provide the ink of the main cartridge 132 to the ink tank 101. After a predetermined amount of ink is provided to the ink tank 101, the operation of the supply pump 134 is stopped, and the air releasing valve 108 is made closed.

However, in this case, if a reverse flow prevention mechanism such as a valve is not provided at the supply pump 134, the difference in the pressure head between the ink tank 101 and the main cartridge 132 causes the ink in the ink tank 101 to flow in reverse to the main cartridge 132 after the operation of the supply pump 134 is stopped and before the air releasing valve 108 is closed. In this case, if an air layer exits near the ink providing opening 105, the air flows in reverse to the main cartridge 132, and then, the ink flows in reverse to the main cartridge 132.

Furthermore, if the air exists at the upstream side of the ink tank 101, e.g., in the tube between the ink tank 101 and the main cartridge 132, when the ink is then provided to the ink tank 101 with the inside of the ink tank 101 being open to the outside air, the problem is not generated, but when the ink is provided to the ink tank 101 with the inside of the ink tank 101 being closed from the outside air, the air flows into the ink tank 101 together with the ink.

For these reasons, the reverse flow prevention means such as the valve are provided at the ink providing opening 105 of the ink tank 101 to prevent the reverse flow of the ink and prevent the air existing between the ink tank 101 and the main cartridge 132 from coming into the ink tank 101.

Figure 26:
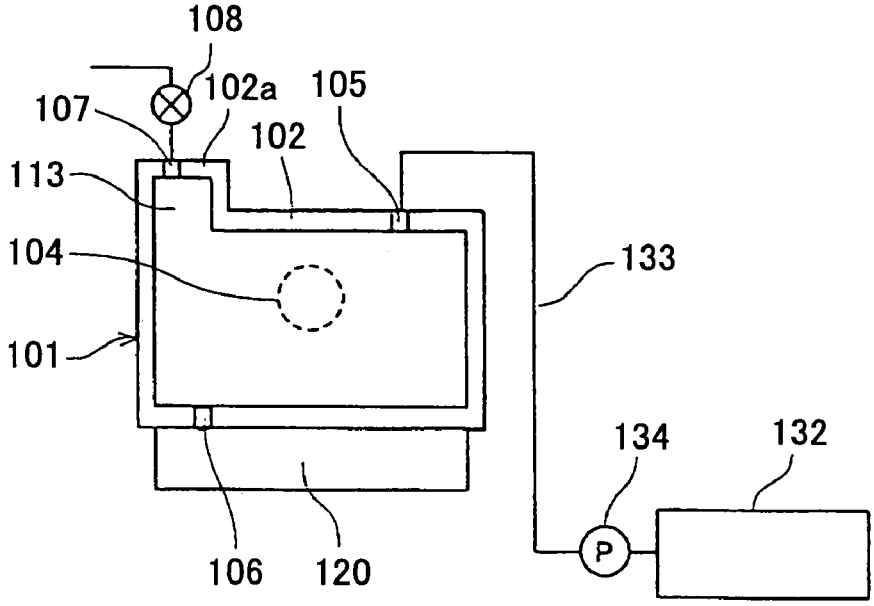
FIG. 26 shows the basic structure of an ink providing device including an ink tank according to an eighth embodiment of the present invention.

Next, an eighth embodiment of the present invention will be described with reference to FIG. 26. The basic structure of an ink providing device including an ink tank 101 according to the eighth embodiment is shown in FIG. 26.

In this embodiment, a protruding part 102*a* is formed at the upper part of a case 102. The protruding part 102*a* is positioned at the level higher than the level of the surface on which an ink providing opening 105 is formed. An air extraction space 113 is formed at the protruding part 102*a*. An air releasing opening 107 is formed above the air extraction space 113. In this structure, the position of the ink providing opening 105 is lower than the position of the air releasing opening 107. In this example, valve means such as a reverse flow prevention valve are not provided at the ink providing opening 105, and the main cartridge 132 is disposed at the position lower than the position of the ink tank 101.

With this structure, when the ink is provided to the ink tank 101 from the main cartridge 132 with the inside of the ink tank 101 being open to the outside air, the air inside the ink tank 101 is discharged to the outside of the ink tank 101 via the air extraction space 113 and the air releasing opening 107. At this time, since the position of the ink providing opening 105 is lower than the position of the air releasing opening 107, it is possible to supply the ink to the ink tank 101 until the ink providing opening (ink providing hole) 105 is filled with the ink, and even if the air in the ink tank 101 remains in the air extraction space 113 that the air releasing opening 107 faces, it is possible to realize the state in which the air does not remain at the ink providing opening 105.

For example, in the state in which the ink providing opening 105 is filled with the ink as described above, the operation of the supply pump 134 is stopped. In this case, the initial reversing flow from the ink providing opening 105 contains the only ink. Accordingly, it is possible to prevent the air from flowing in reverse to the main cartridge 132 by closing the air releasing opening 107 before the reverse flow comes to contain the air.

According to the eighth embodiment, the air can be prevented from flowing in reverse to the main cartridge 132 without providing specific reverse flow prevention means such as the valve means at the ink providing opening 105.

Figure 27:
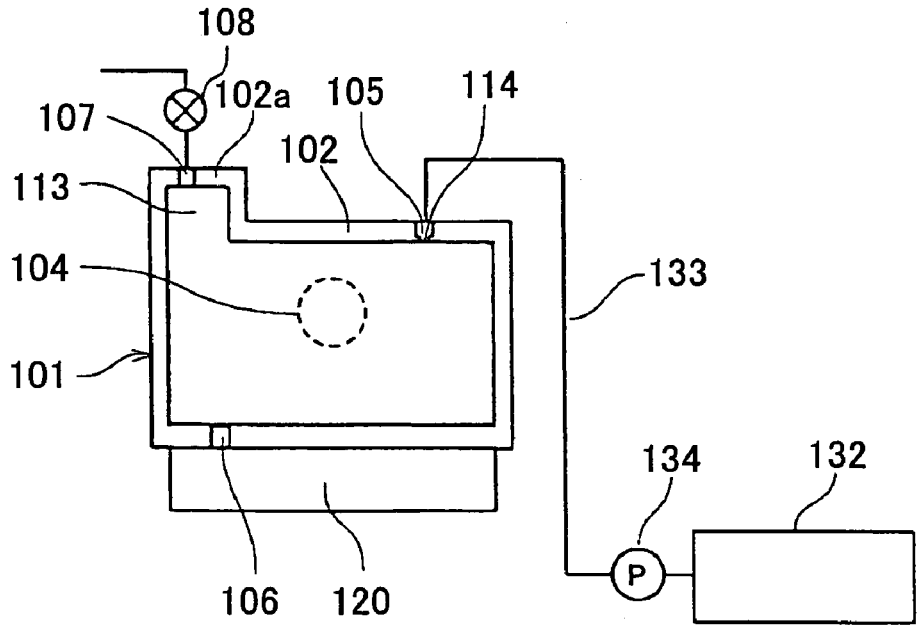
FIG. 27 shows the basic structure of an ink providing device including an ink tank according to a ninth embodiment of the present invention.
Figure 28:
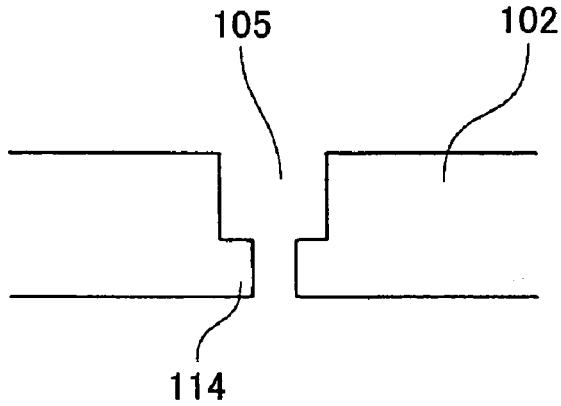
FIG. 28 is an enlarged view showing the important part of the ink providing device shown in FIG. 27.

Next, a ninth embodiment of the present invention will be described with reference to FIGS. 27 and 28. The basic structure of an ink providing device including an ink tank 101 of the ninth embodiment is shown in FIG. 27, and FIG. 28 is an enlarged view showing an important part of the ink tank 101.

In this embodiment, similarly with the eighth embodiment, a protruding part 102*a* is provided at the upper part of a case 102 such that the position of the protruding part 102*a* is higher than the surface on which an ink providing opening 105 is formed. An air extraction space 113 is formed at the protruding part 102*a*. Furthermore, an air releasing opening 107 is formed at the upper part of the air extraction space 113. In this structure, the position of the ink providing opening 105 is lower than the position of the air releasing opening 107. As shown in FIG. 28, a fluid resistance part such as a throttling part 114 is formed at the ink providing opening 105. In this example, valve means such as the reverse flow prevention means are not provided at the ink providing opening 105, and the position of the main cartridge 132 is lower than the position of the ink tank 101.

With this structure, it is possible to prolong the time that is the period before the reverse air flow is generated, and to prevent the air from flowing in reverse to the main cartridge 132 without providing the specific reverse flow prevention means such as the valve means.

Figure 29:
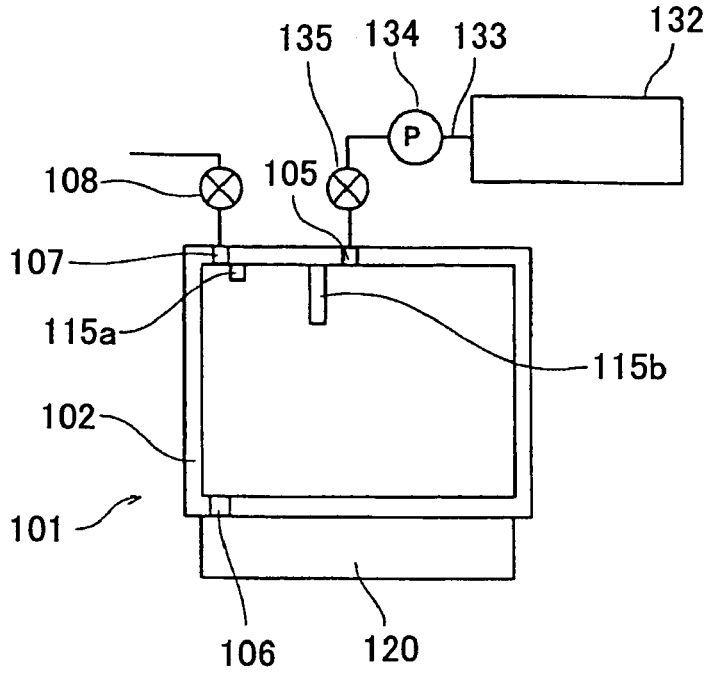
FIG. 29 shows the basic structure of an ink providing device including an ink tank according to a tenth embodiment of the present invention.

Next, a tenth embodiment of the present invention will be described with reference to FIG. 29. FIG. 29 shows the basic structure of an ink providing device including an ink tank 101 according to this embodiment.

In this embodiment, a plurality of detection electrodes (detection pins) for detecting the level of the ink are provided in the ink tank 101. In this example, two detection electrodes 115*a* and 115*b* are provided in the ink tank 101. The length of the detection electrode 115*a* is shorter than the length of the detection electrode 115*b* in terms of the depth direction. With these lengths, the detection electrode 115*a* detects the ink at the position near the upper surface of a case 102, and the detection electrode 115*b* detects the ink at the deeper position in the ink tank 101.

By using this structure, when the ink is provided to the ink tank 101, the detection electrodes 115*a* and 115*b* respectively contact with the ink, and the impedance between the detection electrode 115*a* and the detection electrode 115*b* changes. When the ink is thereby detected, the ink supply to the ink tank 101 is stopped.

When the inside of the ink tank 101 is open to the outside air, the ink tank 101 takes the shape in which the capacity of the ink tank 101 is the largest in this state within the range restricted by a pressing member 121 that is used for generating the negative pressure. At this time, the ink layer is formed at the lower side of the ink tank 101, and the air layer is formed at the upper side of the ink tank 101. Then, when a supply pump 134 is operated to provide the ink to the ink tank 101 from the main cartridge 132, the air in the ink tank 101 is discharged from the air releasing opening 107, and the level of the ink is raised. Accordingly, the detection electrode 115*a* and the detection electrode 115*b* respectively come to be immersed in the ink, and the impedance between the detection electrode 115*a* and the detection electrode 115*b* changes. Therefore, the completion of the ink providing (or the filling of the ink tank 101) can be detected, and the operation of the supply pump 134 is then stopped.

In this example, the detection electrode 115*b* is arranged so as to be at the position deeper than the position of the detection electrode 115*a*. Accordingly, in detecting the level of the ink, it is possible to prevent the detection error. On the other hand, by positioning the detection electrode 115*a* at the upper side of the ink tank 101, it is possible to increase the amount of the ink at the time the supplying of ink to the ink tank 101 is completed. However, when the position of the detection electrode 115*a* is near the upper surface of the case 102, there is a possibility that foam or bubbles are trapped by the detection electrode 115*a*, so that the level of the ink cannot be detected accurately. The place where the detection electrode 115*a* is disposed is preferably the place where the air tends not to be trapped. More preferably, a plurality of detection electrodes are disposed at several places, and when the impedance between any two electrodes of the disposed detection electrodes changes, it is determined that the ink supplying is completed.

It should be noted that a float on the ink, the permeability of the ink, or reflectance of the ink may be used as means for detecting the level of the ink to stop the ink supplying.

Figure 30:
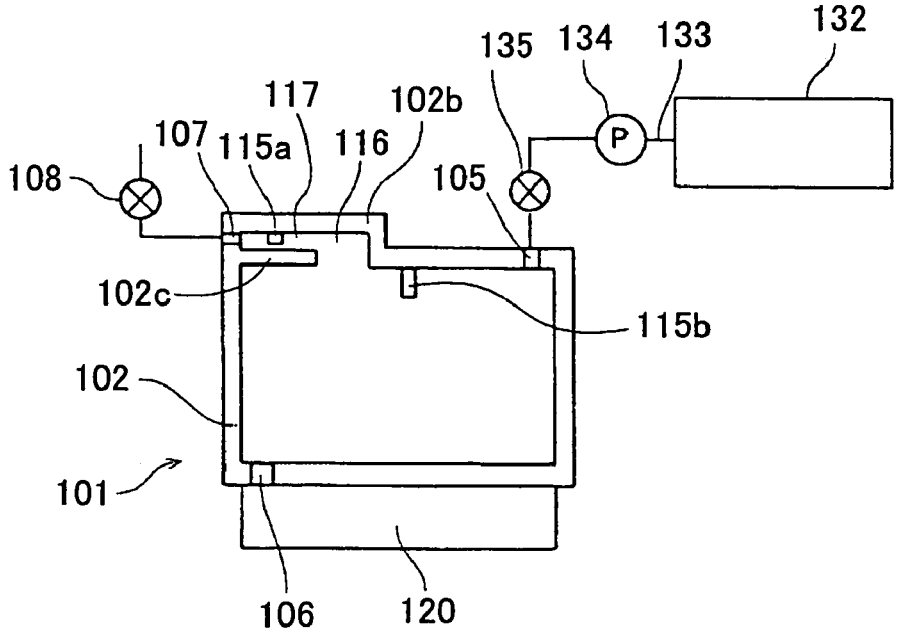
FIG. 30 shows the basic structure of an ink providing device including an ink tank according to an eleventh embodiment of the present invention.

Next, an eleventh embodiment of the present invention will be described with reference to FIG. 30. The basic structure of an ink providing device including an ink tank 101 according to this embodiment is shown in FIG. 30.

In this embodiment, a protruding part 102*b* is formed at the upper side of a case 102 of the ink tank 101, and an air extraction space 116 is formed at the protruding part 102*b*. An isolation part 102*c* integrally formed with the case 102 is provided at one part of the air extraction space 116 so as to form a throttling part 117 that is a narrow passage at a part of the air extraction space 116. Furthermore, an air releasing opening 107 that faces the air extraction space 116 is formed as shown in FIG. 30, and a detection electrode 115*a* is formed in the throttling part 117 of the air extraction space 116. A detection electrode 115*b* is also disposed at the upper side of the ink tank 101, as shown in FIG. 30.

In this structure, the ink can more firmly contact with the detection electrode 115*a*, so that it is possible to prevent the error in detecting the level of the ink.

Next, a twelfth embodiment of the present invention will be described with reference to FIGS. 31, 32A and 32B. The basic structure of an ink providing device including an ink tank 101 according to this embodiment is shown in FIG. 31, and an important part of the ink providing device is shown in FIGS. 32A and 32B.

In the twelfth embodiment, an air releasing valve 108 having a housing 118 integrally formed on an a case 102 of the ink tank 101 is added to the ink providing device of the eleventh embodiment. This air releasing valve 108 includes a valve seat 108*a* provided in the housing 118, a ball 108*b* that can contact with the valve seat 108*a*, and a spring member 108*c* for pressing the ball 108*b* towards the valve seat 108*a*, i.e., driving the air releasing valve 108 to be closed.

Figure 31:
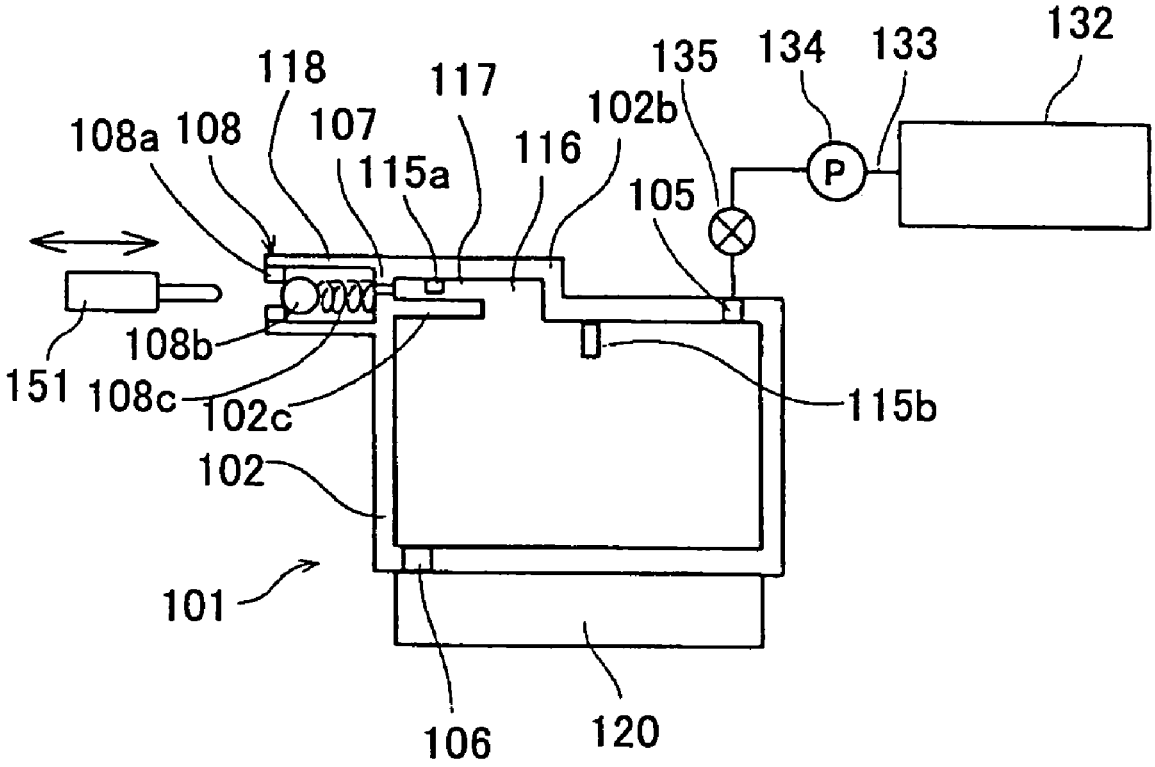
FIG. 31 shows the basic structure of an ink providing device including an ink tank according to a twelfth embodiment of the present invention.

A valve operation pin 151 is provided outside the air releasing valve 108, as shown in FIG. 31. The valve operation pin 151 as driving means advances in the air releasing valve 108 to press the ball 108*b* in the inward direction against the spring force of the spring member 108*c*, thereby driving the air releasing valve 108 to be open.

Figure 32A:
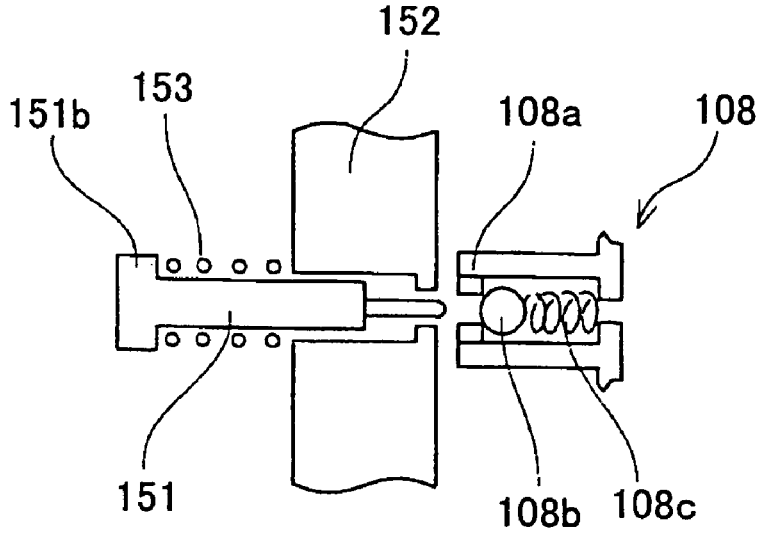
FIGS. 32A and 32B are enlarged views showing the important part of the ink providing device shown in FIG. 31.
Figure 32B:
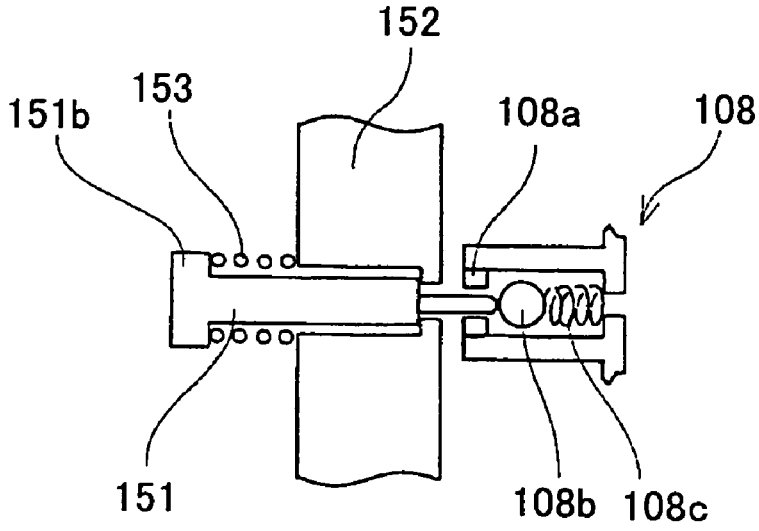

As shown in FIGS. 32A and 32B, the valve operation pin 151 is provided at a member such as a carriage member 152 for fixing the ink tank 101 such that the valve operation pin can move in the carriage member 152 relative to the carriage member 152. A spring 153 of the carriage member 152 presses the valve operation pin 151 backwards. Furthermore, a restriction member 151*b* having a flange is formed on the valve operation pin 151. The restriction member 151*b* restricts an amount that the valve operation pin 151 advances in the air releasing valve 108 so as to prevent the advancing amount of the valve operation pin 151 from exceeding a predetermined amount. The valve operation pin 151 is driven by a solenoid, a link mechanism, a motor, or the like (not shown).

With this structure, the air releasing valve 108 can be opened and closed by moving the valve operation pin 151 forwards and backwards. Accordingly, the air releasing operation can be appropriately performed, and the function or quality of the ink tank 101 can be maintained for a long time.

The air releasing valve 108 needs to have the tolerance for being firmly operated many times in order to repeatedly be opened and closed. As described above, the spring member 108*c* presses the ball 108*b*, meaning that in a normal state, the air releasing valve 108 is closed. Only when the ink is provided to the ink tank 101 or when the ink tank 101 is filled with the ink, the force from the outside is made to act against the spring force of the spring member 108*c* so as to open the air releasing valve 108. Accordingly, the structure becomes simple. Furthermore, by only pressing the ball 108*b* constituting a sealing part so as to move the ball 108*b* by a small length, strict accuracy in the pressing stroke of the valve operation pin 151 is not required because the spring member 108*c* is provided against the pressing stroke. Accordingly, it is possible to simplify the structure for operating the air releasing valve 108.

In this example, the ink tank 101 is integrally fixed directly on a printing head 120, so that the ink tank 101 and the printing head 120 are fixed together on the carriage (not shown) at a predetermined position. Accordingly, the valve operation pin 151 can firmly press and move the ball 108*b* in the inward direction to release the air in the ink tank 101.

Since the spring member 153 presses the valve operation pin 151 in the direction of separating the valve operation pin 151 from the ink tank 101, it is possible to securely obtain the normal state in which the valve operation pin 151 does not interfere with the air releasing valve 108. Therefore, with the simple structure, it is possible to firmly open and close the air releasing valve 108. Furthermore, since the restriction part 151*b* for restricting the pressed amount of the valve operation pin 151 is provided on the valve operation pin 151, it is possible to prevent the air releasing valve 108 from being damaged at the time of the assembling, and to prevent the ink tank 101 from being positioned off a predetermined position on the carriage at the time of the assembling.

Figure 33:
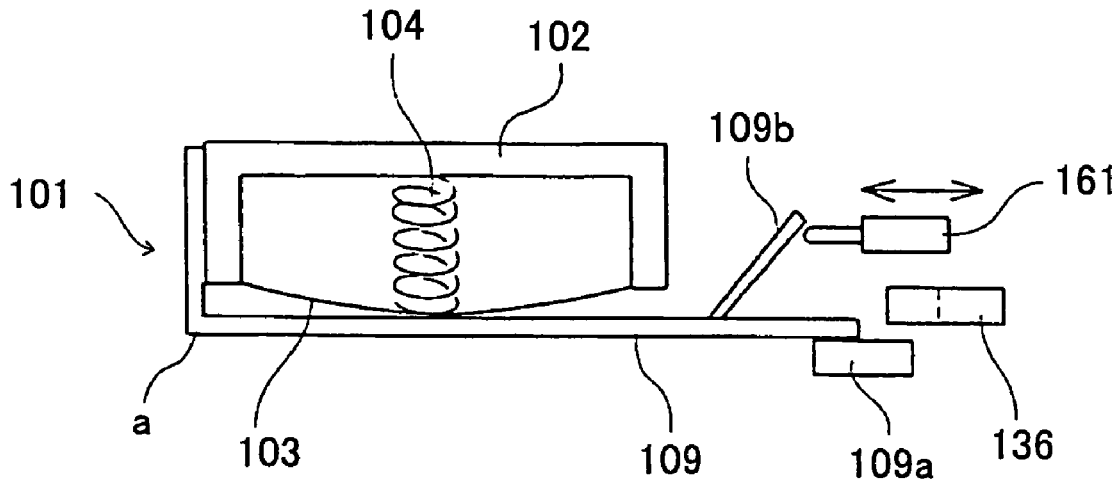
FIG. 33 shows the basic structure of an ink providing device including an ink tank according to a thirteenth embodiment of the present invention.
Figure 34:
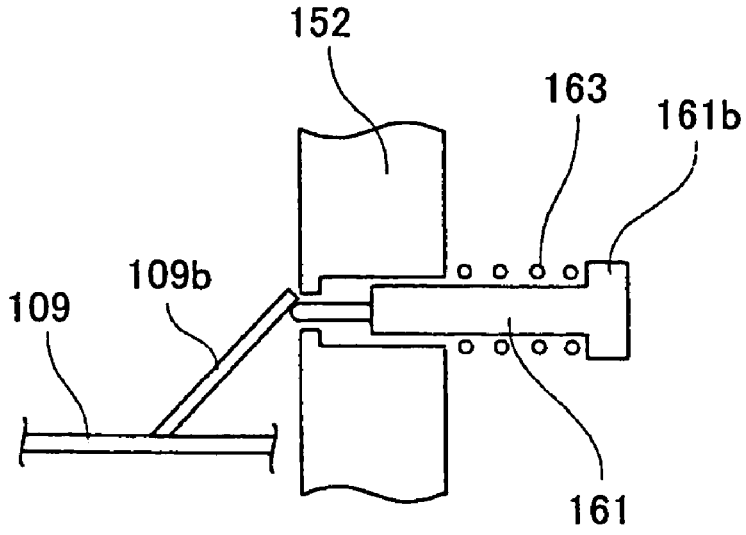
FIG. 34 is an enlarged view showing the important part of the ink providing device shown in FIG. 33.

Next, a thirteenth embodiment of the present invention will be described with reference to FIGS. 33 and 34. The basic structure of an ink providing device including an ink tank 101 according to this embodiment is shown in FIG. 33, and an important part of the ink providing device is shown in FIG. 34.

In the thirteenth embodiment, a displacement operation part 109*b* of a displacement member 109 of the ink tank 101 as described in the sixth embodiment is provided. This displacement operation part 109 is operated by an operation pin 161.

The operation pin 161 is attached on a carriage member 152 or the like for fixing the ink tank 101 such that the operation pin 161 can advance and retreat to and from the ink tank 101. A spring 163 presses the operation pin 161 in the retreating direction of the operation pin 161. A restriction part 161*b* having a flange is formed on the operation pin 161. The restriction part 161*b* restricts an amount that the operation pin 161 advances towards the ink tank 101. In other words, the restriction part 161 prevents the displacement member 109 from being moved beyond a predetermined amount by the restricting the advancing amount of the operation pin 161. The operation pin 161 is driven by a solenoid, a link mechanism, a motor, or the like (not shown)

As described above, the operation pin 161 is provided on the carriage such that the operation pin 161 can move forwards and backwards. Accordingly, with the simple structure, the operation pin 161 can press the displacement operation part 109*b* so as to change the inside capacity of the ink tank 101 via the displacement member 109 and generate the negative pressure in the ink tank 101. Since the operation pin 161 is mounted on the carriage or the like that fixes ink tank 101 at the predetermined position thereon, it is possible to accurately determine the amount that the displacement member 109 is pressed by the operation pin 161, so that the change in the inside capacity of the ink tank 101 can be controlled in high accuracy.

Furthermore, the restriction part 161*b* for restricting the pressed amount of the operation pin 161 is provided on the operation pin 161, so that it is possible to prevent the displacement member 109 from being damaged at the time of assembling the printing apparatus, and it is possible to prevent the ink tank 101 from being off the predetermined position on the carriage at the time of assembling the printing apparatus.

Figure 35:
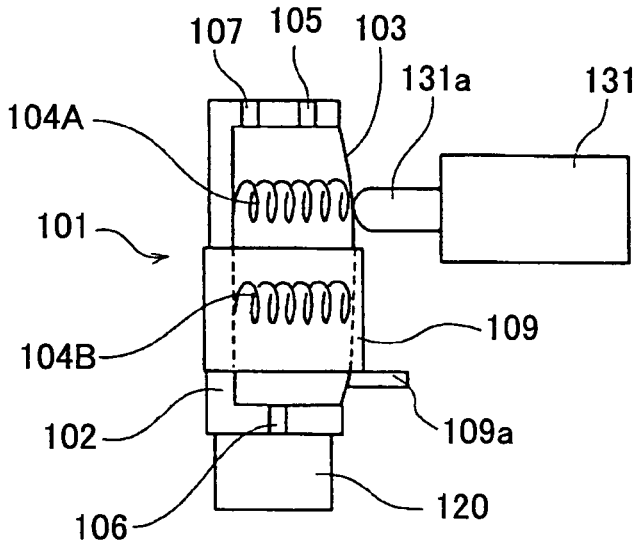
FIG. 35 is a side view showing the basic structure of an ink providing device including an ink tank according to a fourteenth embodiment of the present invention.
Figure 36:
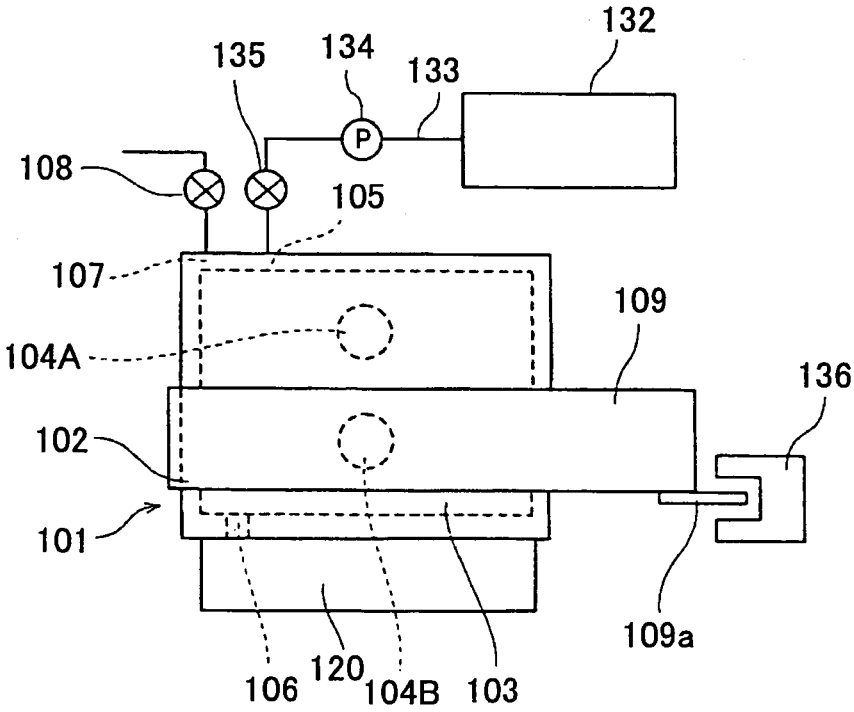
FIG. 36 is an elevation view of the FIG. 35.

Next, a fourteenth embodiment of the present invention will be described with reference to FIGS. 35 and 36. The basic structure of an ink providing device including an ink tank 101 according to this embodiment is shown in FIG. 35, and FIG. 36 is an elevation view of the ink providing device.

This ink providing device includes a compressed spring 104A, provided in the ink tank 101, for generating the negative pressure in the ink tank 101, and a compressed spring 104B, provided in the ink tank 101, for maintaining the generated negative pressure. In this example, the compressed spring 104A can be pressed by a pressing part 131*a*.

By using two spring members, i.e., the spring member for generating the negative pressure, and the spring member for maintaining the negative pressure, it is possible to control the initial negative pressure generating operation, and the negative pressure maintaining operation, independently of each other. Therefore, the design and the adjustment of the structure become easy.

Figure 37:
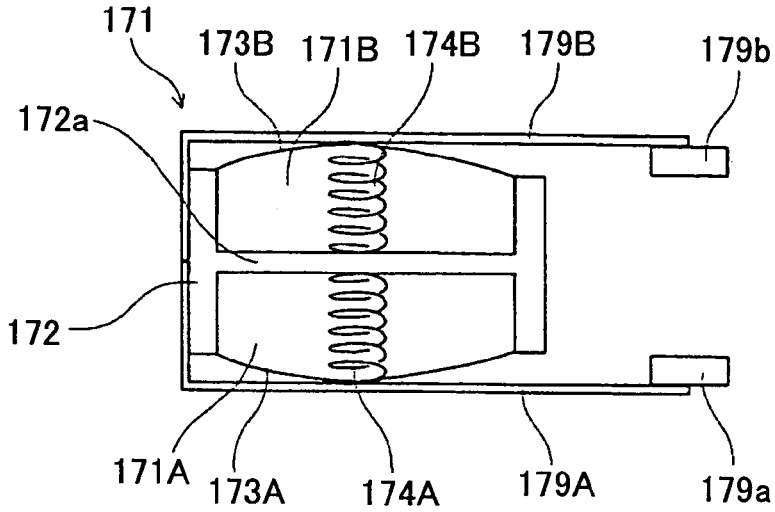
FIG. 37 is a plan view showing the basic structure of an ink providing device including an ink tank according to a fifteenth embodiment of the present invention.
Figure 38:
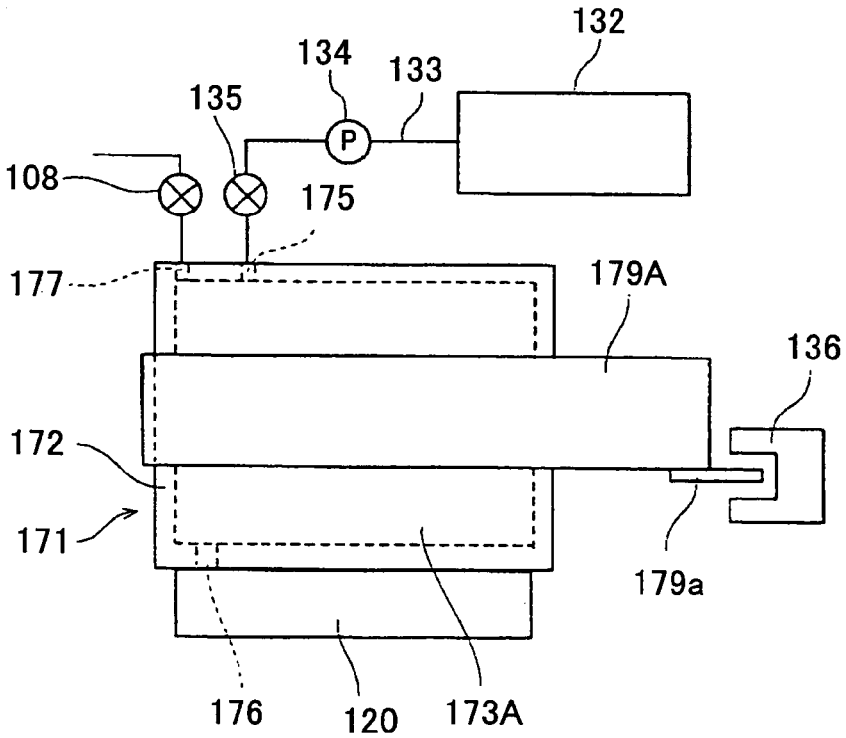
FIG. 38 is an elevation view of FIG. 37.

Next, a fifteenth embodiment of the present invention will be described with reference to FIGS. 37 and 38. FIG. 37 is a plan view showing the basic structure of an ink providing device including an ink tank 171 according to this embodiment, and FIG. 38 is an elevation view of the ink providing device.

In this embodiment, the ink tank 171 includes a case 172 (main body of the ink tank 171) made of resin. An isolation wall of the case 172 isolates the both sides of the case 172 such that two symmetrical openings are formed at the both sides, as shown in FIG. 37. In other words, two rooms 171A and 171B axe defined by the case 172. The ink tank 171 further includes a film 173A for sealing the opening of the room 171A, and a film 173B for sealing the opening of the room 171B. Further, a compressed spring 174A for pressing the film 173A in the outward direction is provided in the room 171A, and a compressed spring 174B for pressing the film 173B in the outward direction is provided in the room 171B.

Displacement members 179A and 179B that can move in accordance with the change in the capacity of the ink tank 171 are provided on the ink tank 171. For example, the displacement members 179A and 179B may be rotated, centering the corners of the ink tank 171. Detection pieces 179*a* and 179*b* are provided on the displacement members 179A and 179B, respectively.

In this structure, the ink tank 171 can accommodate two types of ink, e.g., two different colors of ink, so that the size of the printing apparatus can be made smaller.

Figure 39:
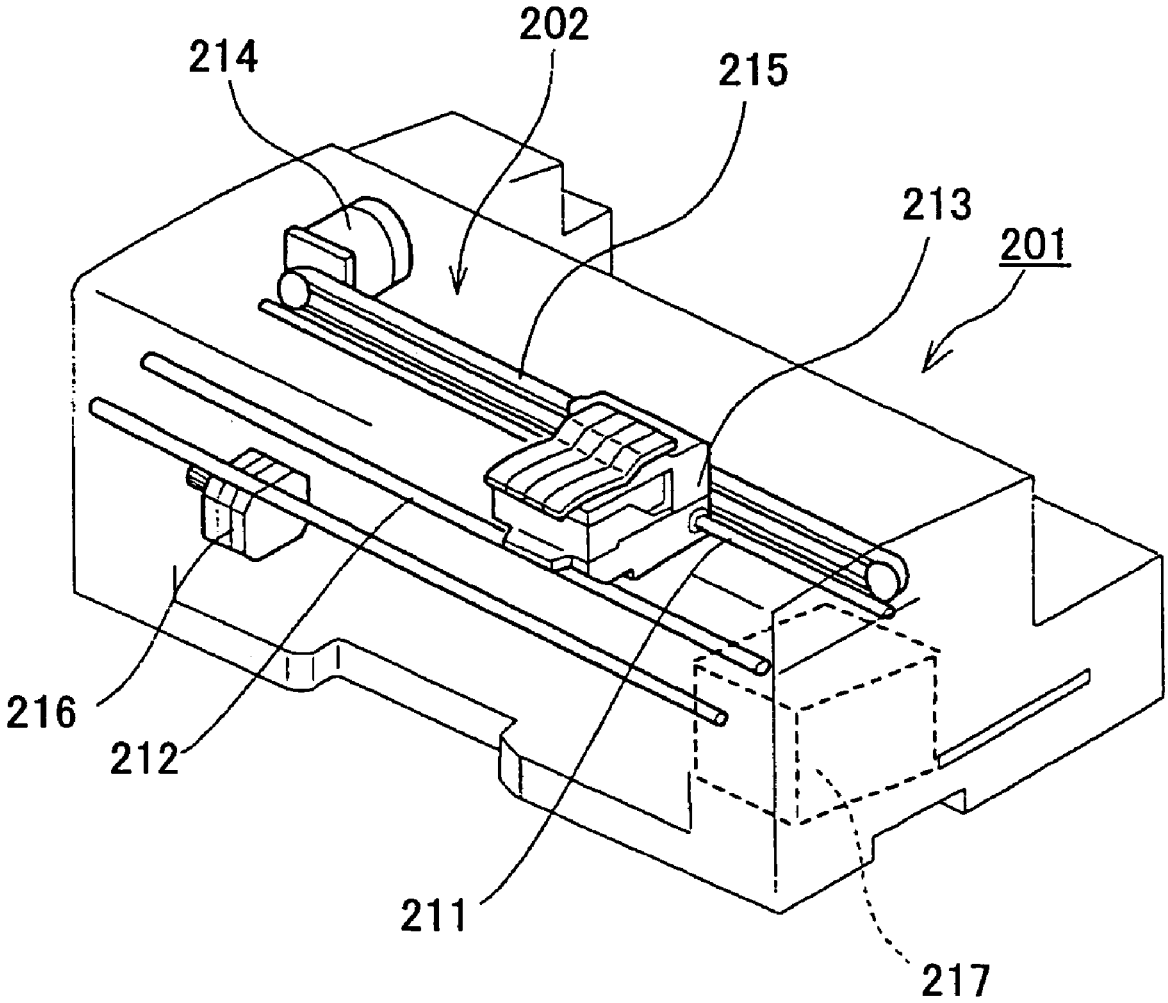
FIG. 39 is a perspective view showing one example of an inkjet printing apparatus according to the present invention.

Next, one example of an inkjet printing apparatus according to the present invention will be described with reference to FIG. 39. FIG. 39 is a perspective view showing an important part of the inkjet printing apparatus.

This inkjet printing apparatus includes a carriage 213 that is provided in a main body of the apparatus and can move in the main running direction. The inkjet printing apparatus further includes a printing mechanism 202 that has an ink cartridge integrally formed on a printing head such as an inkjet head mounted on the carriage 213.

The printing mechanism 202 includes a main guide rod 211 and an assist guide rod 212 that are laid by being supported by side plates (not shown). The main guide rod 211 and the assist guide rod 212 support the carriage 213 such that the carriage 213 can move along the guide rods 211 and 212, i.e., can move in the main running direction. The printing mechanism 202 further includes a main running mechanism having a main running motor 214 and a timing belt 215.

Ink ejecting holes of the inkjet heads (printing heads) that eject the ink of yellow, cyan, magenta, and black are arranged in the direction crossing (orthogonal to) the main running direction of the carriage 213, and oriented downwards. Ink tanks corresponding to respective colors are attached on the respective printing heads.

At the time of the printing, the printing heads are driven in accordance with an image signal while the carriage 213 is moved. At this time, the printing heads eject the ink on standing paper to perform the one-line printing. Subsequently, the paper is moved by a predetermined length by an assist running mechanism (sub-running mechanism) including an assist running motor 216, and the printing is then performed on the next line. When the printing mechanism 202 receives a printing end signal or a signal indicating that the back end of the paper reaches the printing region, the printing mechanism 202 stops the printing operation, and discharges the printed paper.

A recovering device 217 that makes the printing heads recover from deteriorated ejecting condition is disposed at the right end side of the moving direction of the carriage 213 off the printing region, as shown in FIG. 39. The recovering device 217 has cap means, sucking means, and cleaning means.

When the carriage 213 waits for the printing, the carriage 213 is moved to the recovering device 217, and the printing heads are capped by the cap means in order to maintain a wet state of the ejecting holes. In this manner, it is possible to prevent the deteriorated ink ejecting performance that is caused by the drying of the ink ejecting holes. Furthermore, by ejecting the ink that is not used for printing from the ink ejecting holes in the middle of the printing operation, the ink viscosity of all the ink ejecting holes can be made constant to maintain the stable ink ejecting performance.

When the ink cartridge is replaced or when the ink ejecting performance is deteriorated, the ink ejecting holes of the printing heads are capped by the cap means, and by using a tube, foam as well as the ink adhering to the surface of the ink ejecting holes is suctioned by the sucking means to remove the foam and the ink from the ink ejecting holes. In this manner, the printing heads can recover from the deteriorated ejecting condition. The suctioned ink is discharged to a waste ink receiving part (not shown) disposed at the lower part of the main body 201 of the printing apparatus. The waste ink in the waste ink receiving part may be absorbed and held by an ink absorbing body in the waste ink receiving part.

Figure 40:
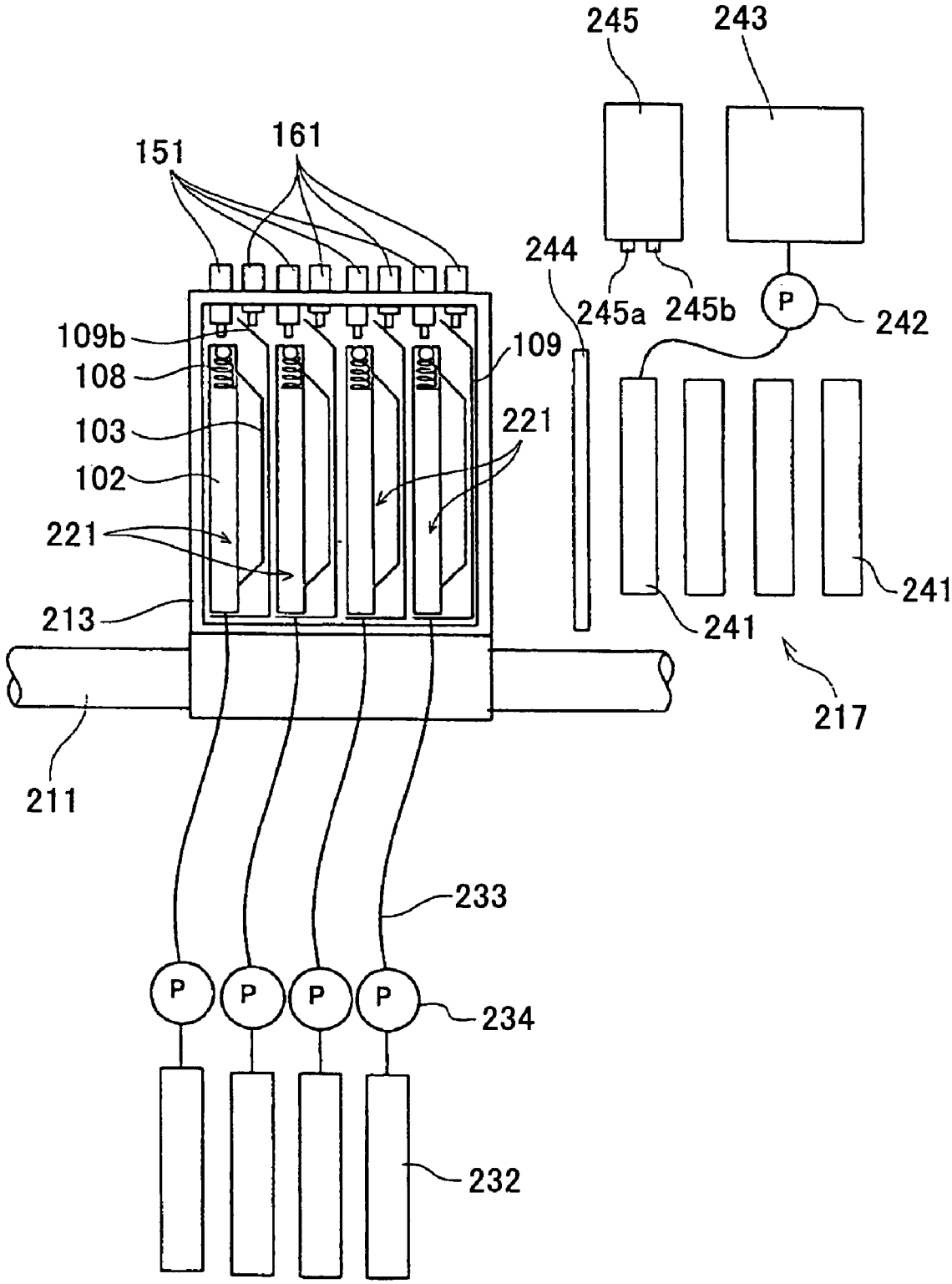
FIG. 40 is a plan view showing the important part of the inkjet printing apparatus shown in FIG. 39.
Figure 41:
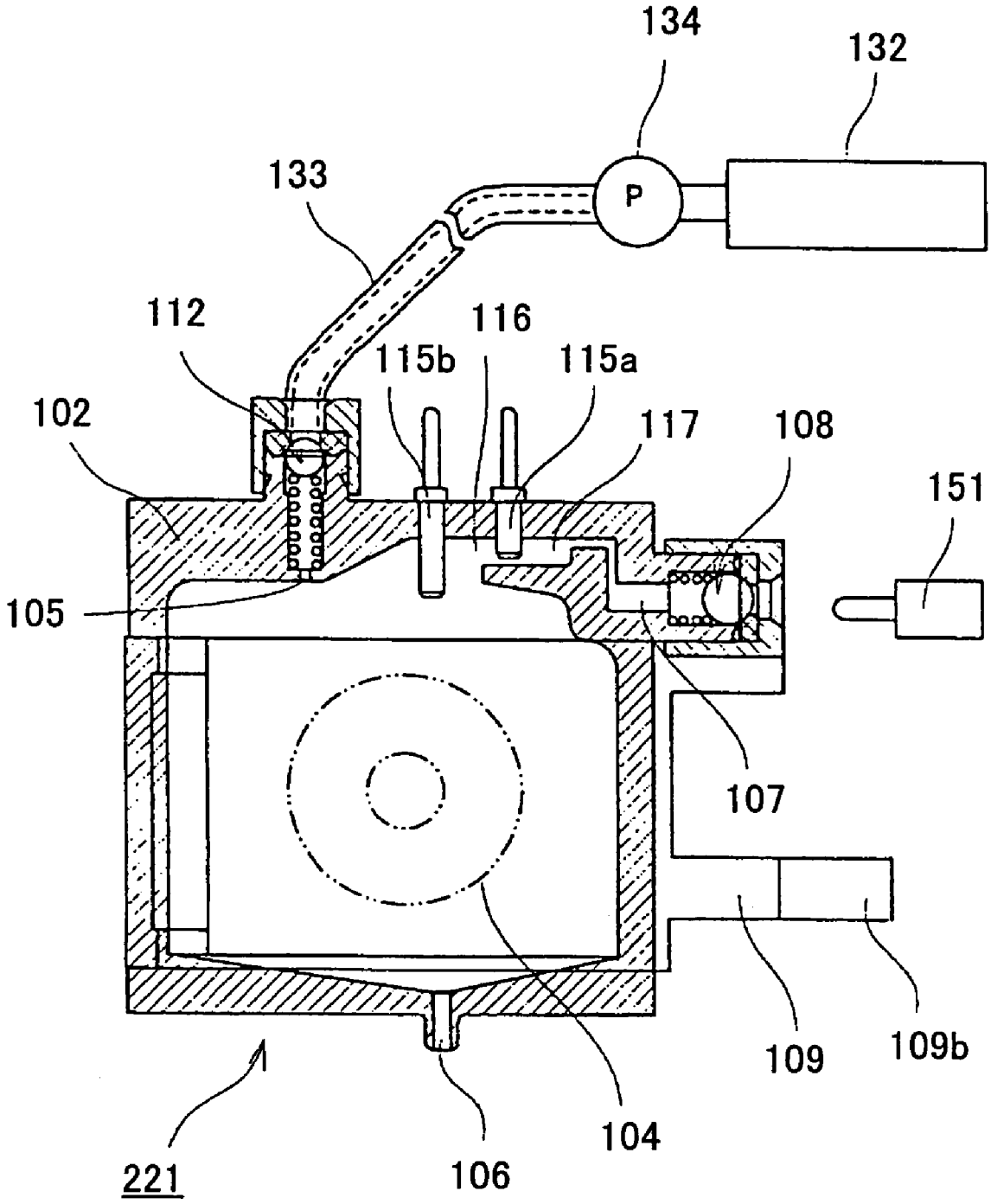
FIG. 41 is a partial sectional view showing an ink tank and an ink providing device of the inkjet printing apparatus shown in FIG. 39.
Figure 42:
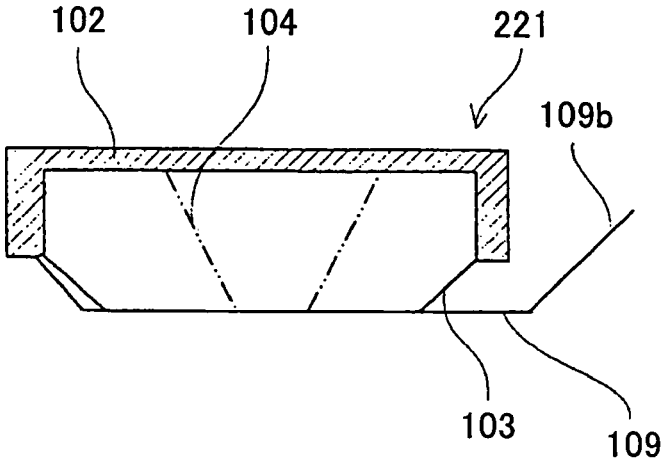
FIG. 42 is a sectional plan view showing the ink tank shown in FIG. 41.
Figure 43:
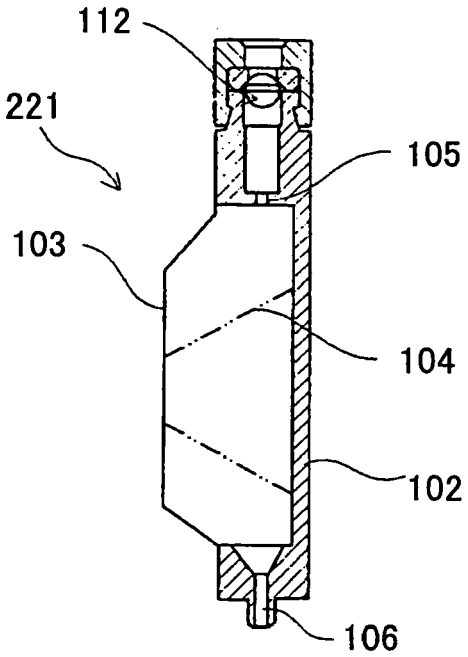
FIG. 43 is a sectional side view showing the ink tank shown in FIG. 41.

One example of an ink providing device that is applied to this inkjet printing apparatus shown in FIG. 39 will be described with reference to FIGS. 40 through 43. This ink providing device includes ink tanks 221. FIG. 40 is a plan view showing the entire structure of the ink providing device, FIG. 41 is a side view of FIG. 40, FIG. 42 is a plan view of the ink tank 221, and FIG. 43 is a side view of FIG. 42.

Four ink tanks 221 corresponding to four colors are mounted on the carriage 213 in order to obtain a full-color image by ejecting four colors. The printing heads located under the ink tanks 221 are connected directly to the ink tanks 221.

The ink tank 221 may be any of the ink tanks described in the above embodiments or combination thereof. As one example, each of the ink tanks 221 includes a case 102 made of resin, a flexible film 103 for covering an opening of the case 102, and a compressed spring 104 for pressing the film 103 in the outward direction. An ink providing opening 105 having a reverse flow prevention valve 212 is formed on the case 102. Further, an ink supply opening 106, and an air releasing opening 107 having an air releasing valve 108 are formed on the case 102. An air extraction space 116 is formed in each ink tank 221 at the upper side of each ink tank 221. A throttling part 117 that communicates with the air releasing opening 108 is formed at the air extraction space 116. A detection electrode 115*a* is disposed at the throttling part 117, and a detection electrode 115*b* is disposed at the inside surface of the upper wall of the case 102. Furthermore, a displacement member 109 provided outside the ink tank 221 moves in accordance with the movement of a flexible film 103 corresponding to the change in the capacity or volume of the ink tank 221. In addition, a displacement operation part 109*b* is formed on the displacement member 109. A valve operation pin 151 for opening and closing the air releasing valve 108 of each ink tank 221 is mounted on the carriage 213. An operation pin 161 for pressing the displacement operation part 109*b* of the displacement member 109 is also mounted on the carriage 213. The valve operation pin 151 can move forwards and backwards to and from the air releasing valve 108, and the operation pin 161 can move forwards and backwards to and from the displacement operation part 109*b*.

Each ink tank 221 is connected to a main cartridge 232 fixed on the main body of the printing apparatus via a tube 233 and a supply pump 234.

Meanwhile, the recovering mechanism 217 provided at the main body of the printing apparatus has the cap means 241 for capping the printing heads, and a sucking pump (or an evacuation pump) 242 that is the sucking means (or evacuation means). The sucking pump 242 is connected to the cap means 241 that is located at the position most near the printing region, out of the plural cap means 241, as shown in FIG. 40. The recovering mechanism 217 further includes a waste ink tank 243 for holding the sucked waste ink, and a wiper 244, provided next to the cap means 241, for wiping the ink, dust, and the like adhering to the nozzle surfaces of the printing heads.

The ink sucking means (in this example, the sucking pump) 242 may be connected to all of the cap means 241, but in this example, the sucking pump 242 is connected to the cap means located most near the printing region. In addition, the sucking pump 242 as the ink sucking means may include a tubing pump, a piston pump, or the like.

The wiping direction of the wiper 244 may be either the moving direction (main running direction) of the carriage 213 or the feeding direction of the paper (sub-running direction). In this example, at the time of the wiping, the wiper 244 is raised, and the wiping is performed by the movement of the carriage 213, that is, the main running direction wiping is performed.

Furthermore, a driving actuator 245 is provided at the side of the recovering mechanism 217. The driving actuator 245 has operation pieces 145*a* and 145*b* for moving valve operation pin 151 and an operation pin 161 forwards and backwards, respectively. In this example, the operation pin 161 for moving the displacement member 109 is not pressed backwards by a spring member, and the operation pin 161 is made to advance by one advancing and retreating motion of the operation piece 245*b* of the driving actuator 245, and is made to retreat by next one advancing and retreating motion of the operation piece 245*b*.

Figure 44:
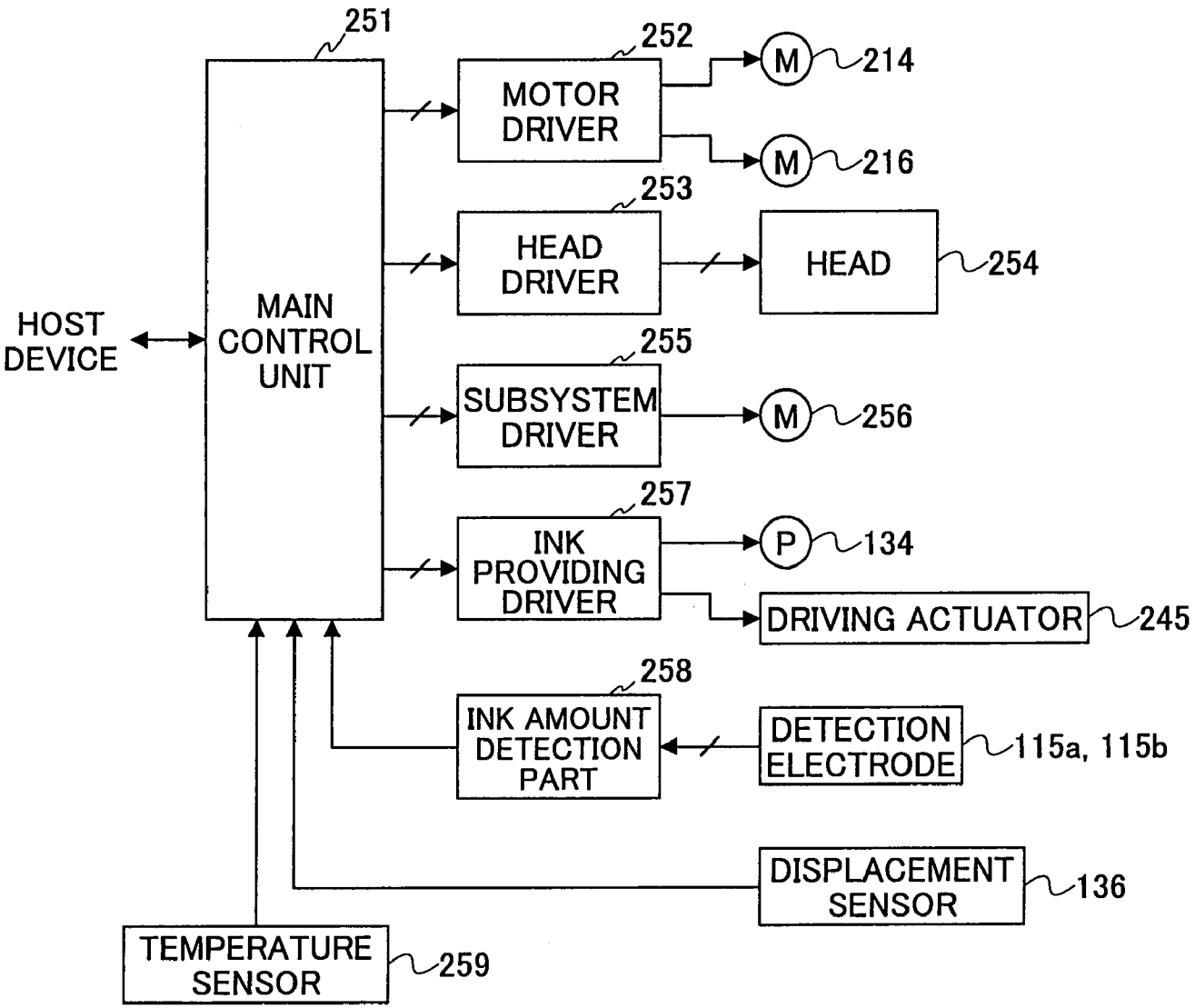
FIG. 44 is a block diagram of a control unit of the inkjet printing apparatus shown in FIG. 39.

Next, a control unit related to the ink providing in this inkjet printing apparatus will be described with reference to FIG. 44.

A main control unit 251 controls the entire inkjet printing apparatus, and includes a CPU, a ROM, a RAM, and an I/F (interface). The main control unit 251 receives printing data from a host device (not shown) via a cable or a line, and causes each unit to perform the printing operation. Furthermore, the main control unit 251 performs control so that the ink tank 221 can be filled with the ink, or a predetermined amount of ink can be supplied to the ink tank 221.

In other words, the main control unit 251 drives and controls the main running motor 214 via a motor driver 252 to move the carriage 213 in the main running direction. In addition, the main control unit 251 drives and controls an assist running motor 216 to move the paper in the sub-running direction. Further, the main control unit 251 causes printing data or the like to be sent to the head driver 253, and drives the pressure generation means of the printing head such as the inkjet head to eject the ink in accordance with the printing data. In this manner, an image is recorded on the paper. The inkjet head may be a piezoelectric type head having a piezoelectric element used for the pressure generation means, a thermal type head having a heat generation resistance body used for the pressure generation means, or a static electric type head having a vibration plate and an electrode.

The main control unit 251 drives and controls a motor 256 of the recovering device 217 via a subsystem driver 255. By using the motor 256, a cam mechanism, or the like, the recovering device 217 moves the cap means 241 and the wiper 244 upwards and downwards, starts and stops the operation of the sucking pump 242, and moves a carriage lock member (not shown) upwards and downwards.

Furthermore, the main control unit 251 drives and controls the supply pump 134 and a driving actuator 245 via an ink providing driver 257 so as to control the ink supply to the ink tank 221, the air releasing/shutting of the ink tank 221, and the capacity change of the ink tank 221.

The main control unit 251 is connected to the detection electrodes 115*a* and 115*b*, and receives from an ink remaining amount detection part 258 associated with the electrodes 115*a* and 115*b* an ink remaining amount signal indicating that the ink providing is completed, or the ink providing is nearly completed. Further, the main control unit 251 is connected to the displacement detection means (detection sensor) 136 for detecting movement of the displacement member 109 of the ink tank 221, and receives a signal from the displacement detection means 136. In addition, the main control unit 251 is connected to a temperature sensor 259 for detecting a circumambient temperature, and receives a detected temperature signal from the temperature sensor 259.

Next, an initial ink providing operation to the ink tank 221 in this inkjet printing apparatus will be described with reference to FIG. 45.

Figure 45:
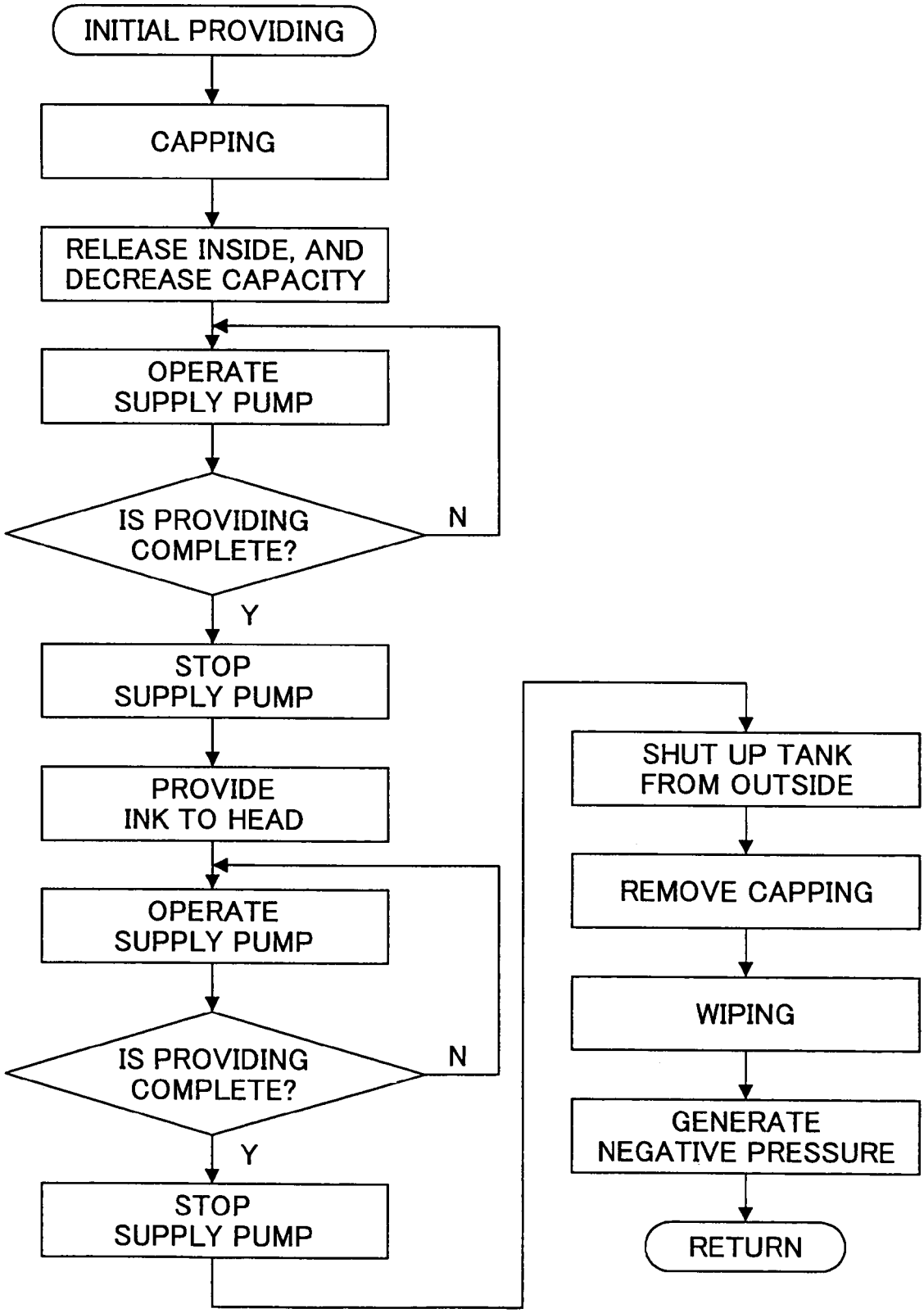
FIG. 45 is a flow chart of an initial ink providing operation performed by the control unit of FIG. 44.

In FIG. 45, first, the carriage 213 is moved to the side of the recovering device 217, and the ink tank 221 to be filled with the ink is moved to the place above the cap means 241 connected to the sucking pump 242. The motor 256 is driven to move the cap means upwards so that the nozzle surface of the printing head connected to the ink tank 221 capped by the cap means 241.

Secondly, the pin driving actuator 245 is driven to advance the valve operation pin 151 so that the air releasing valve 108 of the ink tank 221 can be opened. In addition, by the pin driving actuator 245, the operation pin 161 is made to advance to operate or press the displacement operation part 109*b* of the displacement member 109 so that the displacement member 109 can be moved or rotated. In this manner, the displacement member 109 presses the film 103 in the inward direction of the ink tank 221 against the spring force of the compressed spring in the ink tank 221 so that the inside capacity of the ink tank 221 can be reduced.

Thirdly, the supply pump 134 is operated to start the ink providing to the ink tank 221 from the ink cartridge (the main cartridge 132). Then, by checking a detected signal provided from the ink remaining amount detection part 258, it is determined whether or not the ink providing to the ink tank 221 is completed. When it is determined that the ink providing is completed, the operation of the supply pump 134 is stopped.

Fourthly, the sucking pump 242 is driven to suck the ink from the nozzle of the printing head 254 so that the printing head 254 can be filled with the ink. Thereafter, the supply pump 134 is again operated to supply to the ink tank 221 the ink corresponding to the amount reduced by sucking the ink to fill the printing head with the sucked ink so as to fill the ink tank 221 with the ink.

In this state, the ink exudes (leaks) from the nozzle because the inside of the ink tank 221 is open to the outside air. From this state, the operation of the part of the driving actuator 245 for driving the valve operation pin 151 is stopped to make the valve operation pin 151 retreat. The air releasing valve 108 is thereby closed, that is, the ink tank 221 is shut up from the outside air.

Subsequently, the motor 256 is driven to move the cap means 241 downwards so as to remove the capping on the printing head. In addition, the wiper 244 is made to move upwards, and the carriage 213 is moved so that the nozzle surface of the printing head 254 having the filled ink can be wiped by the wiper 244. In this manner, the meniscus is formed on the nozzle of the printing head 254, and the ink stops exuding from the nozzle.

Thereafter, the operation piece 145*b* of the driving actuator 245 is again moved forwards and backwards, so that the operation pin 161 is made to retreat, and the displacement member 109 can move or rotate. Accordingly, the film 103 of the ink tank 221 is pressed by the compressed spring 104, and the capacity of the ink tank 221 increases, resulting in the negative pressure being generated in the ink tank 221.

The initial ink providing operation is completed by performing the above-described procedure on all of the ink tanks 221, and the printing becomes ready to be performed.

Additionally, the negative pressure may be generated before the nozzle surface is wiped. However, in this case, the meniscus is not formed on the nozzle, and the negative pressure is generated in the state in which the ink that is sucked to the head remains on the nozzle surface, so that the foam generated at the nozzle tends to be recorded on the paper together with the ink.

Figure 46:
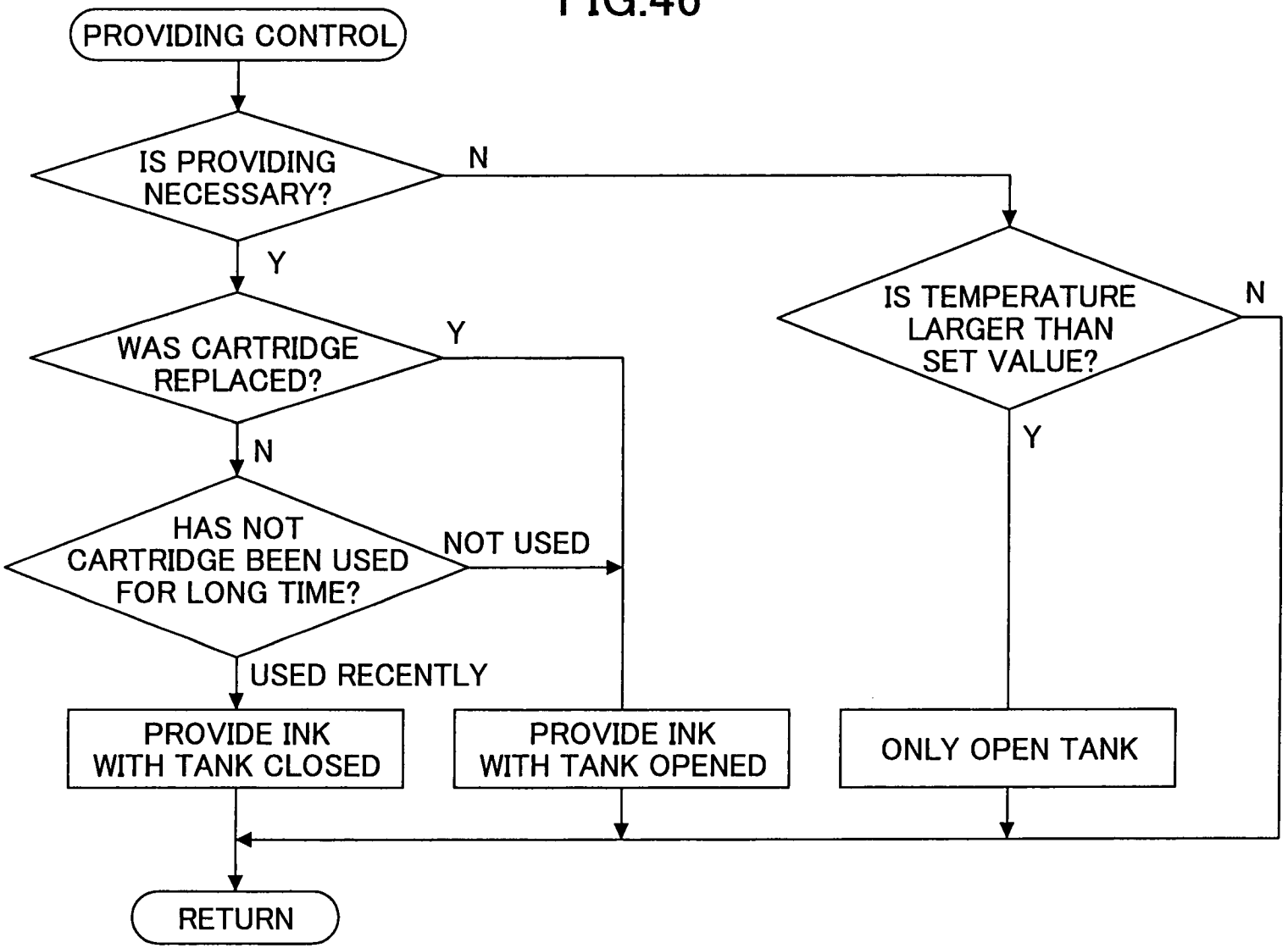
FIG. 46 is a flow chart of an ink supply control performed by the control unit of FIG. 44.

Next, ink providing control will be described with reference to FIG. 46.

First, based on a detected signal provided from the ink remaining amount detection part 258, or a signal provided from the displacement sensor 136, it is determined whether or not it becomes necessary to supply the ink to the ink tank 221. When the ink supply becomes necessary, it is determined whether or not the ink cartridge (the main ink cartridge) 132 has been replaced. When it is determined that the ink cartridge 132 has not been replaced, it is determined whether or not the ink cartridge 132 has not been used for a long time. If it is determined that the ink cartridge 132 was used recently, the ink is supplied to the ink 221 with the inside of the ink tank 211 being closed from the outside air. At this time, the ink is supplied to the ink tank 211 while the operation pin 151 of the driving actuator 245 is not operated so as to keep the air releasing pin 108 closed.

On the other hand, when the ink supply becomes necessary, and the ink cartridge 132 has been replaced with new one, or the ink cartridge 132 has not been used for a long time, the ink is supplied to the ink tank 211 with the inside of the ink tank 211 being open to the outside air. At this time, the operation pin 151 of the driving actuator 245 is operated so as to keep the air releasing valve 108 open.

In addition, even when the ink supply is not necessary, if based on a detected signal provided from the temperature sensor 259, it is determined that the temperature detected by the temperature sensor 259 continue to take a value more than a set value for a predetermined period, the operation pin 151 of the driving actuator 245 opens the air releasing valve 108, and the inside of the ink tank 211 is temporarily opened to the outside air.

In such a manner, the ink providing to the ink tank 211 with the inside of the ink tank 211 being closed from the outside air, and the ink providing to the ink tank 211 with the inside of the ink tank 211 being open to the outside air are selectively performed, so that the ink can be provided to the ink tank 211 for a long time without reducing the ink quality.

Figure 48:
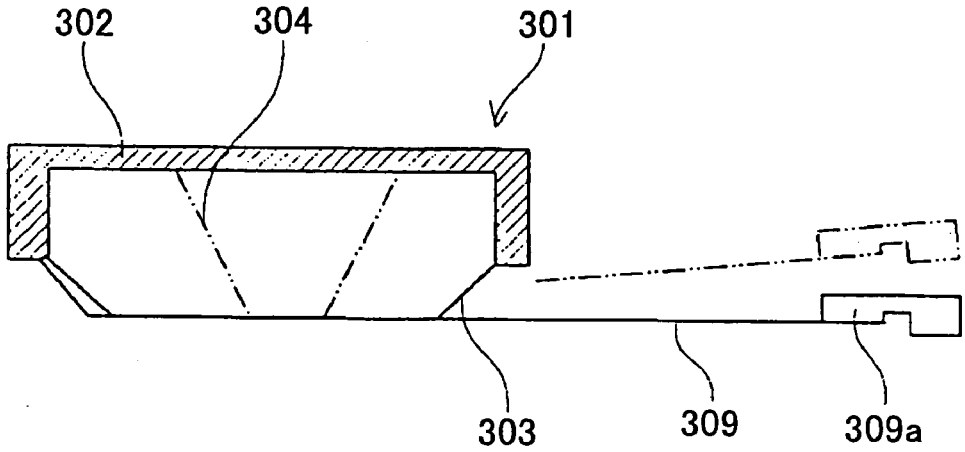
FIG. 48 is a sectional plan view showing the ink tank shown in FIG. 47.
Figure 49:
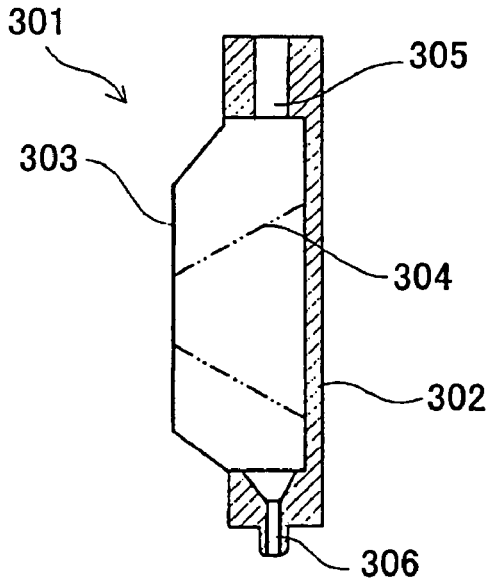
FIG. 49 is a sectional side view showing the ink tank shown in FIG. 47.

Next, a specific embodiment of the present invention will be described with reference to FIGS. 47 through 49. An inkjet printing apparatus, an ink tank, and an ink providing device in this embodiment are basically the same as those shown in FIGS. 39 through 43. A case 302 of an ink tank 301 is made of polyethylene resin, and one side of the case 301 is sealed by a flexible film 303. The inside capacity of the ink tank 301 is about 7 cc. The inside surface of the film 303 is formed by polyethylene having low density, and the outside surface of the film 303 is formed by nylon having the thickness of 80 μm. The inside surface and the outside surface of the film 303 are coupled to each other by heat melting. A compressed spring 304 is provided in the case 302 of the ink tank 301. In this example, the spring 304 is a swirl spring, and when the length of the compressed spring 304 changes by 6 mm, a spring force of about 20 to 50 gf is generated.

Figure 47:
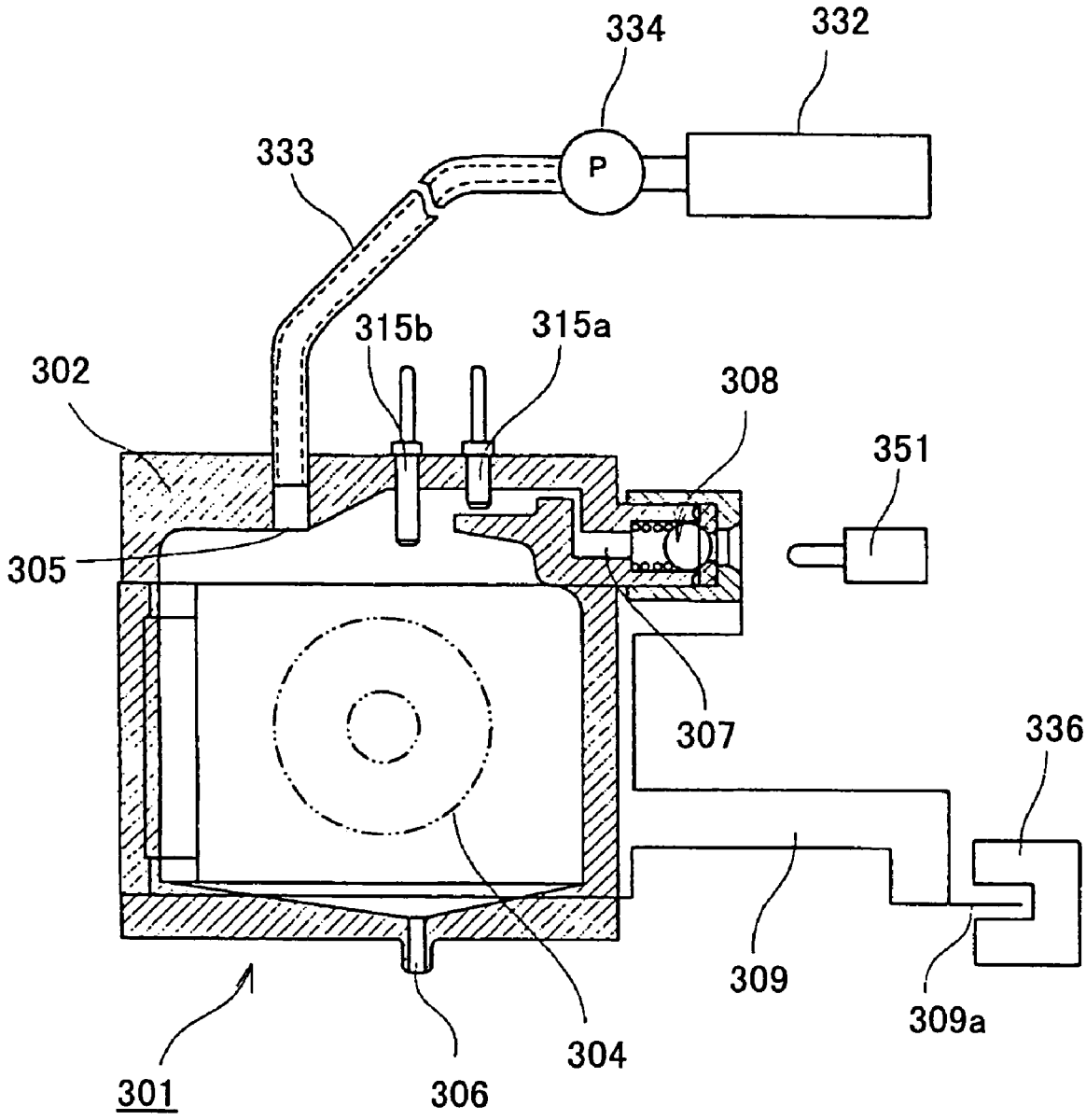
FIG. 47 is a partial sectional view showing an ink tank and an ink providing device according to a specific embodiment of the present invention.

As described in FIG. 47, metal pins 315*a* and 315*b* that detects the level of the ink are provided at the upper surface of the ink tank 301. An air releasing opening 307 that includes a penetrating opening having the diameter of about 2 mm is formed at the upper side of the case 302 of the ink tank 301. An air releasing valve 308 is provided at the air releasing opening 307. A part of the air releasing valve 308 is pressed by a spring provided at the air releasing valve 308 so as to be closed in a normal state. In addition, an ink providing opening 305 having a diameter of about 0.5 mm is formed at the upper part of the case 302 of the ink tank 301. A tube 333 having the inside diameter of 1 mm is connected to the ink providing opening 305. The other end of the tube 333 is connected to a main cartridge 332 via a piston pump 334.

As one example, the main cartridge 332 is a box-shaped cartridge covered with an aluminum film by vapor deposition. A leaf spring 309 having the thickness of 0.15 mm that is a displacement member 309 is formed on the outside surface of the film 203 of the ink tank 301. The displacement member 309 may be caulked and attached on the polyethylene case 303 by heat. This leaf spring is bent inwards so as to press the film 303 towards the inside of the ink tank 301 at the force of about 5 to 10 gf if the swirl spring 304 does not exist in the ink tank 301.

Furthermore, a detection piece 309*a* is provided at a free end of the leaf spring 309, and a photo sensor 336 is provided as displacement detection means for detecting the movement of the detection piece 309*a* of the leaf spring 309. An ink supply opening 306 is provided at the bottom surface of the ink tank 301, and is connected to the printing head in practical usage.

In this structure, the experiment was performed as follows. A pressure sensor for evaluating the ink tank 301 was provided at the ink supply opening 306 via a fluid resistance element that provides a fluid resistance value substantially equal to a fluid resistance value of the printing head.

In this experiment, the ink providing operation was carried out, and the sampling was performed so as to obtain the evaluation of the negative pressure in the ink tank 301. First, the operation pin 351 was made to advance, and the air releasing valve 308 was thereby opened. Then, in this state, the leaf spring 309 was moved by about 1 mm toward the inside of the ink tank 301 so as to press the film 303 toward the inside of the ink tank 301. As a result, the capacity of the ink tank 301 was reduced.

Secondly, the piston pump 334 was operated so as to provide the ink to the ink tank 301 until the impedance between the metal pins 315*a* and 315*b* functioning as the detection electrodes became low. When the ink tank 301 was filled with the ink, the pressure inside the ink tank 301 was measured. This measured pressure was a positive pressure of about 40 mmAq. Next, the operation pin that was pressing the air releasing valve 308 was moved backwards so as to close the inside of the ink tank 301 from the outside air. Thereafter, the pressing on the film 303 by the leaf spring 309 as the displacement member was released. In this state, the pressure in the ink tank 301 was measured. The measured pressure was a negative pressure of −20 mmAq.

Next, when the ink was discharged from the ink tank 301, the degree of the negative pressure in the ink tank 301 gradually increased as the discharged amount of the ink increased. When the amount of the discharged ink reached about 3.5 cc, the negative pressure became −100 mmAq. At this time, the film 303 completely deformed in the inside direction of the ink tank 301, and the free end of the leaf spring 309 contacted with the case 302, similarly with the case shown in FIG. 19.

Then, the air releasing valve 308 was opened again, and the ink was supplied to the ink tank 301 in the same manner as that of the initial ink providing. As a result of this, the ink amount of about 3.5 cc was supplied to the ink tank 301, and the negative pressure in the ink tank 301 became about −20 mmAq again.

Thereafter, the air releasing valve 308 was closed, the supply pump 334 was operated, and the ink was again discharged from the ink tank 301 until the negative pressure in the ink tank 301 reached the −100 mmAq. The ink supply was stopped by detecting the movement or deformation of the leaf spring 309 based on the output from the photo sensor 336. The movement of the leaf spring was detected by using the end part of the leaf spring 309, so that the amount of the movement of the leaf spring 309 could be magnified for the detection, resulting in the accurate detection. Therefore, with this accuracy, the ink supply to the ink tank 301 could be stopped at the negative pressure of −20 mmAq.

In the specific embodiment, additional experiment was carried out. The ink tank 301 used in the above experiment was connected to the printing head, and mounted on the carriage in the printing apparatus. In this experiment, the diameter of the ink providing opening was changed to be 2 mm to 5 mm, and with this diameter, the initial ink providing was carried out. However, when the operation of the piston pump 334 was stopped, and the air releasing valve 308 was closed, the air flowed in reverse, resulting in the air entering the ink providing tube 333. The printing evaluation was repeated until the ink tank 301 became vacant, and again, the ink tank 301 was filled with the ink while the inside of the ink tank 301 was closed from the outside air. Then, when the printing test was performed, good printing quality was obtained.

However, this printing apparatus was placed where a temperature was high, and when the same printing test was carried out at this place, an abnormal image was recorded. The air that entered inside of the ink tank 301 at the time of the ink providing to the ink tank 301 is considered to be the cause of this. Then, the negative pressure generating operation was performed again by opening the inside of the ink tank 301, and in this state, the normal printing quality was obtained. Furthermore, the reverse flow prevention valve 112 was provided at the ink providing opening 305, and when the printing test was carried out in this state, the reverse flow was not generated in the ink providing tube 333, and the stable printing quality was obtained.

In the above-described embodiments, the ink tank that holds the ink is used as a liquid tank, but a liquid tank used for the printing head that ejects liquid resist, a DNA sample, or other type of liquid may be applied to the embodiments of the present invention.

As described above, according to the ink tank related to the present invention, the negative pressure is generated inside the liquid tank (the ink tank) by changing the inside capacity of the ink tank, so that with the simple structure, it is possible to adjust the negative pressure without increasing unnecessary liquid (ink) consumption.

According to the ink tank related to the present invention, the liquid tank includes the air releasing opening that can be closed and opened so that the inside of the liquid tank can be closed and opened to the outside air. The negative pressure can be generated in the liquid tank by opening and closing the air releasing opening, and changing the capacity of the liquid tank. Accordingly, with the simple structure, it is possible to adjust the negative pressure in the liquid tank without increasing the unnecessary liquid consumption. Furthermore, with the simple structure, the negative pressure can be generated, and the inside of the liquid tank can be opened to the outside air, so that it is possible to provide the liquid having reliable quality for a long time. In addition, since the air releasing valve that can be kept closed by the spring member is installed at the air releasing opening of the liquid tank, it is possible to close and open the inside of the ink tank (liquid tank) to the outside air with the simple structure.

Furthermore, according to the liquid tanks of the above-described embodiments, the liquid (ink) can be supplied to the liquid tank via the liquid providing opening (ink providing opening) from the outside of the liquid tank; In the case of the liquid tank having the air releasing opening, the liquid providing opening is formed at the position lower than the position of the air releasing opening, so that the air can be prevented from flowing in reverse to the main cartridge, and the printing quality is not deteriorated. In addition, since the reverse flow prevention means for preventing the liquid from flowing in reverse from the liquid providing opening to the main cartridge, e.g., the valve means for preventing the liquid from flowing in the opposite direction, and/or the flow resistance body that produces large flow resistance is provided, it is possible to prevent the deterioration of the printing quality or the liquid quality caused by the flowing air in the reverse direction.

Further, the pressing means for pressing the liquid tank from the outside is provided, so that it is possible to generate the negative pressure with the simple structure. The displacement member that moves in accordance with the change of the capacity of the liquid tank is provided, so that it is possible to easily detect the capacity of the liquid tank. Furthermore, the movement of the displacement member is larger than the deforming of the liquid tank indicating the capacity change of the liquid tank, so that the detection accuracy can be improved. In addition, since the displacement member may has the member that changes the capacity of the liquid tank, it is possible to generate the negative pressure in the liquid tank with the simpler structure. The displacement member may be made of the material having the high thermal conductivity, so that it is possible to easily disperse the heat generated at the head driving circuit.

Furthermore, by installing at least two detection electrodes extending to the depths that are different from each other at the inside upper part of the liquid tank, it is possible to easily detect the amount of the liquid in the liquid tank. In the case of the liquid tank having the air releasing opening and the liquid providing opening, one of the detection electrodes is installed at the air extraction space directly communicating with the air releasing opening, so that the detection accuracy in detecting the level of the liquid in the liquid tank can be improved.

Furthermore, the spring member for generating the negative pressure, and the spring member for maintaining the negative pressure may be installed in the liquid tank, so that it becomes easy to adjust the negative pressure in the liquid tank. The inside of the liquid tank may be divided into two rooms, and two type of liquid may be accommodated in the two rooms, respectively, so that the space can be saved.

Since the liquid providing devices (ink providing devices) of the above-described embodiments have the liquid tank related to the present invention, it is possible to provide the liquid having the reliable quality for a long time. The liquid providing device may include liquid providing means for supplying the liquid to the liquid tank by using the difference in the pressure head, so that it is possible to provide the liquid to the liquid tank with the simple structure. Furthermore, the driving member that can move to cause the change in the capacity of the liquid tank may be provided on the member that fixes the liquid tank, so that it is possible to firmly change the capacity of the liquid tank. Further, the restriction member such as the restriction part 161*b* of FIG. 34 that restricts the amount of the movement of this driving member is provided, so that the varying amount of the capacity of the liquid tank can be kept in a predetermined range. The driving member such as the operation pin 161 of FIG. 34 may be provided such that a gap exists between the liquid tank and the driving member, and the spring such as the spring 163 of FIG. 34 may be provided for maintaining this gap in order to prevent the operation error.

According to the embodiments of the present invention, the liquid providing device may include the liquid providing means for selecting either the liquid providing operation in which the liquid is provided to the liquid tank with the inside of the liquid tank being open to the outside air, or the liquid providing operation in which the liquid is provided to the liquid tank with the inside of the liquid tank being closed from the outside air. Accordingly, it is possible to realize the stable liquid quality without reducing the liquid quality for a long time.

According to the embodiments of the present invention, the liquid providing device may include the opening/closing means for opening the inside of the liquid tank in accordance with the surrounding temperature. Accordingly, it is possible to realize the stable liquid quality without reducing the quality of the liquid for a long time.

According to the liquid providing devices of the above-described embodiments, the opening/closing driving member that can move to open and close the air releasing opening of the liquid tank is provided on the member for fixing the liquid tank. Accordingly, it is possible to firmly open the inside of the liquid tank to the outside air. In addition to that, the restriction member such as the restriction member 151*b* of FIG. 32A for restricting the movement amount of the opening/closing member is provided, so that the opening degree of the air releasing opening can be kept constant. Furthermore, the opening/closing driving means such as the operation pin 151 of FIG. 32A may be provided such that a gap exists between the liquid tank and the opening/closing driving member, and the spring member such as the spring 153 of FIG. 32A for maintaining this gap may be provided in order to prevent the operation error.

The inkjet printing apparatus according to the present invention may include the liquid tank and/or the liquid providing device (ink providing device) related to the present invention. Accordingly, the inkjet printing apparatus can stably perform the printing having the high quality. In addition, the inkjet printing apparatus may have the wiping means for wiping the nozzle surface of the printing head before the negative pressure is generated in the liquid tank. Accordingly, it is possible to stably provide the ink to the head in this inkjet printing apparatus.

According to the present invention, the liquid tank may be formed integrally with the inkjet head that ejects the ink. Accordingly, with the simple structure, the ink can be stably supplied to the inkjet head while the liquid tank can hold the ink having the negative pressure.

This patent application is based on Japanese priority patent application Nos. 2002-030232 and 2002-040038 filed on Feb. 7, 2002 and Feb. 18, 2002, respectively, the entire contents of which are hereby incorporated by reference.

The invention claimed is:

1. An inkjet apparatus, comprising:

an inkjet head; and a liquid tank that holds liquid supplied from a cartridge and that supplies liquid to the inkjet head, the liquid tank including:

a flexible film configured to close an opening of a case forming the liquid tank;

a spring member, provided inside the liquid tank, configured to press the flexible film in a direction towards the outside of the liquid tank to generate a negative pressure from a state having no negative pressure in the liquid tank;

a pressing member provided outside the liquid tank, configured to press the flexible film against the spring member in the liquid tank from the outside of the liquid tank to change the amount of the negative pressure in the liquid tank; and a liquid providing opening configured to receive liquid from the cartridge into the liquid tank.

2. The inkjet apparatus according to claim 1, the liquid tank further including:

an air releasing opening that is opened and closed so that an inside of the liquid tank is opened and closed to outside air, wherein the capacity of the liquid tank is decreased by pressing the flexible film by the pressing member in a state having no negative pressure in the liquid tank while the air releasing opening is opened, and thereafter, the liquid is provided inside the liquid tank, the air releasing opening is closed and the pressing member is released so that the capacity of the liquid tank is increased by a pressure of the spring member and a negative pressure is generated in the liquid tank.

3. The inkjet apparatus according to claim 2, the liquid tank further comprising an air releasing valve, provided at the air releasing opening, for keeping the air releasing opening closed.

4. The inkjet apparatus according to claim 2, wherein a position of the liquid providing opening is lower than a position of the air releasing opening.

5. The inkjet apparatus according to claim 1, the liquid tank further comprising a reverse flow prevention valve configured to prevent liquid from flowing in reverse from the liquid providing opening.

6. The inkjet apparatus according to claim 5, wherein the reverse flow prevention means include valve means for preventing liquid from flowing in reverse from the liquid providing opening, or a fluid resistance part that produces large fluid resistance.

7. The inkjet apparatus according to claim 1 or 2, the liquid tank further comprising a displacement member that moves in accordance with change of the capacity of the liquid tank.

8. The inkjet apparatus according to claim 7, wherein an amount of movement of the displacement member is larger than an amount of deformation of the liquid tank that indicates the change of the capacity of the liquid tank.

9. The inkjet apparatus according to claim 7, wherein liquid providing to the liquid tank is controlled based on a position of the displacement member.

10. The inkjet apparatus according to claim 7, wherein the displacement member has a function of changing the capacity of the liquid tank.

11. The inkjet apparatus according to claim 7, wherein the displacement member is made of a material having high thermal conductivity.

12. The inkjet apparatus according to claim 1, the liquid tank further comprising at least two detection electrodes tat are provided at an upper part of an inside of the liquid tank, extend to respective different depths of the liquid tank, and detect a level of liquid in the liquid tank.

13. The inkjet apparatus according to claim 1, the liquid tank further comprising:

at least two detection electrodes, provided at an upper part of the inside of the liquid tank, for detecting a level of liquid inside the liquid tank; and an air extraction space that communicates with the air releasing opening, wherein one of the detection electrodes is provided at the air extraction space.

14. The inkjet apparatus of claim 13, wherein the liquid tank further comprising at least one throttling part that is formed by making a part of the air extraction space narrow, and said one of the detection electrodes is provided at the throttling part.

15. The inkjet apparatus according to claim 1, the liquid tank further comprising a valve that is provided at the liquid providing opening and is opened and closed in accordance with a pressure inside the liquid tank.

16. The inkjet apparatus according to claim 1 or 2, the liquid tank further comprising:

a second spring member, provided inside the liquid tank, for maintaining a negative pressure inside the liquid tank.

17. The inkjet apparatus according to claim 1, wherein liquid providing to the liquid tank is stopped after the liquid providing opening is filled with the liquid.

18. The inkjet apparatus according to claim 1 or 2, the liquid tank comprising a part that divides an inside of the liquid tank into two rooms and isolates the rooms from each other so that one of the rooms holds one liquid, and the other of the rooms holds another liquid.

19. The inkjet apparatus of claim 1, further comprising a liquid providing device, wherein the liquid providing device provides liquid to an inside of the liquid tank from outside the liquid tank, and supplies liquid to the inkjet head of the printing apparatus from the liquid tank.

20. The inkjet apparatus according to claim 19, wherein the liquid providing device provides liquid to the inside of the liquid tank by using difference in a pressure head.

21. The inkjet apparatus according to claim 19, further comprising a driving member that is provided on a member for fixing the liquid tank thereon and moves so as to change the capacity of the liquid tank.

22. The inkjet apparatus according to claim 21, further comprising a restriction member for restricting an amount of movement of the driving member.

23. The inkjet apparatus according to claim 21, wherein the driving member is provided on the member for fixing the liquid tank such that a gap exists between the liquid tank and the driving member, and the liquid providing device includes a spring member for maintaining the gap.

24. The inkjet apparatus of claim 19, wherein the liquid providing device provides liquid to the inside of the liquid tank by selecting either a state where the inside of the liquid tank is opened to outside air or a state where the inside of the liquid tank is closed from outside air.

25. An inkjet apparatus as described in claim 24, wherein the liquid is ink, and the inkjet apparatus uses the liquid providing device to supply ink to the inkjet head from the liquid tank, and the inkjet printing apparatus further comprises means for wiping a nozzle surface of the inkjet head before the negative pressure is generated inside the liquid tank.

26. The inkjet apparatus of claim 19 wherein the liquid providing device opens or closes an air releasing opening of the liquid tank in accordance with a surrounding temperature.

27. The inkjet apparatus of claim 19 wherein the liquid providing device includes an opening/closing driving member that is provided on a member for fixing the liquid tank and moves so as to open and close the air releasing opening of the liquid tank.

28. The inkjet apparatus according to claim 27, further comprising a restriction member for restricting an amount of movement of the opening/closing driving member that moves so as to open and close the air releasing opening, or further comprising a restriction member for restricting an amount of movement of the opening/closing driving member.

29. The inkjet apparatus according to claim 28, wherein the opening/closing driving member is provided on a member for fixing the liquid tank such that a gap exists between between the liquid tank and the opening/closing driving member, and the liquid providing device further comprises a second spring member for maintaining the gap.

30. An inkjet apparatus as described in claim 19, further comprising an inkjet head, comprising the liquid providing device described in claim 19, wherein the liquid is ink, and the inkjet apparatus uses the liquid providing device to supply ink to the inkjet head from the liquid tank.

31. An inkjet apparatus as described in claim 1, further comprising an inkjet head, wherein the liquid is ink, and the inkjet apparatus supplies ink to the inkjet head from the liquid tank.

32. The inkjet apparatus according to claim 31, further comprising a wiper configured to wire a nozzle surface of the inkjet head before the negative pressure is generated inside the liquid tank.

33. An ink cartridge comprising:

the inkjet apparatus described in claim 1, wherein liquid is ink, and the inkjet head is integrally formed on the liquid tank.

34. A pressure adjustment mechanism for an inkjet head device, comprising:

a head that ejects ink;

a carriage that mounts the head thereon and moves;

a subtank that is mounted on the carriage, temporarily holds ink provided from a cartridge, and provides the temporarily held ink to the head;

a lever that is moved to adjust a pressure inside the subtank; and diving means for moving the lever selectively to a first position of the lever or a second position of the lever, wherein the subtank includes pressure adjustment means that have air releasing control means and negative pressure control means, the air releasing control means are provided on a side wall of the subtank, enable an inside of the subtank to be opened to outside air, and enable the inside of the subtank to be closed from outside air, and the negative pressure control means generate a negative pressure inside the subtank, the lever acts on the pressure adjustment means at the first position of the lever when the carriage is at a second position of the carriage, and the acting on the pressure adjustment means by the lever is released at the second position of the lever, the driving means include a cam that acts on the lever so as to move the lever, and means for rotating the cam, and when the carriage is at a first position of the carriage where the lever does not act on the pressure adjustment means even if the lever is moved to the first position of the lever, the lever is moved by the driving means to the first position of the lever, and the carriage is moved to the second position of the carriage with the lever being at the first position of the lever to perform air releasing control for the subtank and negative pressure control for the subtank.

35. The pressure adjustment mechanism according to claim 34, further comprising:

a plurality of subtanks that are mounted on the carriage, have a substantially same structure as that of said subtank, and hold ink whose types are different from each other;

a plurality of levers that have a substantially same structure as that of said lever; and a plurality of pressure adjustment means that are respectively provided on the plurality of subtanks, and have a substantially same structure as that of said pressure adjustment means, wherein each of the plurality of pressure adjustment means receive action applied by one of the plurality of levers.

36. The pressure adjustment mechanism according to claim 35, wherein when a series of movements of one of the plurality of levers successively or simultaneously causes some of the plurality of pressure adjustment means to function, ink is provided to some of the plurality of subtanks corresponding to the some of the plurality of pressure adjustment means.

37. The pressure adjustment mechanism according to claim 34, wherein the pressure adjustment means include an air releasing pin that enables an air releasing opening formed on the subtank to be opened and closed so as to perform the air releasing control, the negative pressure means include a negative pressure pin that moves a part of a wall constituting the subtank so as to control a pressure inside the subtank to be a desired negative pressure, the lever presses the air releasing pin and the negative pressure pin at the first position of the lever when the carriage is at the second position of the carriage, and the lever is separated from the air releasing pin and the negative pressure pin at the second position of the lever, and the air releasing pin is separated from the negative pressure pin in a vertical direction.

38. The pressure adjustment mechanism according to claim 34, wherein when the lever acts on the pressure adjustment means and receives a reaction force that is generated from the pressure adjustment means and that causes a stress acting on the lever in a direction of releasing the acting by the lever on the pressure adjustment means, the stress received by the lever acts on the cam towards a center axis of a rotational shaft of the cam so as to restrain movement of the lever caused by the stress.

39. An inkjet printer comprising the pressure adjustment mechanism described in claim 34, wherein the inkjet printer provides ink to an inside of the subtank while the inkjet printer uses the pressure adjustment mechanism so as to adjust a pressure in the subtank.

40. An inkjet apparatus, comprising:

an inkjet head that ejects liquid; and a liquid tank that holds liquid supplied from a cartridge and that supplies liquid to the inkjet head, the liquid tank including:

a flexible film configured to close an opening of a case forming the liquid tank;

a spring member, provided inside the liquid tank, configured to press the flexible film in a direction towards the outside of the liquid tank to generate a negative pressure from a state having no negative pressure in the liquid tank;

a liquid providing opening configured to receive liquid from the cartridge into the liquid tank; and an air releasing opening that is opened and closed so that an inside of the liquid tank is opened and closed to outside air.

41. The inkjet apparatus according to claim 40, wherein the liquid tank further comprises a displacement member that moves in accordance with deformation of the flexible film that indicates change of the capacity of the liquid tank.

42. The inkjet apparatus according to claim 41, wherein an amount of movement of the displacement member is larger than an amount of deformation of the flexible film.

43. The inkjet apparatus according to claim 41, wherein liquid providing to the liquid tank is controlled based on a position of the displacement member.

44. The inkjet apparatus according to claim 41, further comprising a displacement detection part configured to detect the deformation of the flexible film by detecting the deformation of the displacement member.

45. The inkjet apparatus according to claim 41, wherein the displacement member rotates on a corner of the liquid tank in accordance with the deformation of the flexible film.

46. The inkjet apparatus according to claim 40, wherein the liquid tank further comprises a detection electrode that is provided at an upper part of an inside of the liquid tank configured to detect a level of liquid in the liquid tank.

47. The inkjet apparatus according to claim 40, wherein the liquid tank further comprises a valve that is provided at the liquid providing opening and is opened and closed in accordance with a pressure inside the liquid tank.

48. The inkjet apparatus according to claim 40, further comprising a liquid providing device that provides liquid to an inside of the liquid tank from outside the liquid tank, and that supplies liquid to the inkjet head of the printing apparatus from the liquid tank.

49. The inkjet apparatus according to claim 48, wherein the liquid providing device provides liquid to the inside of the liquid tank by using difference in a pressure head.

50. The inkjet apparatus according to claim 48, wherein the liquid providing device provides liquid to the inside of the liquid tank by selecting either a state where the inside of the liquid tank is opened to outside air or a state where the inside of the liquid tank is closed from outside air.

51. The inkjet apparatus according to claim 48, wherein the liquid providing device opens or closes an air releasing opening of the liquid tank in accordance with a surrounding temperature.

52. The inkjet apparatus according to claim 40, further comprising a wiper configured to wipe a nozzle surface of the inkjet head before the negative pressure is generated inside the liquid tank.

* * * * *